US005499741A

United States Patent [19]

Scott et al.

[11] Patent Number: 5,499,741

[45] Date of Patent: Mar. 19, 1996

[54] APPARATUS FOR MAKING OR DISPENSING DRINKS

[76] Inventors: Alistair Scott, 32 Mill Lane, Impington Cambridge CB4 4XN; Allen J. Pearson, 17 Docksgate, Somersham Cambridge PE17 3NZ; James T. Collins, 22 Primrose Drive, Yaxley Peterborough, all of England

[21] Appl. No.: 209,425

[22] Filed: Mar. 9, 1994

Related U.S. Application Data

[62] Division of Ser. No. 778,811, Jan. 23, 1992, abandoned.

[30] Foreign Application Priority Data

Jun. 23, 1989 [GB] United Kingdom ..... 8914420
May 2, 1990 [GB] United Kingdom ..... 9009947

[51] Int. Cl.[6] ..... B67D 5/56

[52] U.S. Cl. ..... 222/95; 222/129.4; 222/207; 222/212; 222/213; 222/389

[58] Field of Search ..... 222/95, 96, 129.4, 222/213, 207, 212, 334, 389

[56] References Cited

U.S. PATENT DOCUMENTS

| | | | |
|---|---|---|---|
| 2,974,834 | 3/1961 | Foote et al. | 222/207 X |
| 3,288,332 | 11/1966 | Etter et al. | 222/334 X |
| 3,455,487 | 7/1969 | Crippen et al. | 222/334 X |
| 3,599,833 | 8/1971 | Reichenberger | 222/23 |
| 3,688,947 | 9/1972 | Reichenberger | 222/129.1 X |
| 3,884,391 | 5/1975 | Pauliukonis | 222/334 X |
| 3,920,149 | 11/1975 | Fortino et al. | 222/129.3 X |
| 4,120,424 | 10/1978 | Zygiel | 222/334 X |
| 4,121,584 | 10/1978 | Tumer et al. | 222/207 X |
| 4,334,640 | 6/1982 | van Overbruggen | 222/207 |
| 4,580,721 | 4/1986 | Coffee et al. | 222/23 X |
| 4,660,742 | 4/1987 | Ozdemir | 222/63 X |
| 4,673,112 | 6/1987 | Bonerb | 222/389 X |
| 4,687,120 | 8/1987 | McMillin | 222/334 X |
| 4,719,056 | 1/1988 | Scott | 222/129.2 |
| 5,031,797 | 7/1991 | Boris et al. | 222/23 |

FOREIGN PATENT DOCUMENTS

| | | | |
|---|---|---|---|
| 0115166 | 12/1983 | European Pat. Off. . | |
| 2078867 | 1/1982 | United Kingdom | 222/334 |
| 2233960 | 1/1991 | United Kingdom | 222/129.1 |
| 2236736 | 4/1991 | United Kingdom | 222/129.1 |

*Primary Examiner*—Andres Kashnikow
*Assistant Examiner*—Kenneth Bomberg
*Attorney, Agent, or Firm*—Lerner, David, Littenberg, Krumholz & Mentlik

[57] ABSTRACT

Apparatus for producing carbonation flavoured drinks has a number of features. Water introduced to a water break from the mains supply holds a value open whilst the carbonation chamber is being filled. A concentrate supply includes a metering chamber into which concentrate flows under gravity and from which concentrate is discharged by gas pressure. The concentrate containers include means to indicate the type of concentrate therein and the degree of carbonation of water is controlled by detecting this indication. Change-over from one gas supply bottle to another is achieved utilising the pressure of the gas in the bottle to displace an element which effects the change-over. Concentrate in supply containers thereof is cooled by coolant used from cooling the carbonation chamber.

11 Claims, 24 Drawing Sheets

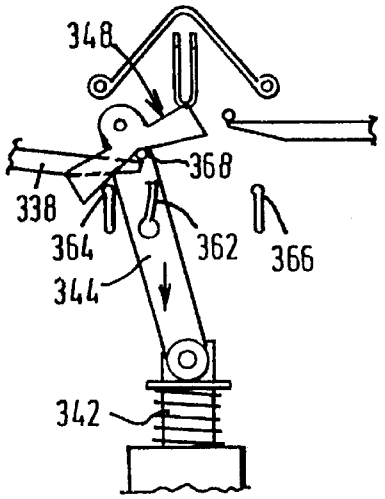
FIG. 13L
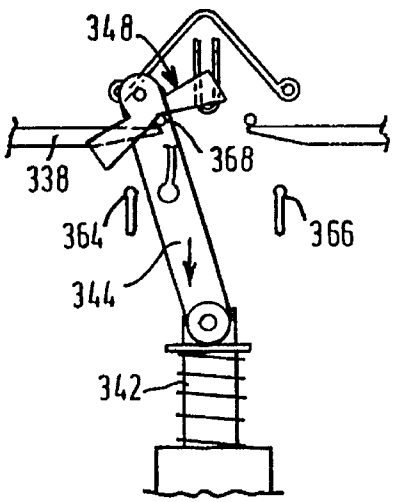
FIG. 13K
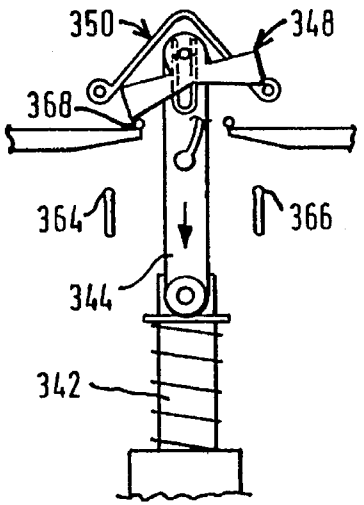
FIG. 13J
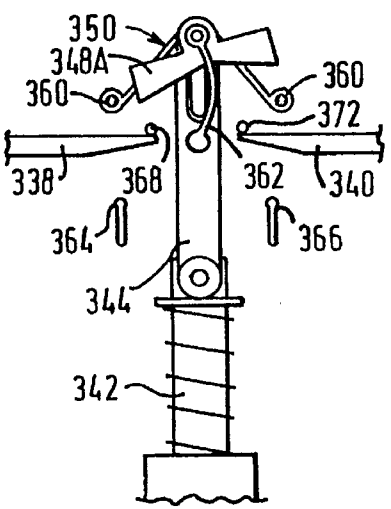
FIG. 13I
FIG. 13P
FIG. 13O
FIG. 13N
FIG. 13M

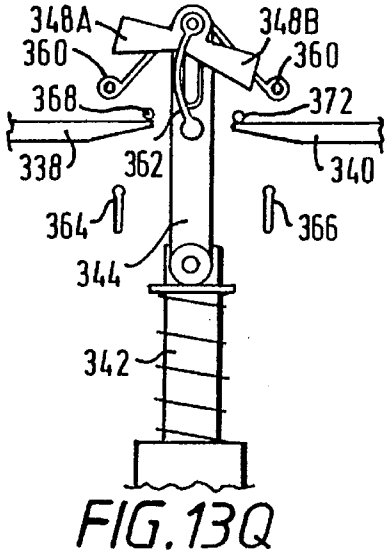
FIG. 13Q
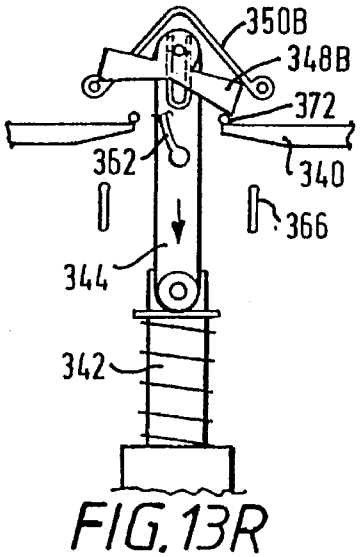
FIG. 13R
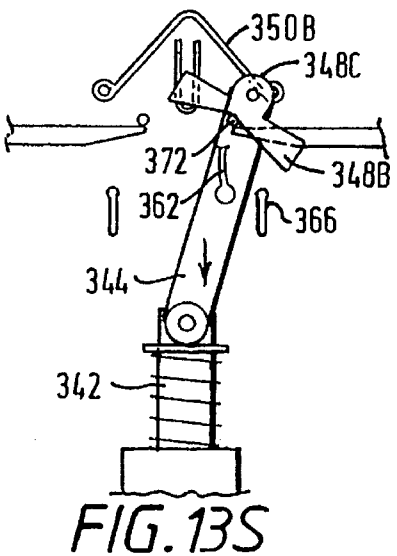
FIG. 13S
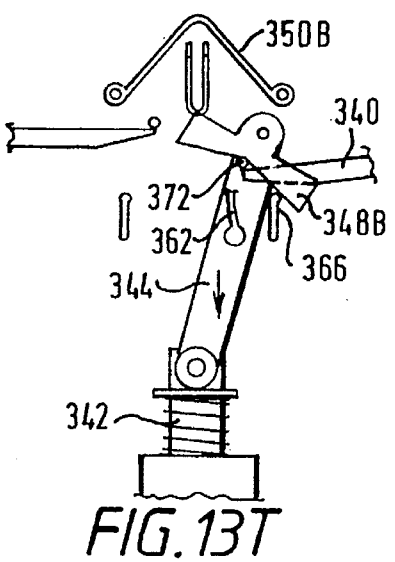
FIG. 13T
FIG. 13U
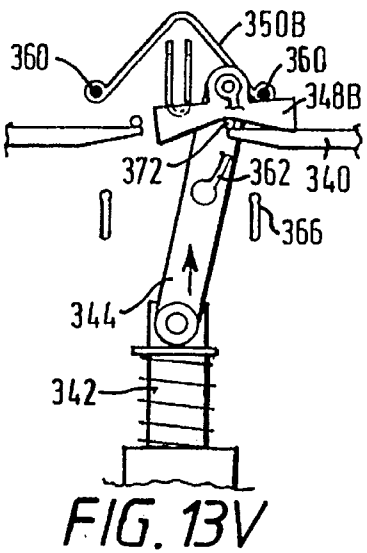
FIG. 13V
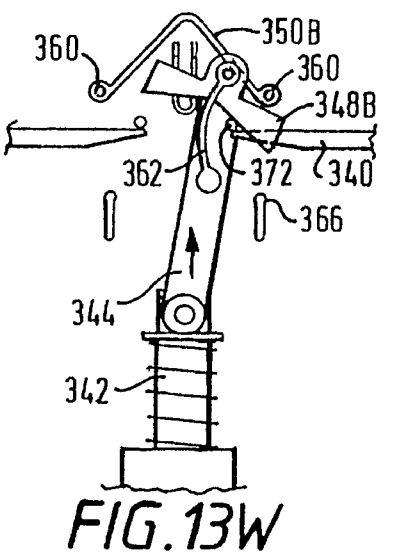
FIG. 13W
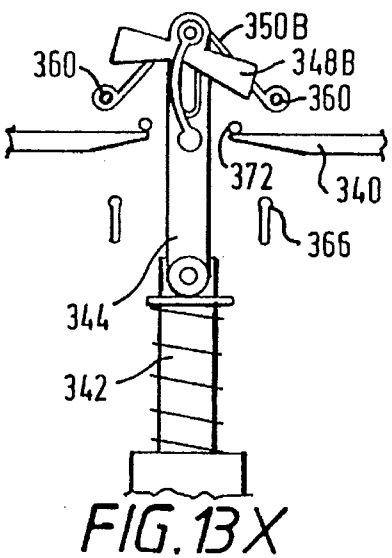
FIG. 13X

APPARATUS FOR MAKING OR DISPENSING DRINKS

This is a division of application Ser. No. 07/778,811 filed Jan. 23, 1992, now abandoned.

This invention relates to apparatus for making or dispensing carbonated drinks.

Apparatus for dispensing carbonated drinks disclosed in our earlier GB Patent 2,161,089 is primarily intended for domestic use. The water container is filled periodically according to demand. The number of carbonated drinks which it is intended to dispense in the course of an evening is relatively small compared with the demand that might be expected from such apparatus installed in a social club or public bar.

Accordingly, applicants have designed a new carbonation apparatus which is particularly but not exclusively useful in such an environment. This has led to considerable development of various facets of the apparatus which are disclosed herein.

In the earlier apparatus concentrate (which is used to flavour drinks) was dispensed by pressurising the concentrate (liquid) in the concentrate bottles so that the concentrate flowed through a dip stick to a dispenser, that dispenser was provided with a valve arrangement. The valve arrangement was actuated mechanically when the user pushed a glass into a dispensing compartment. The means by which the valve arrangement was actuated included a mechanical selector (by which the desired flavour of concentrate was selected). That selector was required to be aligned by the user with the valve arrangement for the required concentrate before the glass (cup) was so positioned in the dispensing compartment that it would mechanically actuate the valve arrangement to dispense concentrate (flavouring).

Such apparatus is perfectly satisfactory for its intended use and environment. Applicants now provide, in one aspect of the invention, apparatus wherein for volume usage drinks can be more rapidly dispensed (in terms of the frequency of use).

A further object is to provide in an embodiment means for the selection of the concentrate to obtain the flavour desired by the user without mechanically resetting a selector.

The invention, however, has a number of features and aspects as will be described.

Dispensing Drinks

According to one aspect of the present invention there is provided carbonation apparatus for dispensing carbonated drinks having a carbonation chamber and a gas supply, dispensing means for dispensing a given quantity of concentrate for flavouring carbonated water to provide a drink is actuated by carbonation gas. In this embodiment there is means for employing the carbonation gas from the head space of the carbonation chamber to actuate the dispensing means to dispense concentrate. The dispensing means may be charged with concentrate by free flow from a concentrate container in a first step prior to dispensing in a second step.

In one embodiment, the dispensing means delivers a measured quantity of concentrate and this is affected by a charge of carbonation gas and not by a mechanically actuated valve. In an embodiment provision is made whereby the quantity of concentrate dispensed may be different for different concentrates. The dispensing means may be adapted to deliver a quantity which is related to the flavour of the concentrate. This enables (as further explained later) the ratio of concentrate to carbonated water to be varied as appropriate to the flavour being selected.

According to another aspect of the invention there is provided a dispensing mechanism for concentrate for carbonated drinks comprising a concentrate chamber for receiving concentrate through an opening thereto from a concentrate container. An inlet valve mechanism for a charge of carbonation gas. The carbonation gas actuating the dispensing mechanism to dispense said quantity of concentrate. An outlet mechanism to permit said quantity of concentrate to be dispensed in response to pressure exerted by the carbonation gas.

In a preferred embodiment the dispensing mechanism includes diaphragm means in the concentrate chamber, the carbonation gas acting on the diaphragm means to expel said quantity of concentrate.

According to another aspect of the invention there is provided carbonation apparatus having a dispensing means actuated by the carbonation gas wherein the flow of carbonation gas to said concentrate dispensing means is controlled by a concentrate selection mechanism for selecting the concentrate of that dispensing mechanism. In an embodiment, the selection mechanism is operable to allow carbonation gas from said dispensing means to be exhausted to atmosphere thereby to permit recharging of the dispensing mechanism with concentrate.

The selection mechanism may be operable to cause the carbonation chamber to commence dispensing carbonated water and the or a selected dispensing means to commence dispensing concentrate in timed relationship.

Low Cost Syrup Metering Unit

An object of one aspect of the invention is to provide a low cost syrup metering unit, preferably a unit of such low cost that it may be disposed of after use.

In one aspect, the invention provides a device for discharging liquid comprising a housing defining a metering chamber for receiving the liquid, at least a portion of the housing being distortable by pressure to open an outlet for discharge of the fluid in the metering chamber.

Another aspect of the invention provides a device for discharging metered quantities of fluid comprising a housing defining a metering chamber having opposed wall means which are movable apart under pressure to open an outlet for discharging fluid from the chamber.

In a further aspect) the invention provides a concentrate container for containing flavoured concentrate for a carbonated drink, a metering device mounted on said container and adapted for discharging concentrate therefrom in metered quantities, first valve means between the metering chamber and the concentrate container for permitting concentrate to flow from the container into the metering chamber under gravity when the container is orientated with the metering chamber below the container, and a second valve means arranged to open when the first valve means is open to permit air to enter the container and rise through the concentrate therein as concentrate leaves the container and enters the metering chamber.

In a further aspect, the invention provides a container for containing concentrate or other liquid to be dispensed and comprising first and second valves disposed in the region of a portion of the container which is to be lowermost when dispensing liquid, the first valve being arranged to open to permit liquid to leave the container under gravity and the second valve being positioned higher than said first valve (when said portion is lowermost) so as to open in response to pressure reduction in the container as liquid leaves the container, to permit entry of air into the container.

In yet a further aspect, the invention provides a valve comprising a valve seat defining a passage through which fluid may flow, a valve head engageable with said seat to close the passage and movable away from the seat to open the passage, a ligament connected to the valve head and extending through the passage, and a transversely extending stop element attached to the ligament at the opposite side of the passage to the valve head for engaging an abutment surface to limit the distance through which the valve head may move away from the valve seat. Preferably, the valve head ligament and stop member are integrally moulded from synthetic plastics material.

The above aspects of the invention have the advantage that the dispensing unit, concentrate supply and valve arrangements may be particularly inexpensive so as to be disposable after use. Preferably, this low cost dispensing unit is attached to a syrup container, such as a box or bag-in-the-box containing syrup so that the purchaser of replacement syrup containers would obtain, with each one, a new dispensing unit and both the syrup container and dispensing unit would be disposed of after use.

Syrup Flow Control

A further aspect of the invention provides a concentrate dispensing device for dispensing concentrate in response to application of gas pressure thereto, the device comprising outlet means which provides a relatively large outlet when the applied gas pressure is relatively small and a relatively smaller outlet when the gas pressure is relatively large. In this way, differences between the rate of discharge of concentrate arising from application of different gas pressures may be reduced or eliminated.

Charging the Carbonation Chamber

For carbonation apparatus to be used in an environment where the frequency of demand for drinks is high, it is desirable that the supply of water to the carbonation chamber is continuous.

Accordingly, another aspect of the present invention provides carbonation apparatus for dispensing carbonated drinks having a carbonation chamber, water supply means for filling the carbonation chamber with water, a passage of said water from said water supply means to said carbonation chamber requiring the water to pass through a space into which the water supply is discharged and from which space the water may then flow to said carbonation chamber whereby reverse flow of carbonated water back into the water supply means is prevented.

In an embodiment the space is defined by a water break chamber and a passage from the water break chamber to the carbonation chamber is controlled by a valve which comprises a ball and cage arrangement operable to close the passage when the water level has reached a predetermined level. The ball and cage arrangement is particularly advantageous as the supply of water can be arranged to depress the ball and allow the flow of water when required but when the supply is cut off the ball seals the passage. Such an arrangement is particularly simple, reliable, and economic to implement.

Changeover of Carbonation Gas

In carbonation apparatus for high volume usage it is desirable to be able to change rapidly from one gas supply to another during operation of the carbonation apparatus without down time.

According to another aspect of the invention there is provided a changeover mechanism for changing gas supplies for use with a gas supply arrangement having a first and second coupling means each with a first and second gas flow control means associated therewith and adapted for connection to a first gas supply, first and second actuating members operable to permit gas flow through said first and second gas flow control means respectively, wherein said changeover mechanism is adapted to operate in one of two conditions whereby in each of said conditions one of said first and second gas actuating members is repeatedly actuated, and changeover means switching actuation from one to the other of said conditions following detection that the gas supply associated with the actuating member last actuated has reached low pressure.

This changeover mechanism (an embodiment of which is illustrated) facilitates continuous operation of the carbonation apparatus: an empty gas bottle can be replaced when the carbonation apparatus is not in use.

Variable Carbonation

As will be further explained in relation to an embodiment, it is possible to arrange that the period during which the water is carbonated in the carbonation chamber is varied according to the nature of the concentrate. For this purpose according to a further aspect of the invention, there is provided carbonation apparatus with a carbonation chamber and agitating means for carbonating, control means for determining the carbonation period during which the agitating means is operational, concentrate being mixed with the carbonated water in the dispensed drink, means for determining the carbonation period in dependence upon an identification of the concentrate to be dispensed.

Further aspects of the variable carbonation and its mode of implementation are described in a specific embodiment. That specific embodiment also makes provision for the concentrate containers to carry identification so that a suitably adapted apparatus can have an indicator next to a selection button indicating that the desired flavour is available.

Cooling the Concentrate

The cooling of the concentrate is facilitated in an embodiment in an especially advantageous way. According to a further aspect of the invention there is provided carbonation apparatus for dispensing flavoured drinks comprising a carbonation chamber surrounded by a cooling jacket for the passage therethrough of a cooling medium, a compartment for a container of concentrate juxtaposed said cooling jacket, wherein both cooling of the carbonation chamber and cooling of the concentrate container is achieved by thermal transfer to said cooling medium.

The apparatus defined in the above statement is especially advantageous for the cooling of the concentrate since the cooling arrangement takes advantage of an efficient housing design and an efficient layout of that design whereby the medium for cooling the carbonated water is also used for cooling the concentrate. This enhances both the production of the apparatus and the reliability thereof.

Further aspects of the present inventions will be described with reference to the accompanying drawings. Furthermore, further aspects will be apparent from the appended claims.

Embodiments of the invention will now be described, by way of example only, with reference to the accompanying drawings, in which.

Figure 1:
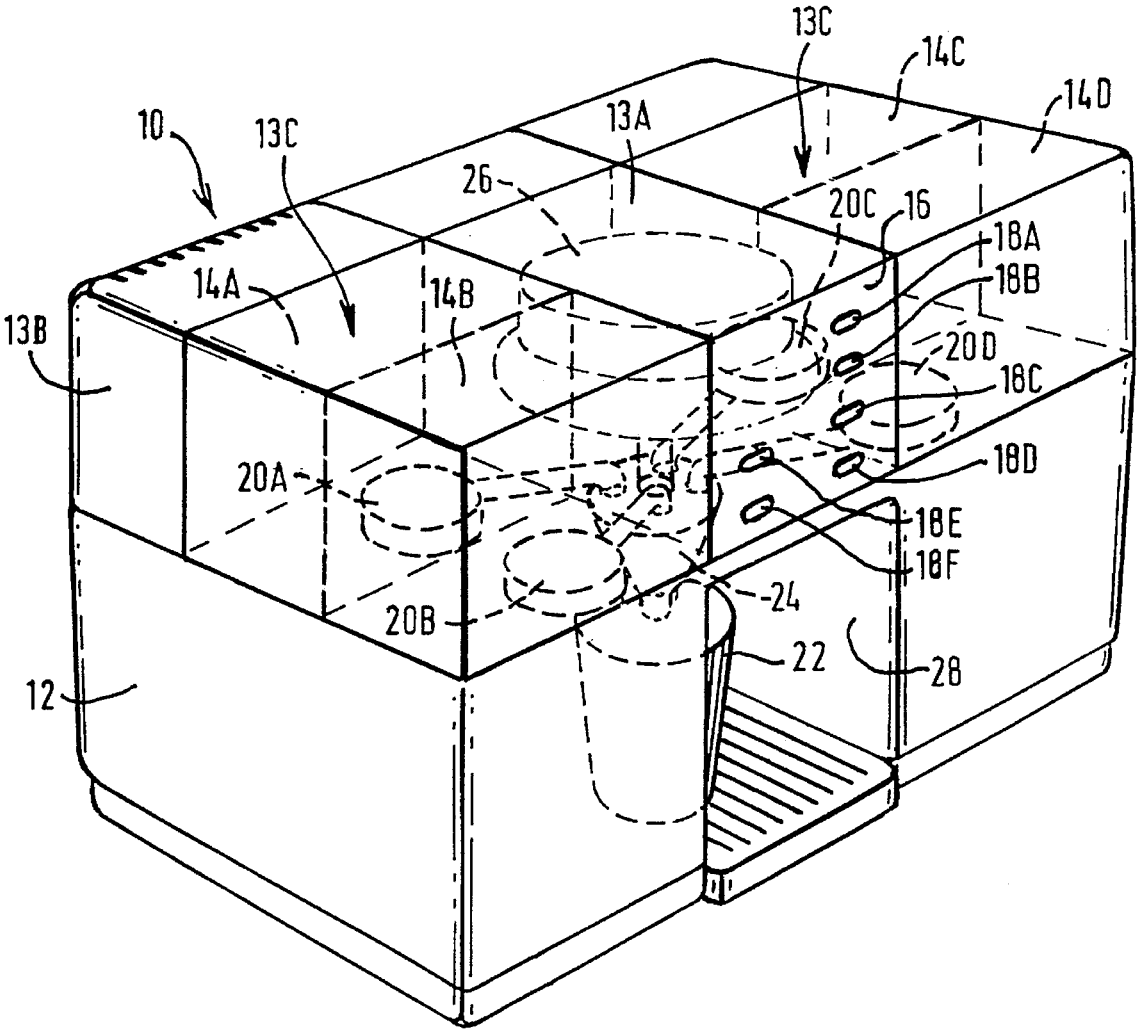
FIG. 1 shows a front perspective view of a water carbonation apparatus.
Figure 14A:
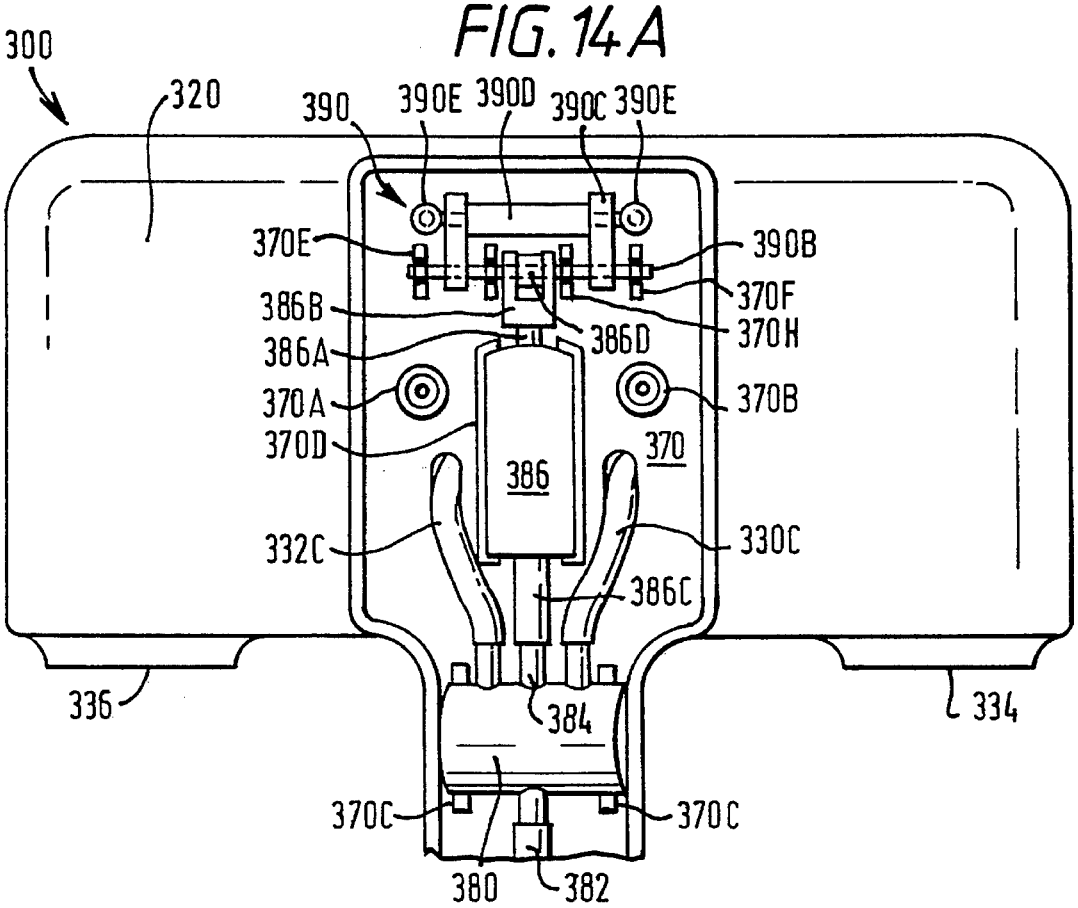
Figure 14B:
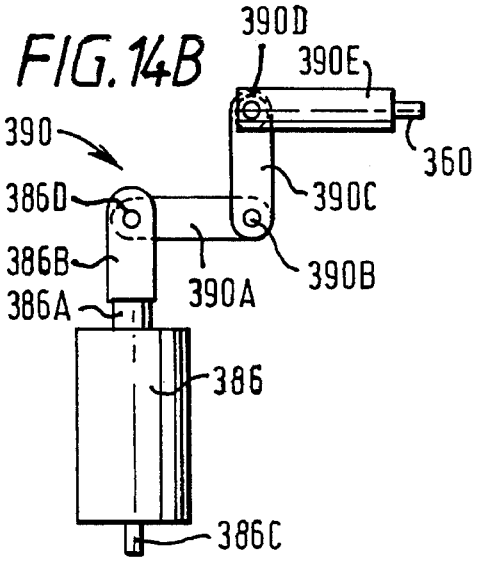
Figure 14C:
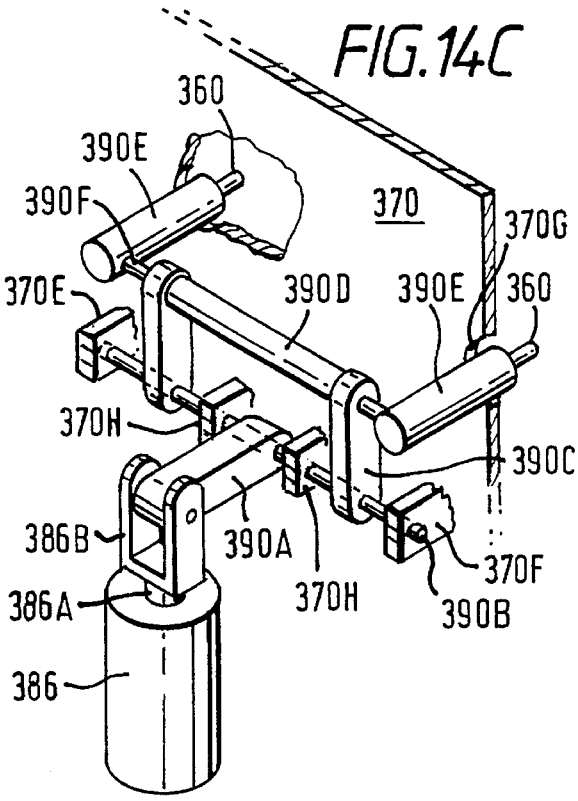
Figure 15:
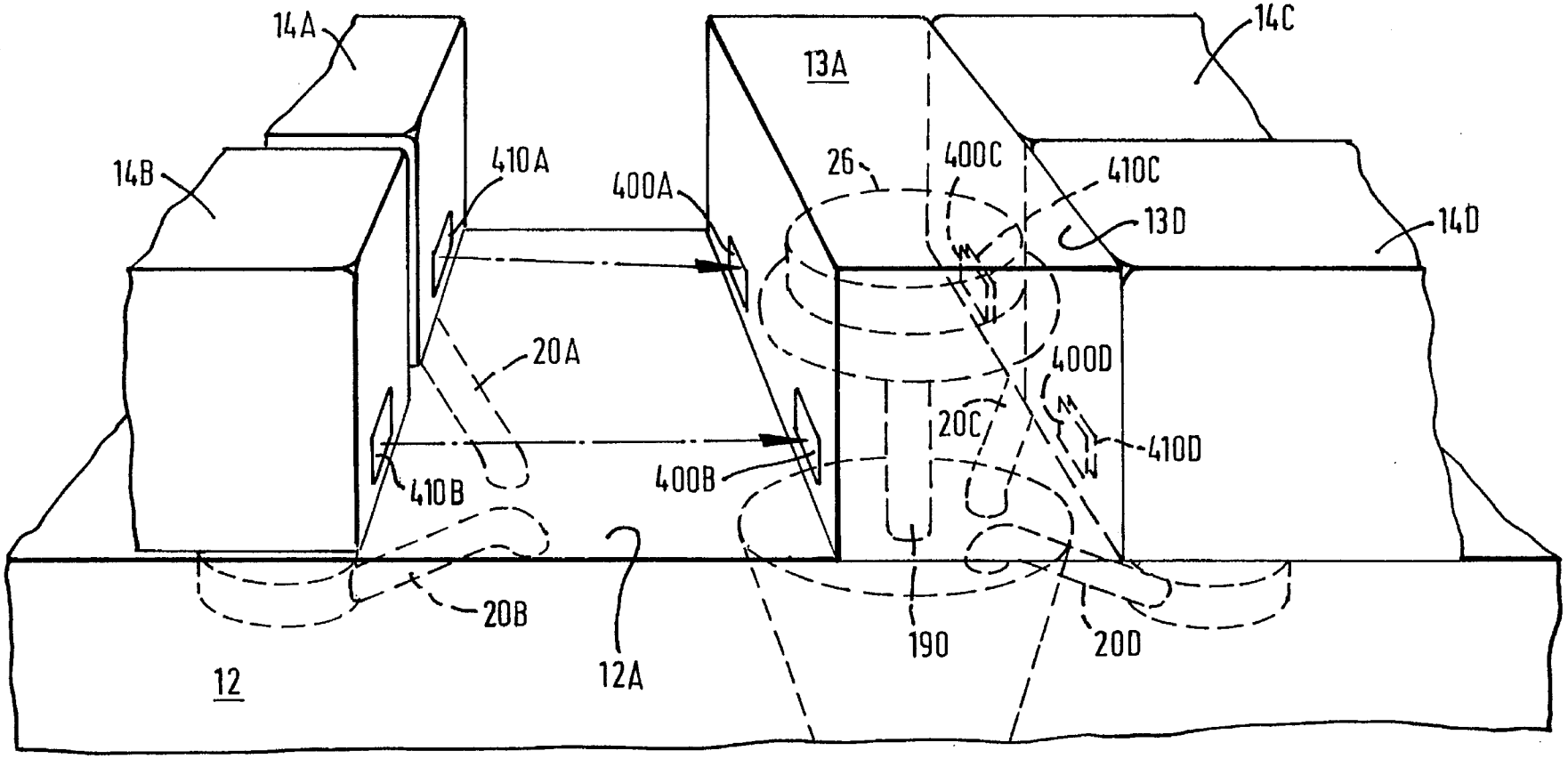
Figure 16:
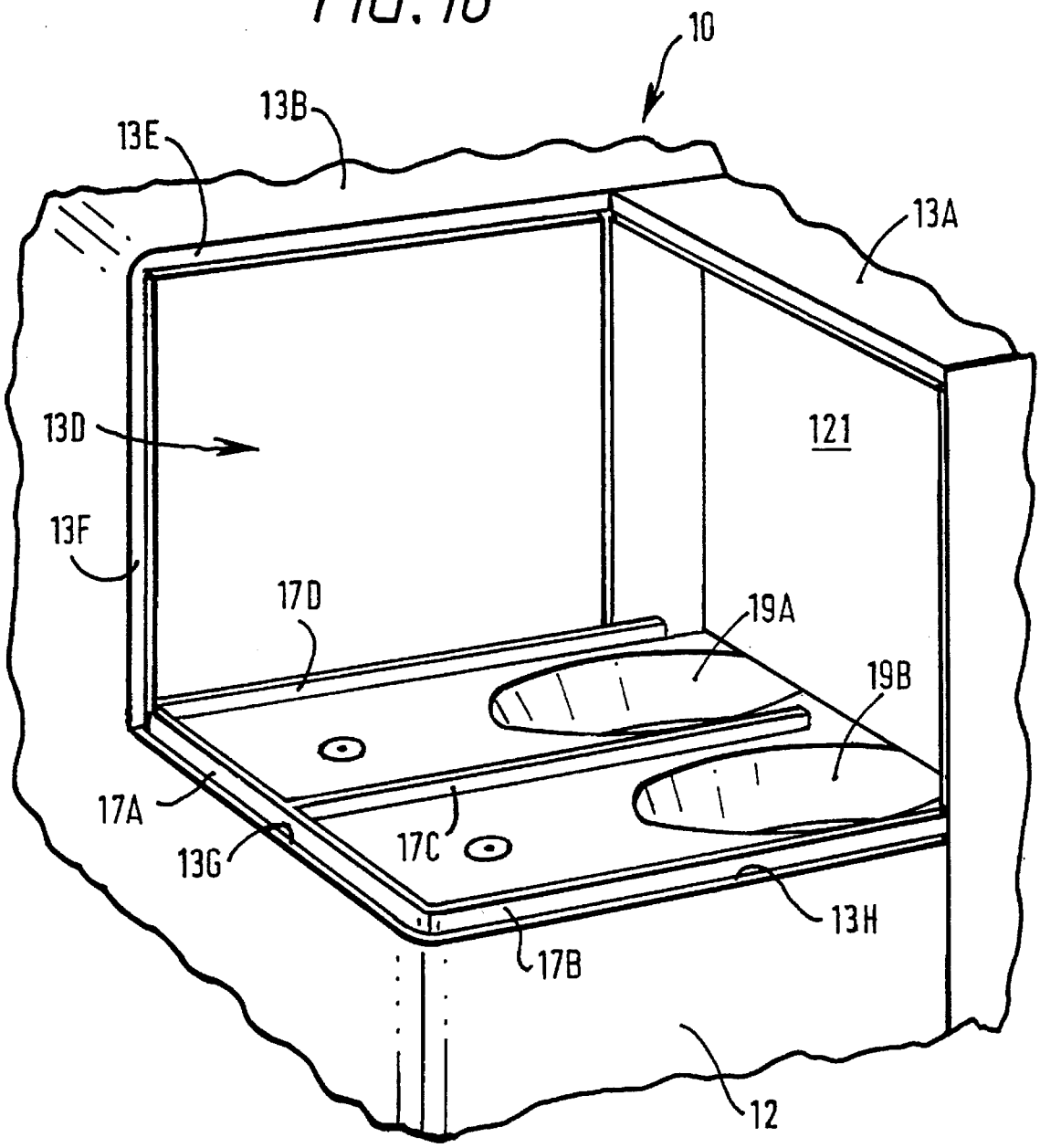
Figure 17:
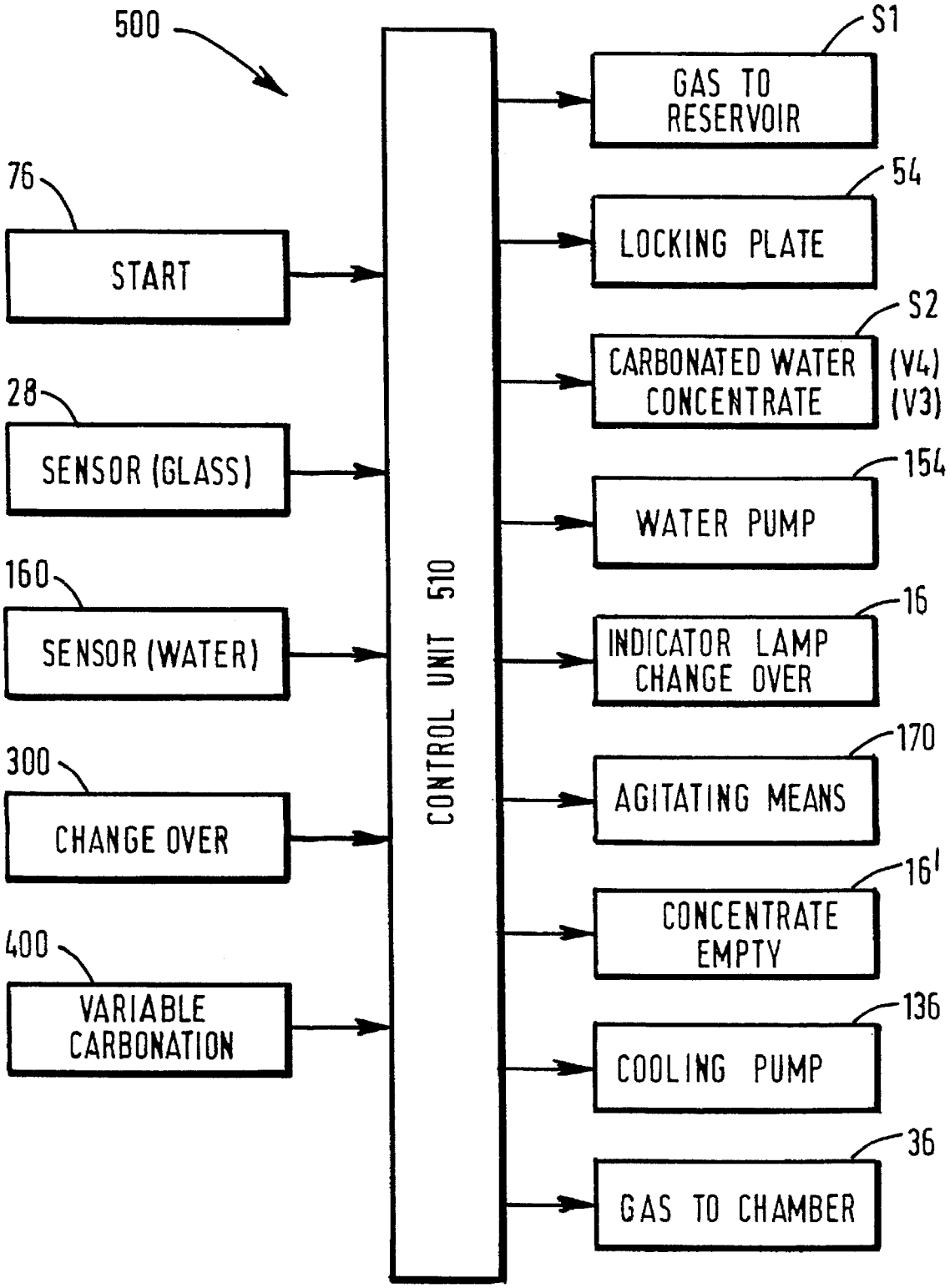
Figure 19:
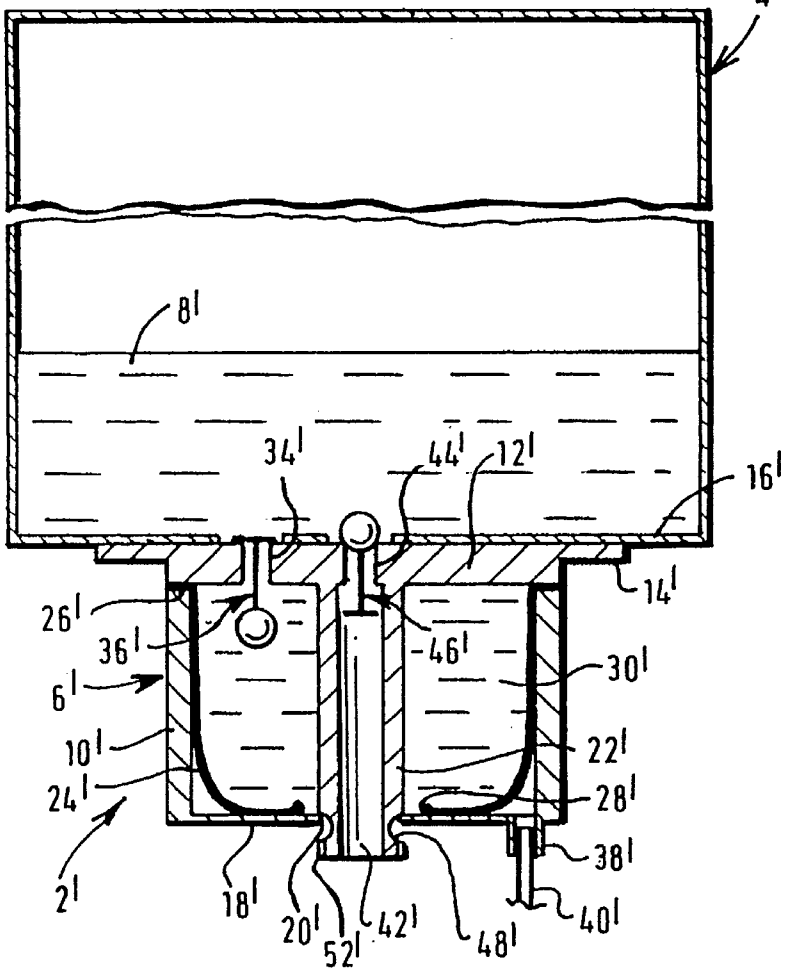
Figure 18:
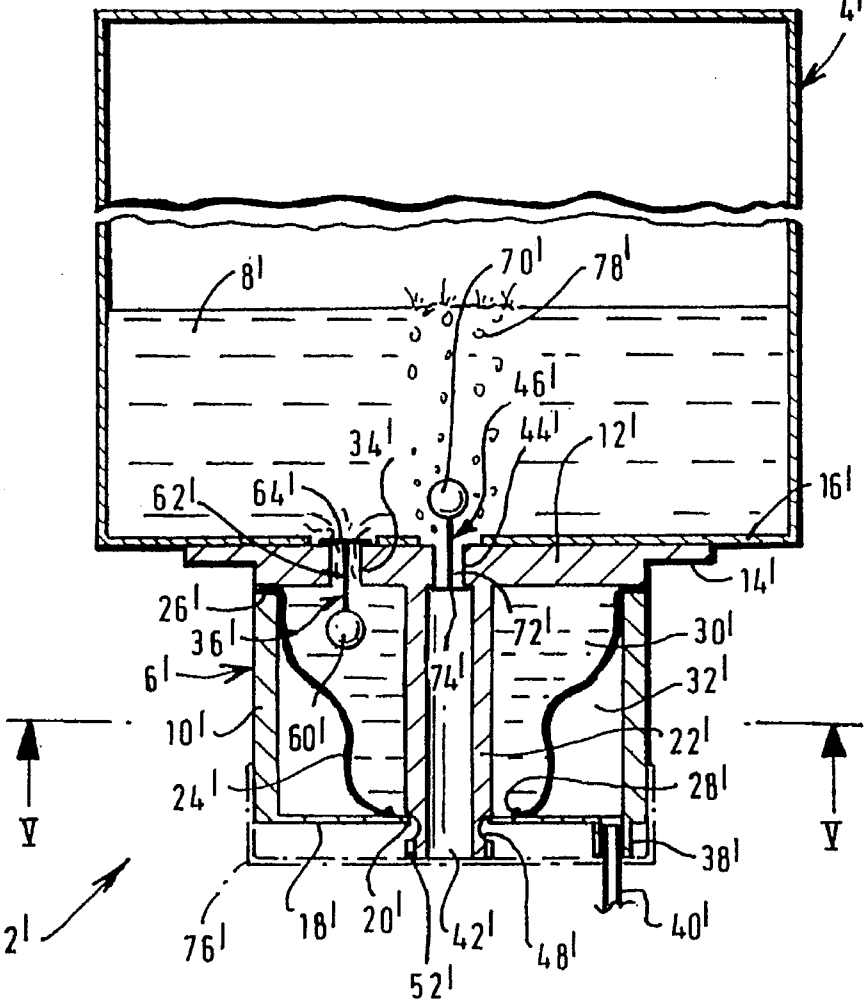
Figure 20:
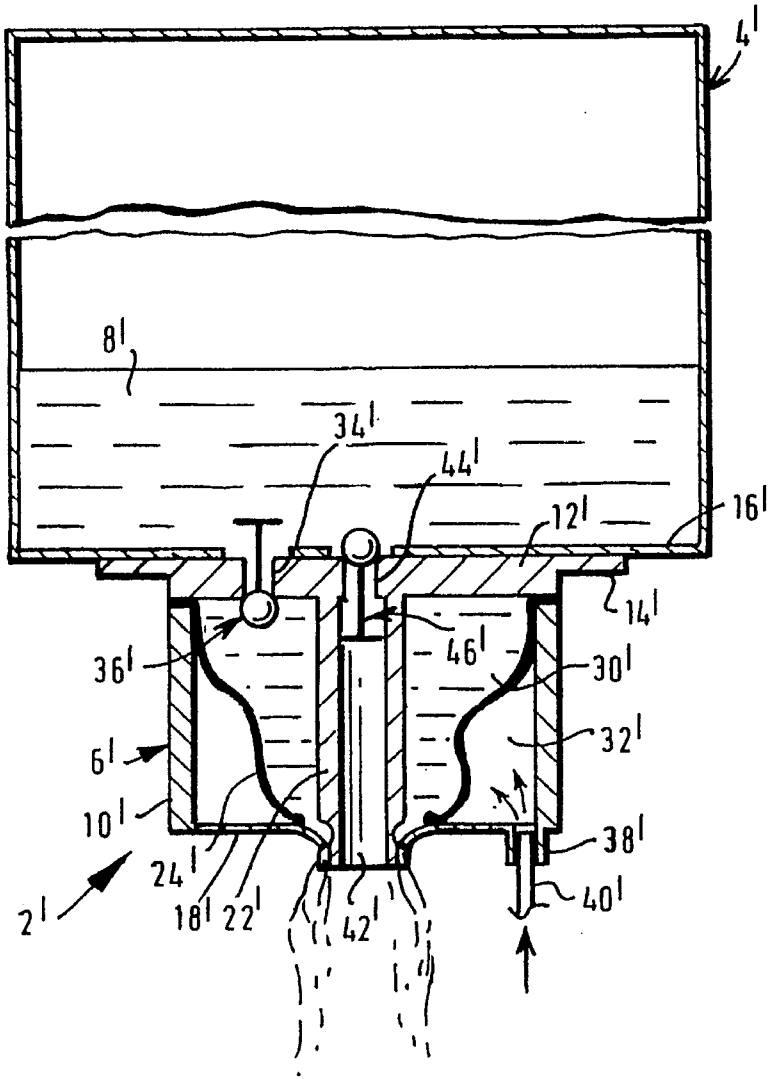
Figure 22:
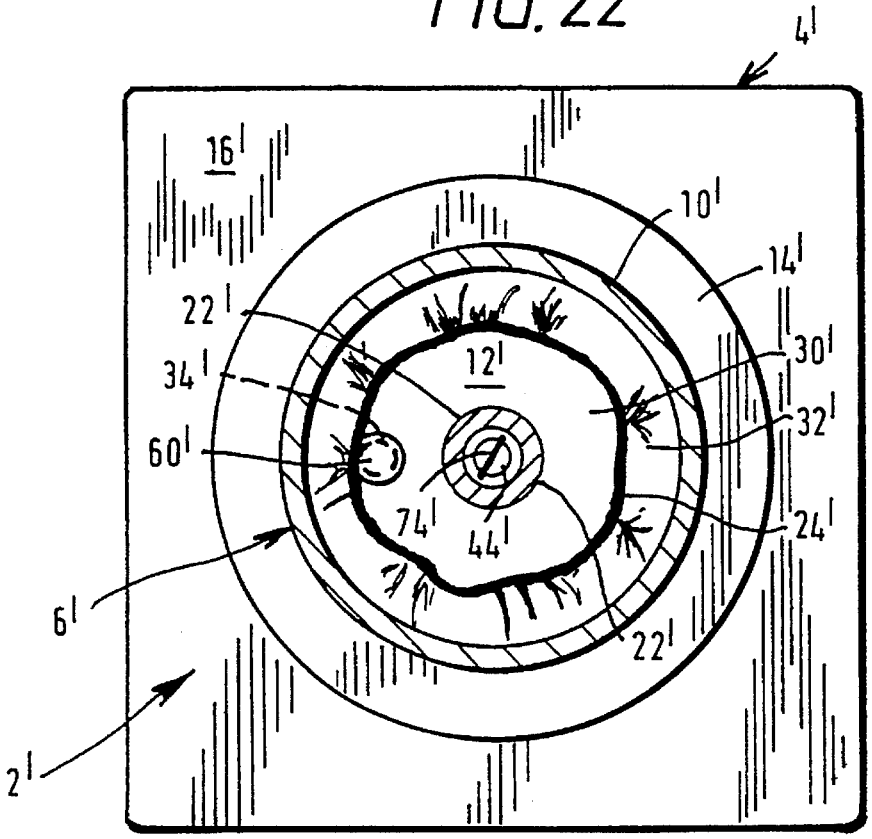
Figure 23:
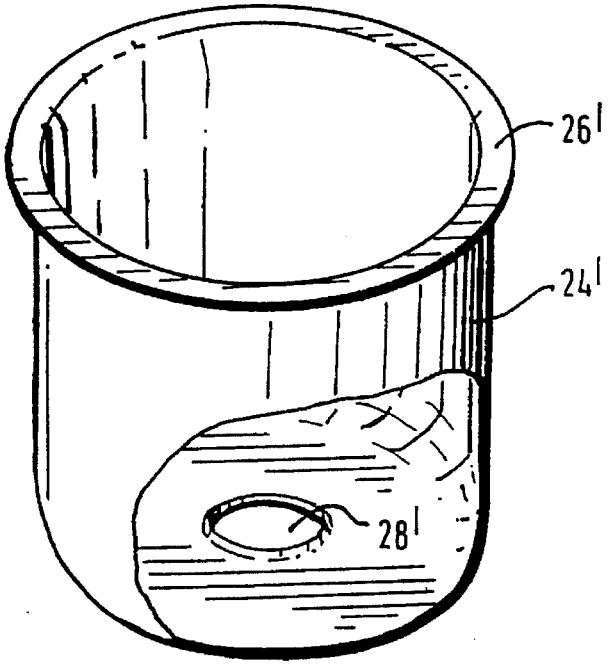
Figure 24:
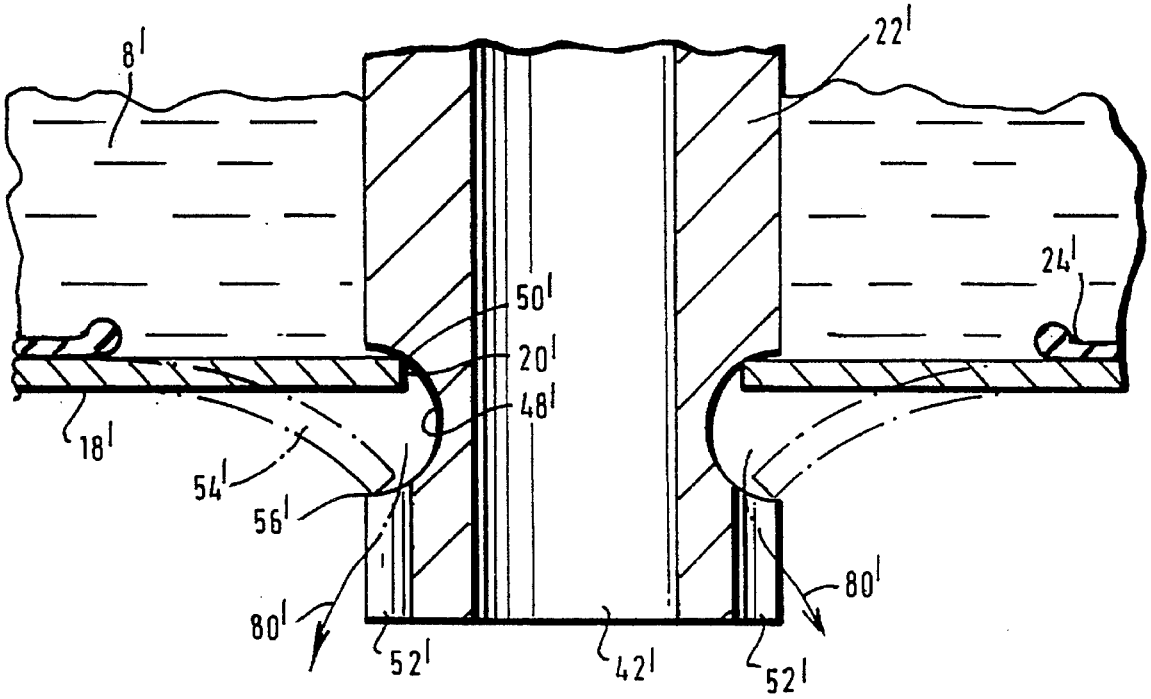
Figure 25:
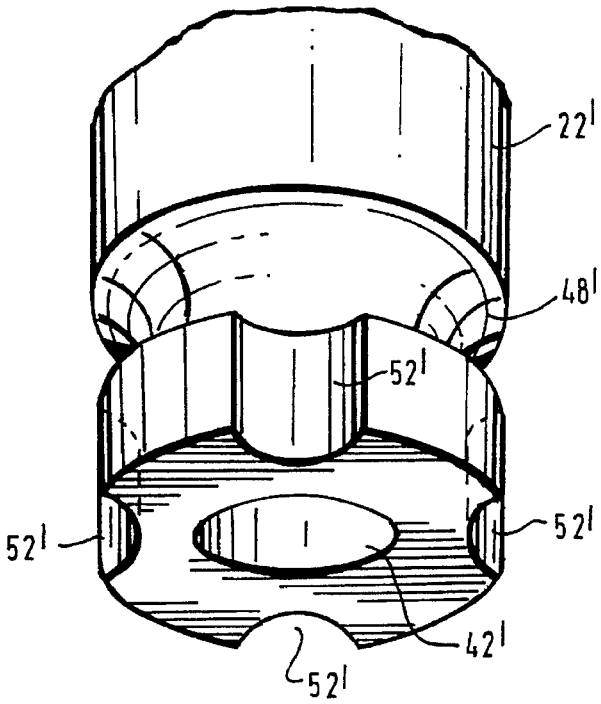
Figure 27:
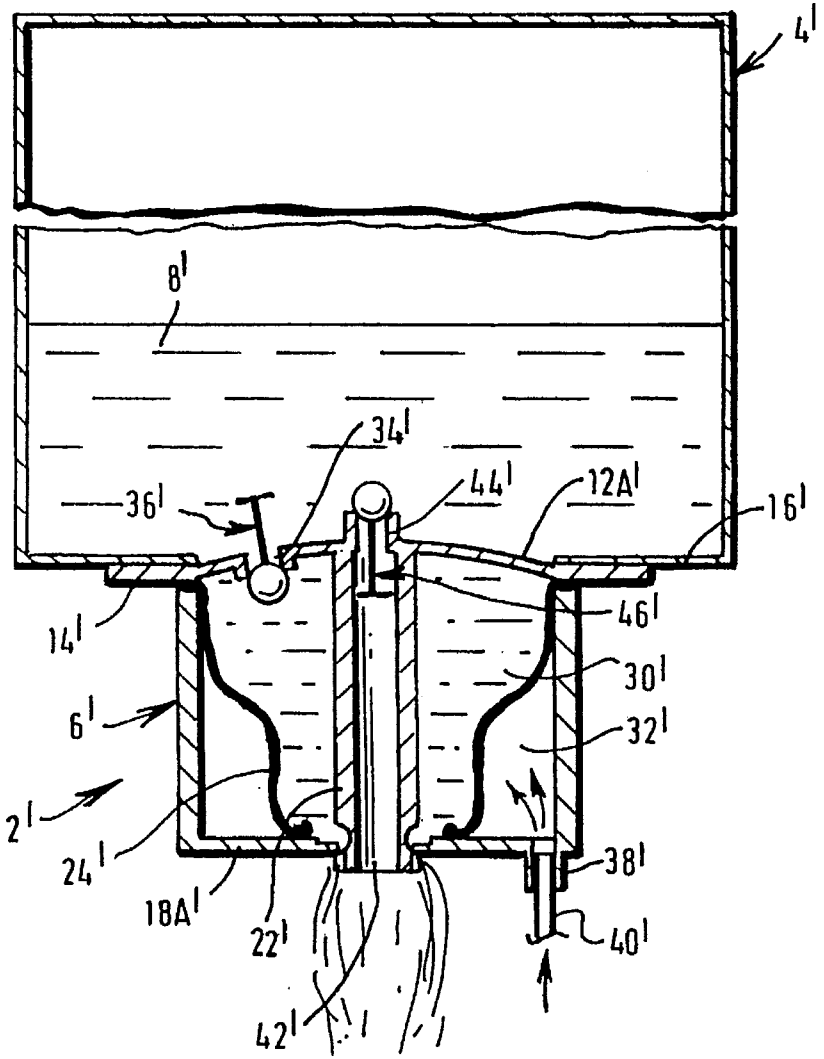
Figure 26:
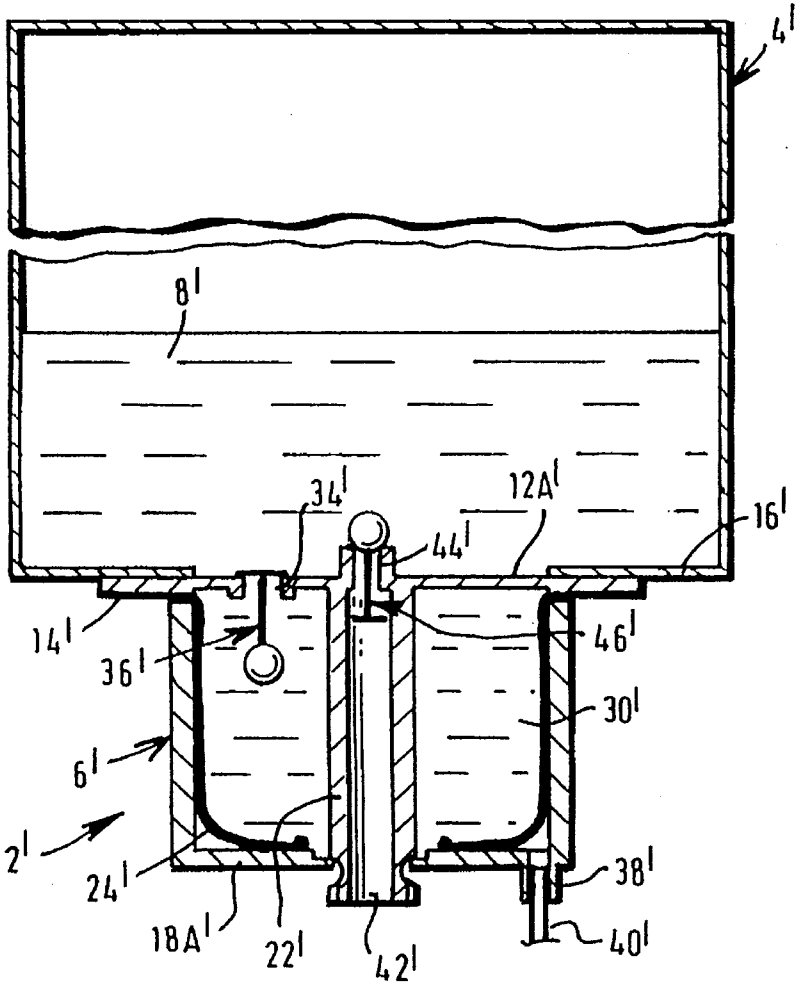
Figure 28:
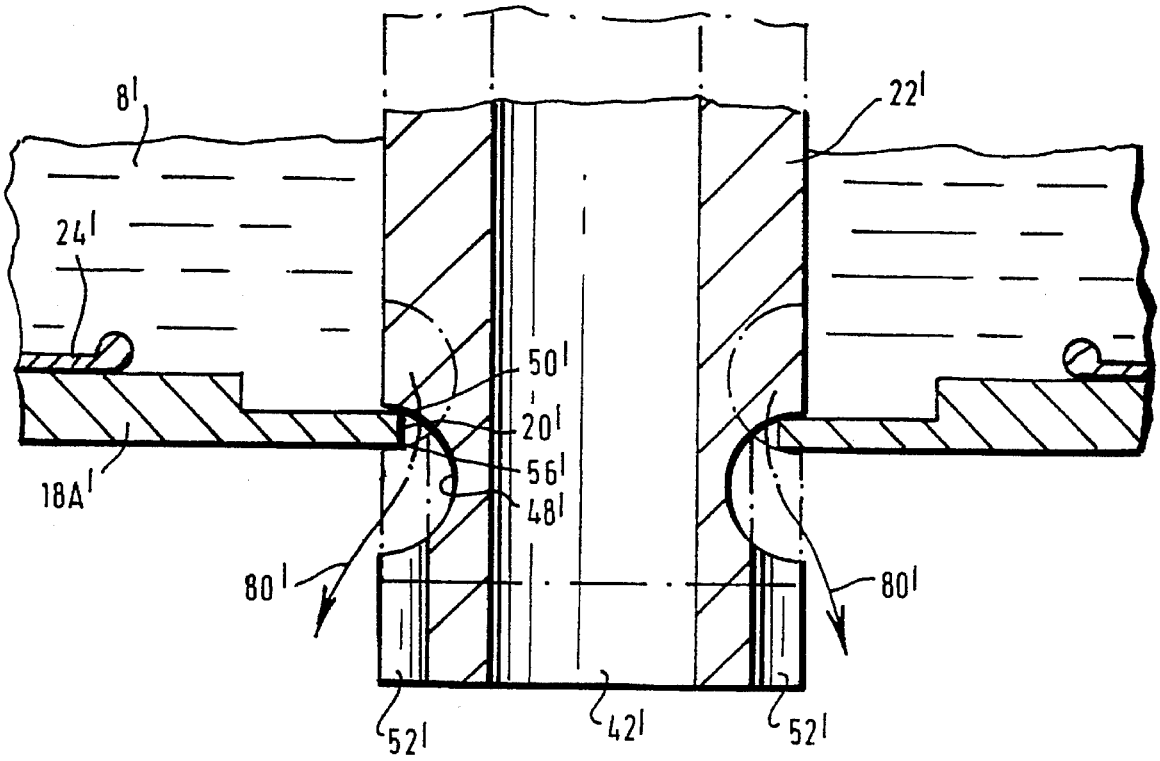

FIGS. 13*a* to *h*, 13*i* to 13*p*, and 13*q* to 13*x* respectively show three phases of operation of the changeover mechanism, namely continuous operation using one gas cylinder, operation changing from one gas cylinder to the other gas cylinder, and continuous operation using the other gas cylinder;

FIG. 14A shows a perspective view of the part of the changeover mechanism by means of which the actuator pins are reciprocated;

FIG. 14B shows a side view of parts of the mechanism of FIGS. 14A;

FIG. 14C shows a perspective view of those parts of the mechanism shown in FIG. 14B;

FIG. 15 shows another perspective view of the upper part of the carbonation apparatus with the concentrate vessels displaced to render visible a sensor means for detecting carbonation requirements of different concentrates;

FIG. 16 shows a part of the carbonation apparatus of FIG. 1 which illustrates a compartment for concentrate containers;

FIG. 17 shows a block diagram of the circuitry included in the carbonation apparatus of FIG. 1;

FIGS. 18 to 21 are diagrammatic cross-sectional views of a dispensing device according to a further embodiment of the invention, showing the device in four different conditions;

FIG. 22 is a cross-section on the line V—V shown in FIG. 18;

FIG. 23 is a perspective view, partly cut-away, of a part of the device of FIGS. 18 to 22;

FIG. 24 is an enlarged section through part of the device shown in FIGS. 18 to 22;

FIG. 25 is an enlarged perspective view of part of the device as shown in FIG. 24;

FIGS. 26 and 27 are views similar to FIGS. 19 and 20 but showing an alternative embodiment of the invention; and FIG. 28 is an enlarged sectional view through part of the device shown in FIGS. 26 and 27;

GENERAL DESCRIPTION OF APPARATUS (FIG. 1)

A water carbonation apparatus 10 for preparing drinks which combine carbonated water with an essence or flavouring is shown in FIG. 1. The apparatus comprises a housing 12, the lower section of which is generally rectangular and which has an upper section comprising a central upper portion 13*a* extending forwardly from a rear upper portion 13*b* which extends along the rear wall of the housing. The upper portions 13*a* and 13*b* define two compartments laterally spaced either side of the upper portion 13*a*. These compartments have compartment covers 13*c* and accommodate containers 14*a* to 14*d* (the presence of which is illustrated schematically) for concentrate to be mixed with carbonated water to provide the drinks which are dispensed. The compartment covers 13*c* are formed of a material (or lined with a material) having selected thermally insulating properties in order to insulate the containers 14 and the concentrate therein from the ambient conditions. The containers 14*a* to 14*d* may be of the bag-in-box construction (see FIGS. 4A,5A) in which the outer container is formed of a rigid membrane such as cardboard and the inner container is formed from a foil of a material which will be collapsible as the concentrate is dispensed from the container through an outlet connecting member (not shown). The containers 14 are arranged in pairs 14*a*,14*b* and 14*c*,14*d* as shown.

The upper portion 13*a* of the housing provides at the front panel thereof a selection panel 16 which accommodates selection buttons 18*a* to 18*f* for the selection of a drink flavoured with a particular concentrate by buttons 18*a* to 18*d* and to permit selection of still water or carbonated water (without flavouring) by buttons 18*e*,18*f* respectively. Each of the containers 14*a* to 14*d* are coupled to a concentrate dispensing mechanism 20*a* to 20*d* respectively (shown in broken lines). When the user requires a drink he places a glass or cup 22 below a mixing chamber 24 in the form of a nozzle which communicates with a carbonation chamber 26 (shown in broken line) and the concentrate dispensing mechanisms 20*a* to 20*d*. The glass 22 has to be placed in a dispensing compartment 28 which opens to the front of the housing 12. There is a sensing mechanism to detect whether a glass 22 is present in compartment 28 before the dispensing of drinks.

Figure 2:
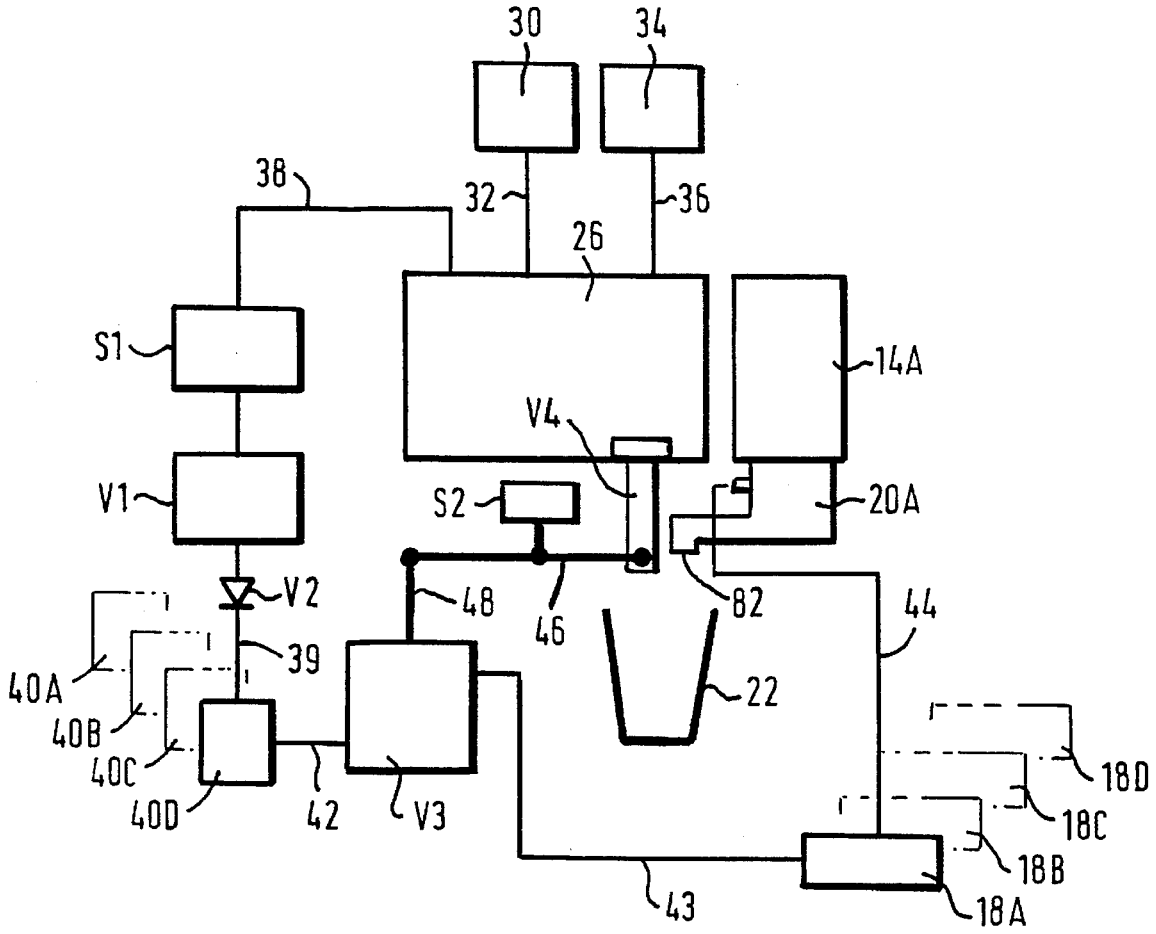
FIG. 2 shows a schematic diagram of the carbonation apparatus of FIG. 1.

Description of FIG. 2

FIG. 2 shows a schematic diagram of the apparatus 10. A water supply 30 communicates by a water supply line 32 with the carbonation chamber 26. Likewise a gas supply tank or main reservoir 34 containing the carbonation gas such as carbon dioxide, communicates via a gas supply line 36 with the carbonation chamber 26. Both of these lines 32,36 are controlled by valves (e.g. solenoid actuated valves) not shown. Carbonation of the water takes place in chamber 26. The apparatus may be arranged to operate such that the chamber 26 is refilled with water immediately following the dispensing of the previous drink so that the chamber normally stands full of water. After the carbonation step, the carbonation gas which remains in the chamber may pass through exhaust lines 38,39. Exhaust line 38 is controlled by a solenoid valve S1 which operates to permit the gas to pass to an auto exhaust valve V1, which in turn may pass the carbonation gas via exhaust line 39 with a check valve V2 to charge reservoirs 40*a* to 40*d*. Typically the pressure of the carbonation gas in the gas supply 34 will be in the order of 6 to 7 bar (about 100 psig) whereas the required pressure in the reservoirs 40*a* to 40*d* will be in the order of 2 to 3 bar (about 40 psig). The collective capacity of the four reservoirs 40*a* to 40*d* is about four times that of the head space in the carbonation chamber when it is full of carbonated water. After charging the pressure in the reservoirs 40 will be slightly above the level just indicated due to the carbonation of the water itself since the carbonation gas in the water tends to maintain the pressure in the head space. The reservoirs 40*a* to 40*d* are themselves connected by a charge line 42 to a pressure relief valve V3 from which the charge line 43 continues via the selection buttons 18*a* to 18*d* (those buttons on panel 16 for the selecting of flavours corresponding to the concentrate in the containers 14*a* to 14*d* of FIG. 1). Further charge lines 44 run from each of the selection buttons. 18 to a respective one of the concentrate dispensing mechanisms 20*a* to 20*d*. As shown, the concentrate dispensing mechanism 20*a* communicates with respective concentrate container 14*a*. A glass 22 is shown disposed below an outlet from the concentrate dispensing mechanism 20*a* and a valve V4 of the carbonation chamber 26.

The valve V4 is associated with an arm 46 which is pivotally connected to an actuating solenoid S2 and an actuating member 48 for the pressure relief valve V3.

OPERATION OF APPARATUS OF FIG. 2

Each selection button 18*a* to 18*d* selects a respective one of the concentrate containers 14*a* to 14*d* for a particular flavour of the drink dispensed. The selection buttons 18*a* to 18*d* are each associated with a respective selection mechanism 50 (further described with reference to FIGS. 3A to 3C). Chamber 26 is already charged with water. The respective concentrate dispensing mechanism 20*a* is charged with concentrate. Assuming that a glass 22 is in place (i.e. in the compartment 28 of FIG. 1) actuation of the button 18*a* is possible. This actuation initiates a cycle of the carbonation apparatus (to be further described). During the cycle, dispensing of concentrate and carbonated water occurs as follows. For the purpose of dispensing concentrate, carbonation gas is caused to flow from the reservoirs 40 through the charge line 42, the pressure relief valve V3 (when actuated by the solenoid S2), the charge line 43, the concentrate selection mechanism 50 (FIG. 3) associated with the button 18*a* through the further charge line 44 to the concentrate dispensing mechanism 20*a* to dispense a measured quantity of the concentrate from the dispensing mechanism 20c which is charged by the concentrate container 14*a*. Likewise during said cycle, the solenoid S2 is actuated to open the valve V4 to dispense carbonated water from the carbonation chamber 26. The two liquids, the carbonated water and the concentrate, dispensed respectively from the valve V4 of chamber 26 and an outlet mechanism 82 of the concentrate dispensing mechanism 20 are mixed as they pass to the glass 22 (see the mixing chamber 24 of FIG. 1). Further details of the apparatus shown in FIG. 2 will become apparent from the description below of FIGS. 3 to 7.

Concentrate Selection Mechanisms 50

Figure 3A:
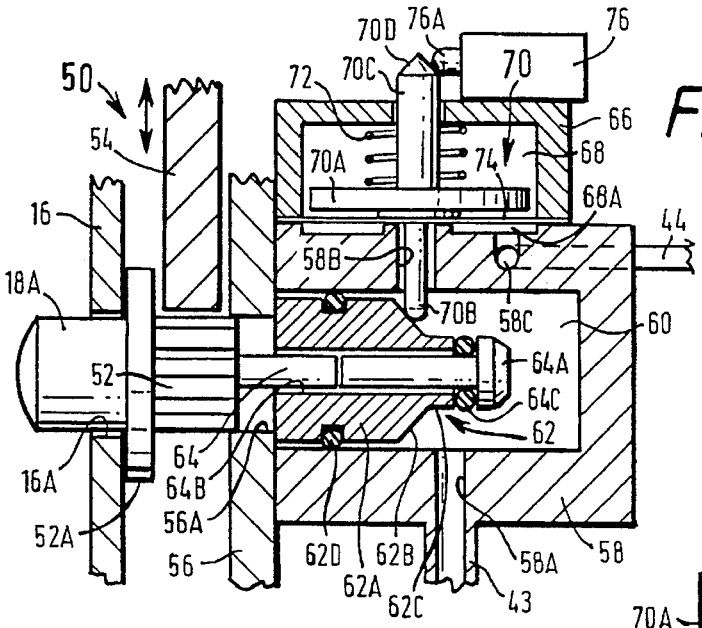
FIGS. 3A, 3B and 3C show sectional views of a concentrate selection mechanism prior to selection, during selection actuation, and subsequent to selection actuation.
Figure 3B:
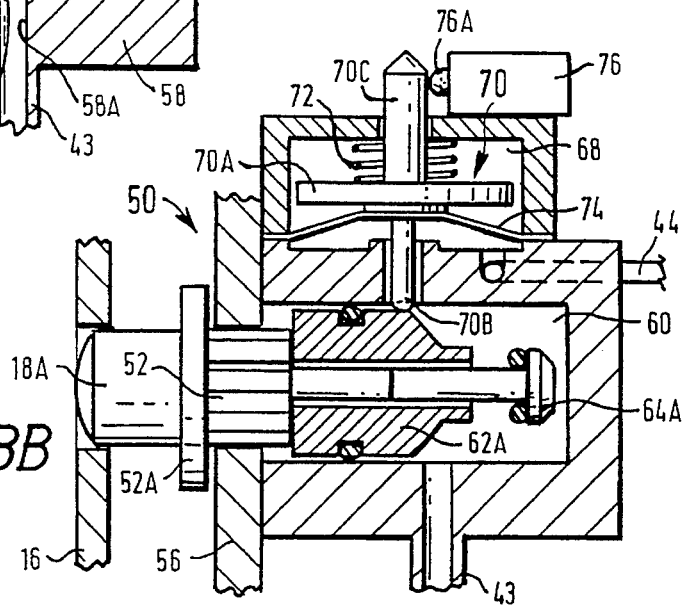
Figure 3C:
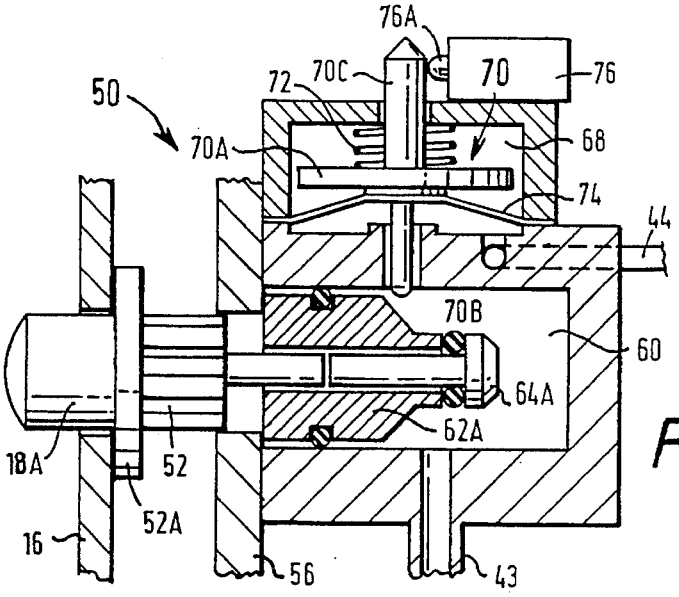

One of the concentrate selection mechanisms 50 associated with the selection buttons 18*a* to 18*d* is shown in FIGS. 3A to 3C which illustrate various stages of its operation. The concentrate selection mechanism 50 comprises the selection button 18*a* (see FIGS. 1 and 2) which is carried by a shaft 52 having a collar 52*a*. Collar 52*a* is displaceable between a position in which it contacts front panel member 16 (see FIG. 1) and a position in which it contacts a panel member 56 having an aperture 56*a* for the shaft 52. A locking plate 54 locks the button 18*a* with collar 52*a* adjacent panel 16 when no glass/cup is present in dispensing compartment 28 (FIG. 1). It is displaced (for example by a solenoid) when the glass 22 is detected thereby enabling actuation of button 18*a*. Detection may be by way of a sensing mechansim detecting a reflected light beam.

The panel member 56 forms a front plate of a valve chamber 60 which is further defined by a first valve chamber housing 58.

Within the valve chamber 60 there is a movable cylinder 62 having a main portion 62*a* of a diameter such as to be a close fit in the cylindrical chamber 60 and sealed by means of an O-ring seal 62*d*. The cylinder 62 further comprises a cam portion 62*b* and a reduced portion 62*c*. The cam portion 62*b* is formed as a conical reduction between the outer main portion 62*a* and the inner reduced portion 62*c*. The cylinder 62 has a bore 62*e* for the passage of a piston member 64. The piston member 64 is an extension of the shaft 52 and is of reduced diameter relative thereto. It extends through the bore 62*e* of the cylinder 62. Piston member 64 is provided at its leading end with a piston head 64*a*. Head 64*a* carries at its rearward face (relative to the direction of forward travel of the head 64*a* and the selection button 18*a*) an O-ring seal 64*c*. O-ring seal 64*c* ensures a gas tight seal between the piston 64 and the cylinder 62 in the position (FIG. 3A) in which the cylinder 62 abuts the panel member 56.

Above the first valve chamber housing 58 there is mounted a second and upper valve chamber housing 66 which defines an upper valve chamber 68 accommodating a valve member 70. The chambers 60 and 68 communicate via the passage 58*b* in housing 58. The valve member 70 has a collar 70*a*, a depending spigot 70*b* and an upstanding shaft 70*c* terminating in a conical cam 70*d*. Within the valve chamber 68 the valve member 70 is biased into a closed position by a spring 72 and in that position holds a diaphragm 74 in its closed position. The valve member 70 is displaceable to actuate a microswitch 76 by means of the conical cam 70*d* displacing a microswitch actuator 76*a* as shown in FIG. 3B.

The chamber housing 58 has an inlet passage 58*a* which communicates with the charge line 43. The chamber 68 has an outlet 68*a* which communicates with a bore 58*c* through the housing 58 and thence to the charge line 44. It will be recalled from FIG. 2 that charge lines 42,43 communicate with the reservoirs 40 and that the charge line 44 communicates from the selection mechanism 50 to the appropriate concentrate dispensing mechanism 20.

Operation of Concentrate Selection Mechanism 50 (FIGS. 3A to 3C)

The concentrate selection mechanism 50 as shown in FIG. 3A is in its rest position in which the button 18*a* projects through the selection panel 16. The cylinder 62 abuts the panel 56. The piston 64 is located such that the piston head 64*a* abuts the cylinder 62 with the O-ring seal 64*c* interposed therebetween to seal the same. In this situation the depending spigot 70*b* of the valve member 70 depends through the passageway 58*b* of the housing 58 and is in contact with the cam portion 62*b* of the cylinder 62. The diaphragm 74 is in its relaxed position and maintained there by the collar 70a of the valve member 70. It will be clear that since the area of diaphragm 74 greatly exceeds the area of the passage 58B, gas pressure in chamber 60 will not normally be able to lift the diaphragm 74. Valve member 70 is biased into that position by the spring 72 acting between the collar and the upper wall of the housing 66 of valve chamber 68. The diaphragm 74 so arranged prevents the passage of carbonation gas from the chamber 60 passing through the passage 58*b* to the upper chamber outlet 68*a* from which it would then flow through the passage 58*c* to the charge line 44 and thence the concentrate dispensing mechanism 20. Likewise, the exhaust of gas from the dispensing mechanism 20 through the chamber 60 and then to atmosphere via the piston bore 69B (in the FIG. 3B position of piston 64A) or via the charge line and relief valve V3 of FIG. 2 is prevented.

In the absence of user actuation of the selection button 18*a*, and if there is no glass 22 in the dispensing compartment 28 (see FIG. 1) then the locking plate 54 will be in the position illustrated in FIG. 3A. If a glass 22 is placed in the compartment 28, then the locking plate 54 is moved out of the path of the collar 52*a* on the shaft 52, thereby enabling the selection button 18*a* to be displaced.

In FIG. 3B the selection 18*a* is displaced into its selection position. Initially this causes displacement of the shaft 52.

After a period of free travel corresponding to the thickness of the wall 56, the shaft 52 abuts the cylinder 62 and displaces it. In addition, the forward displacement of the shaft 52 causes displacement of the piston 64 such as to cause the piston head 64*a* to move away from the end 62*c* of the cylinder. The displacement of the cylinder 62 has caused a displacement of the valve member 70 in the upper chamber 68. The cam portion 62*b* of the cylinder 62 has displaced the depending spigot member 70*b* of the valve member 70 upwardly against the bias of the spring 72 where it is held by the main portion 62*a* (of the cylinder) which acts as a holding means therefor until carbonation gas is supplied. This causes the diaphragm 74 to travel therewith and also causes the upstanding shaft 70*c* to move upwardly.

As the carbonation gas (from reservoirs 40) enters the chamber 60 and thence through passage 58B to the chamber 68 below the diaphragm 74, then owing to the area of the diaphragm 74 this pressure whilst applied is sufficient to maintain the raised position of the diaphragm 74 against the bias of spring 72.

The upward movement of the shaft 70*c* of valve member 70 causes actuation of the microswitch 76 by means of the microswitch actuator 76*a*. Actuation of the microswitch 76 operates a control circuit (not shown) for timed operation of the various solenoids and solenoid actuated valves.

The user releases the selection button 18*a*. It returns to its initial position as shown in FIG. 3C under the influence of the pressure in the chamber 60. This pressure is due to the carbonation gas travelling through the charge line 43 and the inlet passage 58*a* into the chamber 60. It then passes through the passageway 58*b* into the cheer 68 below the diaphragm 74, through to the passageways 68*a* and 58*c*, and thence to the charge line 44 for the concentrate dispensing mechanism 20 associated with that concentrate selection mechanism 50. As indicated above, the diaphragm 74 is maintained in its raised position (shown in FIG. 3C) after the button 18*a* and therewith the cylinder 62 has returned to the position in which cylinder 62 abuts panel 56 and the portion 62*a* thereof no longer holds the spigot 70*b* raised.

Figure 4A:
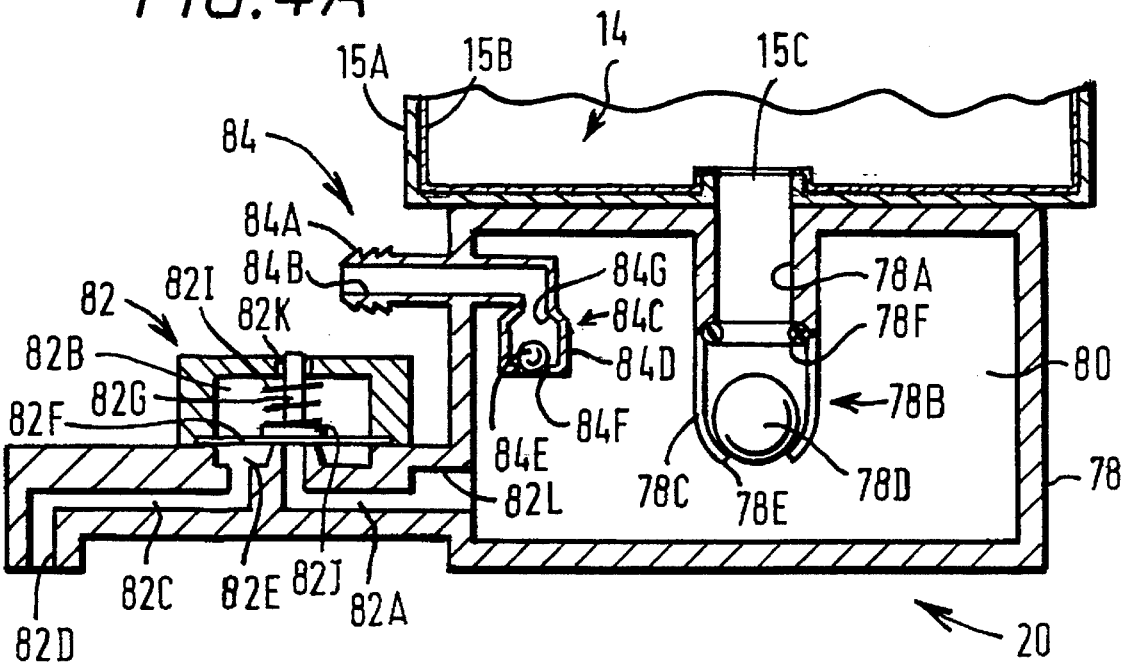
FIGS. 4A and 4B show sectional views of a concentrate dispensing mechanism before and after filling the mechanism with concentrate.
Figure 4B:
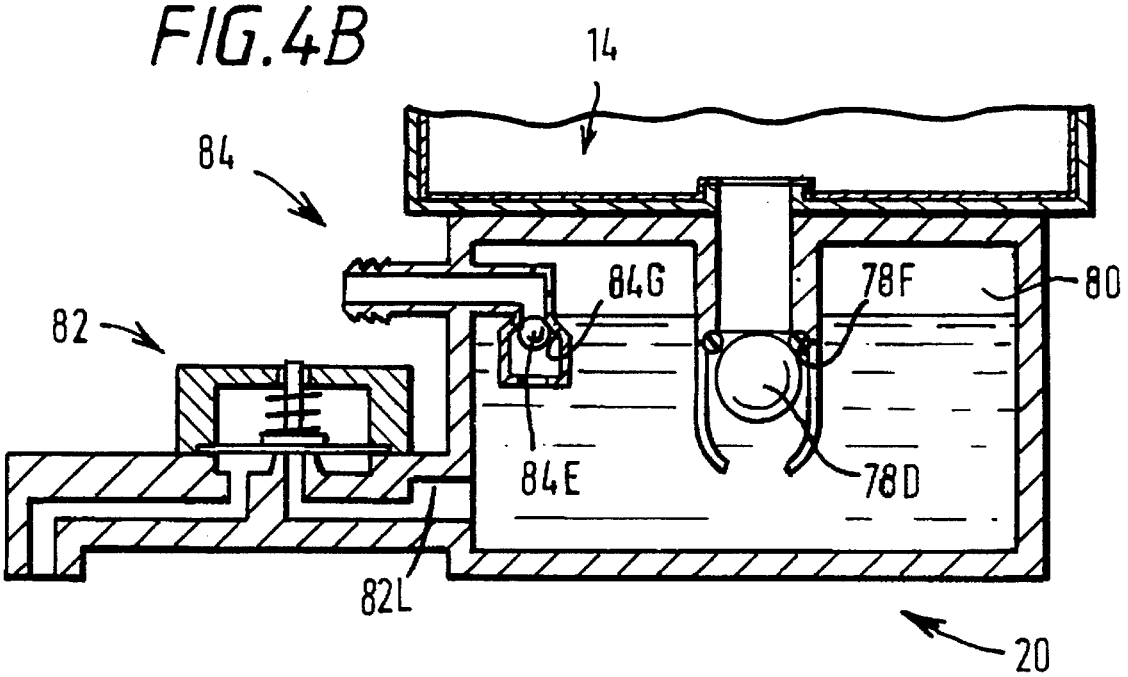

Concentrate Dispensing Mechanism 20 (FIGS. 4A,4B)

The construction and operation of the concentrate dispensing mechanism 20 will now be described with reference to FIGS. 4A and 4B. Four of these mechanisms 20*a* to 20*d* are illustrated schematically in FIG. 1.

The upper surface of the lower housing section 12 is contoured to receive these concentrate dispensing mechanisms 20 in a releasable fashion. When in situ in the housing, these mechanisms 20 couple the respective concentrate container 14 to the mixing chamber 24 (see FIG. 1).

In FIG. 4A a concentrate container 14 is illustrated only in part and the means of connection with the concentrate dispensing mechanism 20 are not shown. As mentioned with reference to FIG. 1, the containers 14 can be of the bag in the box type with an outer wall 15*a*, a liner 15*b* and an opening 15*c*. It will be readily appreciated that a concentrate container 14 of the bag-in-box type may be provided on its lower surface with a removable strip below which there is a pierceable strip into which a connecting member (not shown) for coupling to the concentrate dispensing mechanism 20 may be inserted. This operation would occur with the dispensing mechanism 20 and concentrate container 14 out of the apparatus 10. The concentrate dispensing mechanism 20 is attached to container 14 and then the assembly so formed placed in the housing 12 with the concentrate dispensing mechanism 20 located in a corresponding recess of the housing (not shown) such that its dispensing outlet mechanism 82 registers with the mixing chamber 24 (FIGS. 1 and 2). This positioning of the mechanism 20 in a corresponding recess also positively locates the container 14.

The concentrate dispensing mechanism 20 comprises a housing 78 defining a concentrate chamber 80 and a outlet mechanism housing 82 communicating therewith. Housing 78 defines an inlet passage 78*a* from the concentrate container 14 to the chamber 80. This inlet passage 78*a* terminates in a valve mechanism 78*b* which controls the flow of concentrate from the concentrate container 14 to the chamber 80. The valve mechanism 78*b* comprises a cage 78*c* in which a ball 78*d* is captured between an outlet 78*e*. Outlet 78*e* is of reduced area compared with the area of the passage 78*a* and a seat 78*f* at the upper level of the cage 78*c*. The seat 78*f* is defined by an O-ring seal.

The ball 78*b* opens the passageway 78*a* in the absence of concentrate in the chamber 80 by resting on the outlet 78*e* which forms a seat for this purpose. When the chamber 80 is charged with the required volume of concentrate, the ball 78*b* is seated on the valve seat 78*f*.

The further housing 82 defines an outlet mechanism for the passage of concentrate from the chamber 80 to a mixing chamber 24 (see FIG. 1). The body of the housing 82 defines a first passageway 82*a* with an enlarged bore 82L at the end thereof communicating with the chamber 80 and also communicating with a valve chamber 82b within the housing 82. Valve chamber 82*b* in turn communicates with an outlet passageway 82*c* (which in this embodiment is horizontally inclined) which delivers concentrate via its outlet opening 82*d* (which in this embodiment is vertically inclined) to the mixing chamber 24. The horizontal and vertical inclinations can be varied to suit the relative positioning of the dispensing mechanism and the mixing chamber. The outlet passageway 82*c* communicates with the interior of chamber 82*b* by means of an annular passageway 82*e* which ensures that all concentrate delivered to the chamber 82*b* via the passageway 82*a* is expelled into the passageway 82*c*. Within the valve chamber 82*b*, a valve mechanism comprises a diaphragm 82*f* associated with a valve member 82*g* biased by a spring 82*i* arranged between an upper part of the housing 82 and a valve collar 82*j* on the member 82*g*. It will be seen that the housing has an aperture 82*k* through which the valve member 82*g* projects when raised. The aperture 82*k* enables venting of air in the upper part of the chamber 82*b* when the diaphragm 82*f* is displaced due to the pressure in the chamber 80. The venting of chamber 82*b* is merely to allow expansion of the diaphragm 82*f*.

The chamber 80 communicates with a supply of carbonation gas from the reservoirs 40*a* to 40*d* via the charge line 44 which is connected to an inlet valve mechanism 84. Inlet valve mechanism 84 comprises an inlet connection 84*a*, a passageway 84*b* and an outlet valve 84*c*. The outlet valve 84*c* comprises a cage 84*d* in which a ball 84*e* is seated on a lower seat 84*f* in FIG. 4A or an upper seat 84*g* in FIG. 4B.

As described with reference to FIG. 2, carbonation gas from the reservoirs 40 is used to dispense a charge of concentrate from the chamber 80. When a charge of carbonation gas is applied along the charge line 44 through the valve mechanism 84, the concentrate in the chamber 80 is forced through the outlet mechanism 82. At the same time ball 78*d* is forced against seat 78*f* and prevents gas entering the container 14.

When the chamber 80 is empty (or substantially so) and vented to atmosphere via the mechanism 84 and the charge line 44 and/or an associated concentrate selection mechanism 50, concentrate may flow from the concentrate container 14 into the chamber 80 under gravity feed. The chamber 80 charges with concentrate to the level shown in FIG. 4B, which is a predetermined level. The inlet valve mechanism 84 has its ball 84*e* displaced to an upper seat 84*g* thereby preventing concentrate from leaving via mechanism 84 and the the charge line 44 (FIG. 2). Similarly, the ball 78*d* of valve 78*b* controlling the flow of concentrate from the container 14 to the chamber 80 is seated on the valve seat 78*f*. The outlet mechanism 82 also has its valve member 82*g* and diaphragm 82*f* in its closed position.

Thereafter, a charge of carbonation gas along the line 44 drives the measured quantity of concentrate from the chamber 80 through the outlet mechanism 82 and into the mixing chamber 24 (see FIGS. 1 and 2). The valve 82*g* is opened by the pressure of the concentrate which is pressurised by the gas through valve mechanism 84.

The dispensing of the concentrate from the chamber 80 is synchronised with the dispensing of carbonated water from the carbonation chamber 26 by means of the operation of the solenoid 52 of FIG. 2.

Figure 5A:
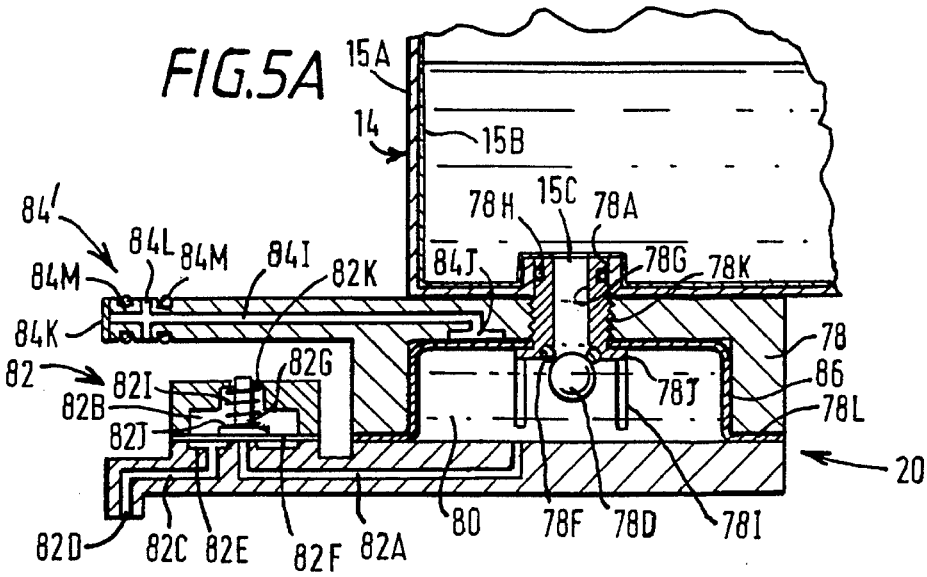
FIGS. 5A, 5B and 5C show sectional views of an alternative embodiment of a concentrate dispensing mechanism, with the mechanism full, empty, and filling with concentrate.
Figure 5B:
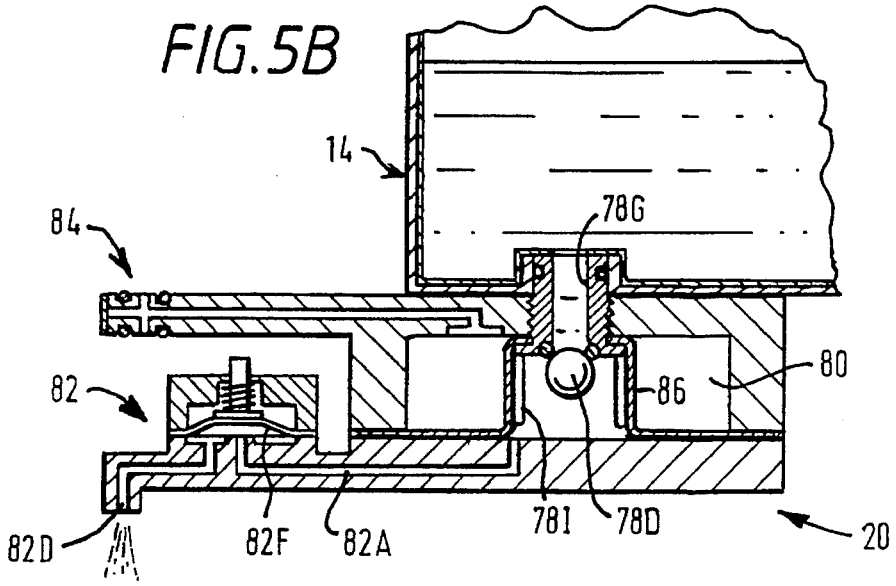
Figure 5C:
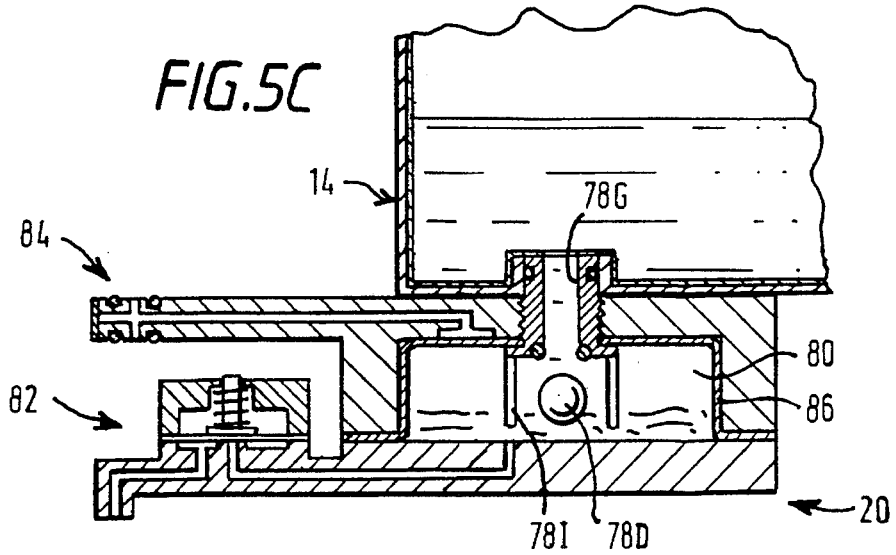

Modified Concentrate Dispensing Mechanism 20' (FIGS. 5A to 5C)

An alternative embodiment of a concentrate dispensing mechanism 20' is shown in FIGS. 5A, 5B and 5C which respectively show the chamber 80 when it is charged with concentrate, when it is empty of concentrate, and when it is charging with concentrate.

The same reference numerals will be employed in describing FIGS. 5A to 5C as were used for like parts in FIGS. 4A and 4B. In particular, the container 14 is also of the bag-in-box type with an outer wall 15*a*, a liner 15*b* and an opening 15*c* (defined by a portion of the container wall as shown).

One modification is that the chamber 80 in this embodiment has a diaphragm 86. This also results in a modification of the means for control of gas via the inlet valve mechanism 84. It also changes the valve 78 for charging of concentrate from the concentrate container 14. The valve outlet mechanism 82 remains the same and reference numerals 82,82*a* to 82*k* will not be further explained.

In this embodiment, the inlet mechanism 84' has an inlet passageway 84*i* which at its inner end communicates with the chamber 80 where it has an enlarged diameter outlet 84*j*. At its outer end, the inlet passageway 84*i* communicates with the charge line 44. It is sealed at its axial end 84*k* and it has a radially extending passageway 841 arranged between two O-ring seals 84*m*. This arrangement at the end 84*k* of the inlet valve mechanism 84 allows the mechanism 84 to be a push fit into the charge line 44. The O-ring seals 84*m* ensure that the pressure balances are such that the valve mechanism 84' is not urged away from the charge line 44.

Communication between the container 14 and the chamber 80 for the concentrate is via passageway 78*a* (as in the FIG. 4 embodiment). In this embodiment the inlet passage 78*a* accommodates a tubular member 78*g* which is sealed therein by means of an O-ring seal 78*h* and which at its lower end carries a radially outwardly extending flange 78*j* from which there is a depending skirt member 78*i*. The tubular member 78*g* is threadedly connected by means of threaded connections 78*k* to the housing 78 in the passageway 78*a*. As in the FIG. 4 embodiment the passageway so defined has an O-ring seal 78*f* which forms a seat for the ball 78*d* which acts as a valve member for the control of concentrate from the container 14 into the chamber 80.

The tubular member 78*g* has a bore through which concentrate flows from the concentrate container 14 into the chamber 80. The depending skirt member 78*i* determines the volume of the chamber 80 which extends radially outwardly thereof. This volume is the volume of concentrate which is dispensed through the passageway 82*a* when the carbonation gas issues into the chamber 80 above the diaphragm 86 via the inlet passageway 84*i*.

At its inner periphery the diaphragm 86 is secured between the flange 78*j* and the housing 78. At its outer periphery the diaphragm 86 is secured at the location 781 between parts of the housing 78.

When, as shown in FIG. 5A, the chamber 80 is full of concentrate the diaphragm 86 adopts a configuration which conforms to the upper and side walls of the chamber 80. After discharge of the concentrate (FIG. 5B), the chamber 80 gas is exhausted via the charge line 44 and the passageway 84*i*. Then the chamber 80 starts to refill with concentrate (FIG. 5C).

The passage 84*i* communicates with the charge line 44. When this is exhausted, the gas in the chamber 80 above the diaphragm 86 is exhausted to atmosphere and this allows the diaphragm 86 to occupy the position shown in FIGS. 5A and 5C.

In FIG. 5C, the pressure in the chamber 80 is now at ambient pressure and the concentrate flows via the passage 78*a* (reduced in diameter by the member 78*g*) into the chamber 80 under gravitational flow. The chamber then fills to the position shown in FIG. 5A where the ball 78*d* comes into contact with the seat 78*f* and closes the chamber 80. Valve 78*b* also prevents concentrate re-entering container 14.

When a charge of carbonation gas is admitted through valve mechanism 84, it causes the diaphragm 86 to be forced downwardly to expel the concentrate from the chamber 80. The diaphragm is forced into the position shown in FIG. 5B where the chamber is emptied.

During the emptying of the chamber, the outlet mechanism 82 is actuated by the pressure of the liquid concentrate which in turn is determined by the pressure of the gas entering the upper part of the chamber, i.e. above the diaphragm 86.

The diaphragm has the advantage that it separates the carbonation gas entering the chamber 80 through the passageway 84*i* from the liquid concentrate in the cheer 80. This avoids the issue of carbonation gas through the dispenser outlet 82*d* which has been known to occur with the embodiment of FIG. 4. The separation also ensures that there is no possibility of concentrate entering the inlet passageway 84*i* at the enlarged diameter outlet 84*j*. It also closes the outlet passageway 82*a* (FIGS. 5A and 5B respectively).

The arrangement shown in FIGS. 5A to 5C has the advantage that the capacity of the chamber 80 can be modified by the appropriate selection of the depending member 78*i*. Thus, for different concentrates the chamber volume can be varied in order that a different ratio of concentrate to carbonated water can be dispensed through the mixing chamber 24 into the glass 22 (see FIG. 1).

Figure 6B:
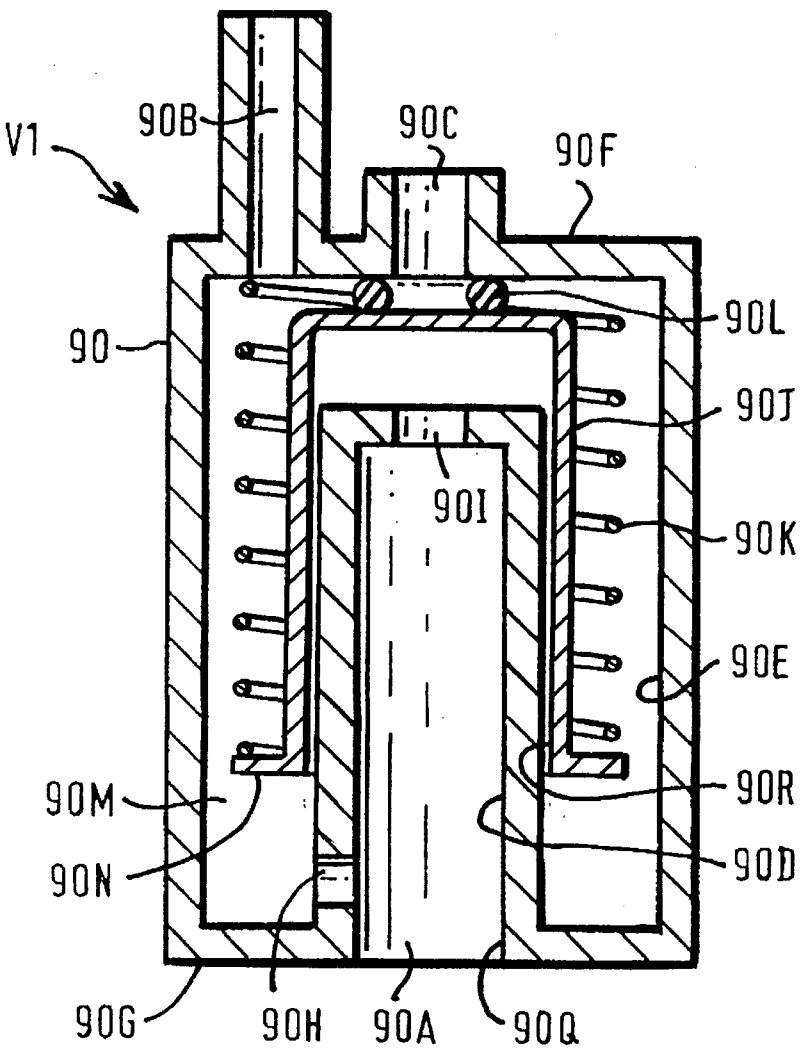
FIGS. 6A, 6B show sectional views of an auto exhaust valve mechanism with the valve member in two operating positions.
Figure 6A:
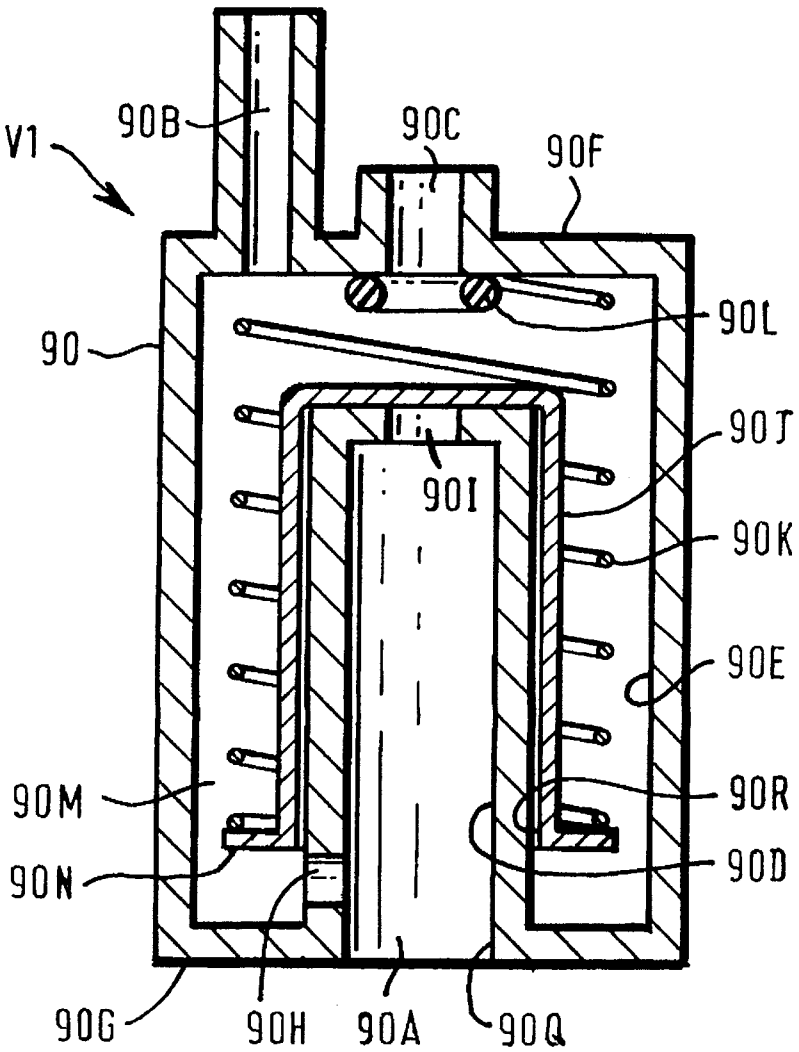

Auto Exhaust Valve V1 (FIGS. 6A,6B)

The construction of the auto exhaust valve V1 of FIG. 2 will now be described with reference to FIGS. 6A and 6B. The auto relief valve V1 comprises a housing 90 with an inlet passage 90*a*, and an outlet passage 90*b* and an exhaust passage 90*c*. The housing 90 is defined by an inner cylindrical casing 90*d*, an outer cylindrical casing 90*e*, these being joined at one end by a first end plate 90*f* itself being contoured to provide the outlet passage 90*b* and the exhaust passage 90*c*. A second end plate 90*g* joins the inner and outer cylindrical casings 90*d* and 90*e* at their other end and defines the inlet end 90*q* of inlet passageway 90*a*. The inner cylindrical casing 90*d* has a first aperture 90*h* which is arranged near the inlet end 90*q* of the passage 90*a* and which enables said passage 90*a* to communicate with the interior of the housing. The interior of the housing is designated the chamber 90*m*. Likewise, at the inner end of the passage 90*a* there is an aperture 90*i* which enables the passage 90*a* to communicate with the chamber 90*m*. Within the housing 90 there is a closed cylindrical valve member 90*j* which is mounted on the inner cylindrical casing 90*d*. The valve member 90*j* is biased to close the aperture 90*i* by means of a spring 90*k*. Spring 90*k* is arranged between the housing and a flange 90*n*. Flange 90*n* extends outwardly of the open lower end 90*r* of the valve member 90*j*. The spring 90*k* is arranged concentrically with an O-ring seal 901 at the interior of the first end plate 90*f* and with the exhaust passage 90*c*.

The inlet passage 90*a* is arranged to communicate with the gas supply line 38 from the carbonation chamber 26 (FIG. 2). The outlet passage 90*b* is arranged to communicate with the gas supply line 39 extending from the auto exhaust valve V1 to the reservoirs 40. The exhaust passage 90*c* enables the auto exhaust valve V1 to vent any surplus carbonation gas from the chamber 26 to atmosphere after the reservoirs 40 have been charged.

Operation of the Auto Exhaust Valve V1

The auto exhaust valve V1 has as its primary function to exhaust the surplus carbonation gas from the carbonation chamber 26 after the reservoirs 40 have been charged. The gas from the carbonation chamber 26 is controlled by the solenoid valve S1 (FIG. 2). It enters the passage 90*a* and passes through the aperture 90*i* into the chamber 90*m* displacing the valve member 90*j*. It also passes into chamber 90M via aperture 90H. The pressure drop across aperture 90H ensures that there is a pressure differential across the valve member 90*j* whereby the valve member 90*j* is displaced. It is necessary that the valve member 90*j* is a sufficiently close fit on the cylindrical casing 90*d* in order that this pressure differential is maintained and that the pressure differential is not dissipated by leakage therebetween.

As shown in FIG. 6A the valve member 90*j* initially seals the aperture 90*i*. The exhaust passage 90*c* is then open and the carbonation gas can flow to atmosphere via aperture 90*h* from passageway 90*a* to chamber 90*m* and then passage 90*c*.

When valve member 90*j* is displaced by the pressure of the carbonation gas to close the exhaust passageway 90*c*, the gas will flow through the passage 90*b* to charge the reservoirs 40 via the line 39. The valve member 90*j* is temporarily maintained in the position (shown in FIG. 6B) where it closes the exhaust passage 90*c*. It is held in that position until the pressure differential across the aperture 90*h* falls below the level at which it can hold the valve member 90*j* displaced against the action of spring 90*k*. This occurs when the pressure of the surplus (waste) carbonation gas from the carbonation chamber 26 is substantially reduced for example to about 3 to 4 bar (about 50 psig). Once the reservoirs 40 are charged, any surplus carbonation gas passes through exhaust passageway 90*c* as soon as valve member 90*j* leaves valve seat 901.

Figure 7:
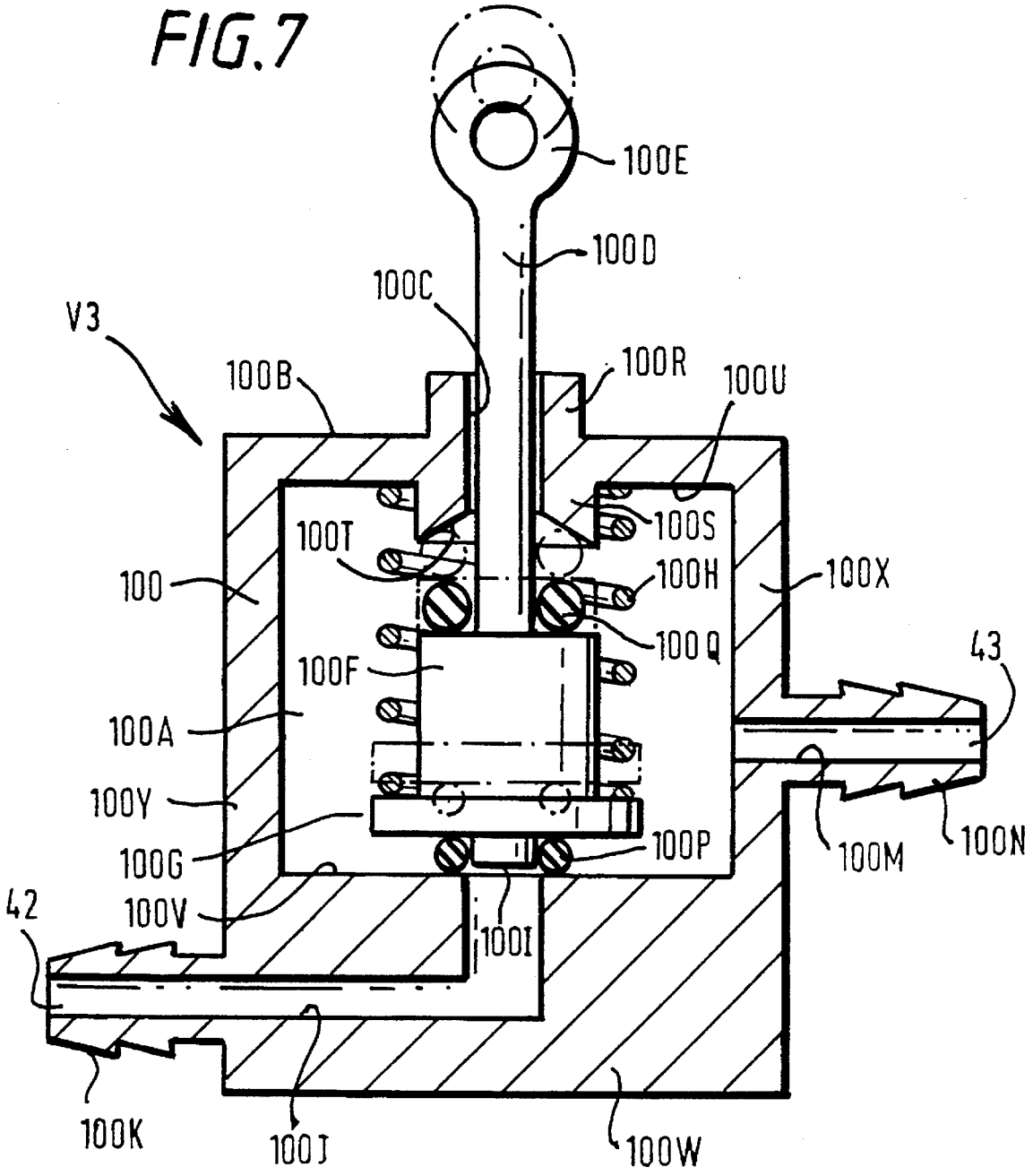
FIG. 7 shows a sectional view of a relief valve mechanism.

Multifunction Pressure Release Valve V3 (FIG. 7)

The pressure relief valve V3 has a housing 100 which defines a chamber 100*a*. A top wall 100*b* defines an exhaust and valve passageway 100*c* in which a valve shaft 100*d* is reciprocally displaceable. Valve shaft 100*d* has at its upper end a connector (which here is in the form of a closed eyelet) for connection to the solenoid S2 of FIG. 2. The valve shaft 100*d* carries a valve member 100*f* and a valve collar 100*g* and terminates in its lower end 100*i*. The lower end 100*i* in one position of the valve shaft 100*d* can depend into a passageway 100*j*. The passageway 100*j* is defined by the housing and extends through a projecting connector 100*k*. The projecting connector 100*k* is connected to the charge line 42 leading to the reservoirs 40 (see FIG. 2). Another passageway 100*m* extends through a projecting connector 100*n* which is connected to a charge line 43 from the pressure relief valve V3 to the concentrate selector mechanisms 50 with their buttons 18 (see FIG. 2). The valve shaft 100*d* is associated with a sealing ring 100*p* which surrounds the lower end 100*i* thereof and is arranged concentrically with the passageway 100*j* at the chamber outlet. Another sealing ring 100*q* is arranged about the valve shaft 100*d* immediately above the valve member 100*f* and in contact therewith. The housing further defines an outer extension 100*r* of the valve passageway 100*c* and an inner extension 100*s* thereof. The inner extension 100*s* has a cavity 100*t* at its lower end. A valve spring 100*h* is arranged between an inner surface 100*u* of the top wall 100*v* and the collar 100*g* so as to bias the valve shaft 100*d* downwardly in the chamber towards an interior surface 100*v* of a bottom wall 100*w*. The passageway 100*m* extends through a sidewall 100*x* which is opposite the sidewall 100*y* as shown in FIG. 7. The chamber 100*a* itself may be cylindrical and therefore these references to opposite sidewalls refer that wall as seen in cross-section. The spring 100*h* is arranged concentrically with the passageway 100*c*, the valve shaft 100*d*, the valve member 100*f*, the valve collar 100*g*, and the inwardly depending extension 100*s*.

Operation of the Pressure Relief Valve V3

The operation of the relief valve V3 to pass carbonation gas to the dispensing mechanisms 20 (see FIG. 2) is controlled by the displacement of the shaft 100*d* by the solenoid S2 (of FIG. 2). It also acts to exhaust the dispensing mechanism and it also acts as a pressure relief valve as will be explained.

As shown in FIG. 7 the valve shaft 100*d* is in a lower position in which the lower end 100*i* is about to enter the passageway 100*j* and the O-ring 100*p* ensures that the valve collar 100*g* seals that passageway. If one of the concentrate selection mechanisms 50 of FIGS. 3A to 3C is actuated to allow the flow of carbonation gas from a dispensing mechanism 20 to flow to exhaust, then that gas passes along the line 43 and into the chamber 100*a* of the pressure relief valve and exits through the exhaust passageway 100*c*.

When the solenoid S2 is actuated to charge the dispensing mechanism 20 with a charge of carbonation gas to dispense a measured quantity of concentrate, then the solenoid S2 raises the valve shaft 100*d*. This brings the valve member 100*f* into a position juxtaposed with the interior extension 100*s* such that the O-ring seal 100*q* is compressed in the cavity 100*t* thereof to seal the exhaust passageway 100*c*. Carbonation gas from the reservoirs 40 can then flow along the charge line 42 into the passageway 100*j* and out through the passageway 100*m* via charge line 43, the selection mechanism 50 and to the dispensing mechanism 20 to thereby discharge a measured quantity of concentrate. After a timed interval the solenoid S2 returns the shaft 100*d* to its lower position (FIG. 7) in which the passage 100*j* is again sealed off.

This valve V3 also acts as a pressure relief valve in the event of a malfunction causing the pressure in the charge line 42 (and thus the passageway 100*j*) to become excessively high, for example due to the reservoirs 40 being charged to a pressure level well beyond that required for driving the dispensing mechanisms 20. In that event, the gas pressure acting on the valve collar 100*g* of the valve member

100*f* causes the valve member 100*f* to be displaced thereby permitting the gas to vent to atmosphere through the exhaust passageway 100*c*. This flow of gas through passageway 100*c* continues until the gas pressure in charge line 42 is reduced to its desired level whereupon valve 100*f* closes on the seat 100*p* under the bias of spring 100*h*.

Figure 8:
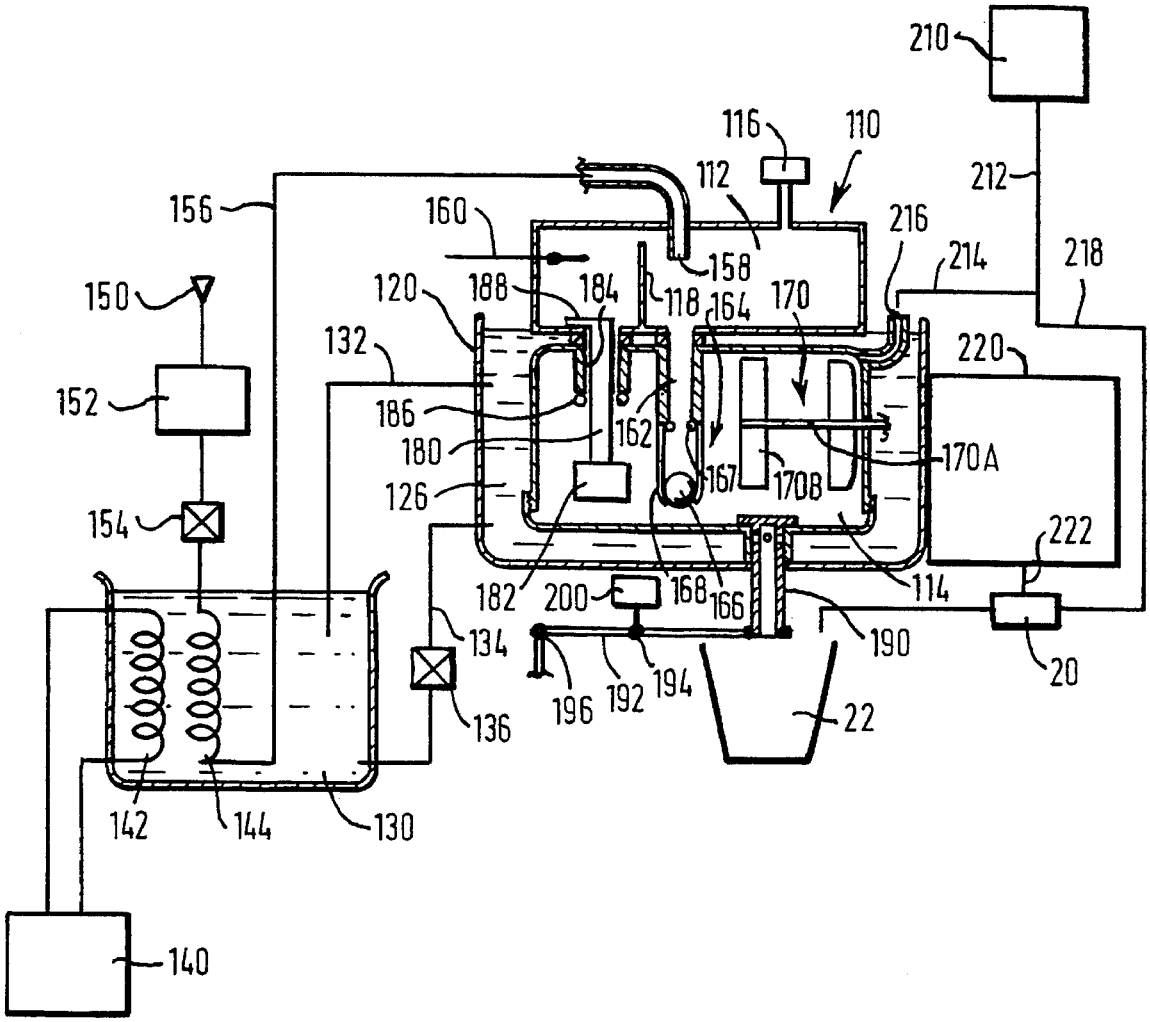
FIG. 8 shows a schematic view of carbonation apparatus, similar to FIG. 2, but including graphic representation of refrigeration means and a carbonation chamber (the chamber being empty)
Figure 9A:
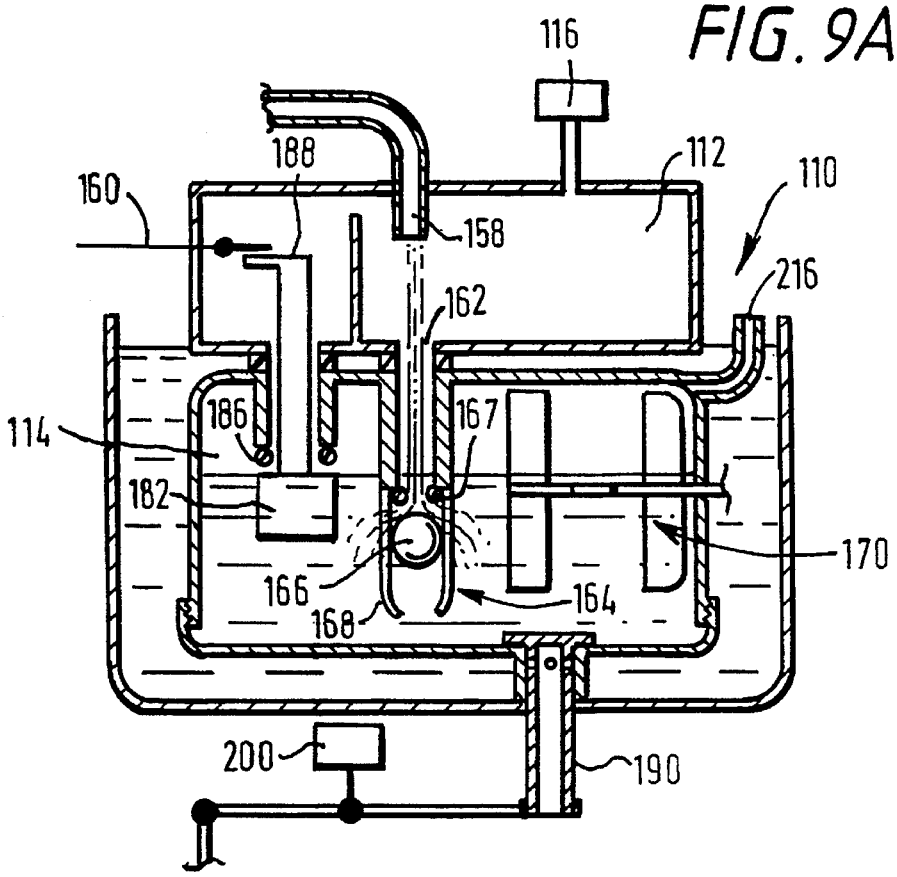
FIGS. 9A, 9B show further sectional views of the carbonation chamber of FIG. 8 with the chamber water level at two stages namely filling and full, respectively.
Figure 9B:
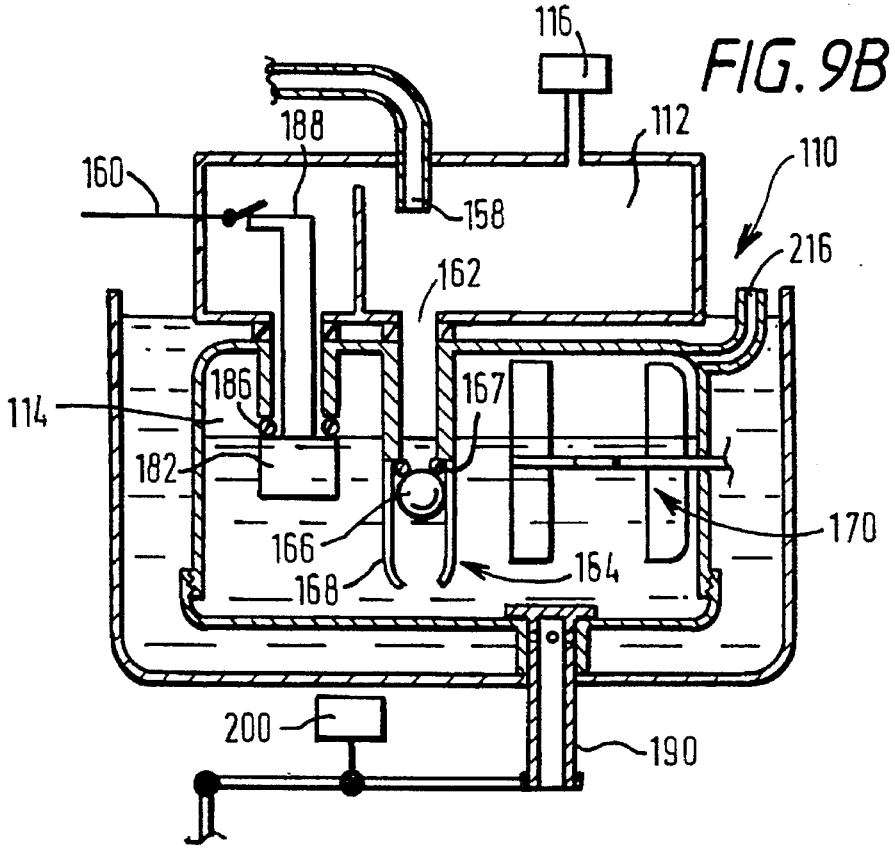

Carbonation Apparatus of FIGS. 8, 9A and 9B

In FIG. 8 there is a schematic diagram of a carbonation apparatus (generally similar to that of FIG. 1). The carbonation chamber 110 is surrounded by a cooling jacket 120. Both the carbonation chamber 110 and the cooling Jacket 120 are supplied with water 126 therein from a refrigerating tank 130. The tank 130 is refrigerated by means of the refrigerant compressor 140. Refrigerant circulates in the coil 142 which co-operates with the coil 144 in the tank 130 to chill the water supply. The tank 130 contains water which is cycled via a supply line 134 and a pump 136 to the cooling jacket 120 and returns via a return line 132. The water supply for the chamber 110 comes from a mains supply at 150 via a flow controller 152 and a solenoid valve 154. It passes through the coil 144 in the tank 130 and along a supply line 156. It issues through a water inlet 158 to an upper chamber 112 of the carbonation chamber 110. This upper chamber 112 provides a water supply break between the mains water supply 150 and the agitating chamber 114. Upper chamber 112 is vented to atmosphere through a vent 166. This upper chamber 112 has a baffle 118 which shields sensing means 160 from the water issuing from the inlet 158. Within the agitating chamber 114 there is an inlet conduit 162 which houses a valve 164 comprising a ball 166 and cage 168 for controlling the flow of water into the chamber 114. Also within the chamber 114 is an agitator means 170 for assisting in the carbonation of the water by mechanically forcing carbonation gas from the head space above the water downwardly into the body of the water. It has a horizontal shaft 170*a* and vertical paddles 170*b* and is driven by a motor (not shown) under the control of a control circuit (not shown). Metering means 180 meters the level of the water in the chamber 114. This metering means 180 comprises a float valve 182 which is guided in a channel 184 as the water level rises until the float valve 182 itself comes into contact with seal 186. At the same time an upper end 188 of the float valve 182 comes into contact with the sensing means 160. The sensing means 160 is electrically connected to the control circuit which sequences the operation of the apparatus. Valve means 190 control the flow of carbonated water from the agitating chamber 114. This valve means 190 is connected to a beam 192 which is pivoted at 194 and at 196. The valve means 190 is controlled by a solenoid 200. As the valve means 190 moves up, carbonated water flows from the chamber 114 into a glass 22. A reservoir 210 for the supply of carbon dioxide is connected by means of a supply line 212 and a supply line 214 to the inlet 216 at the agitating chamber 114. A further line 218 from the supply line 212 (and thus reservoir 210) connects with a concentrate dispensing mechanism 20 associated with a concentrate container 220. The concentrate dispensing mechanism 20 (FIG. 1) is arranged to issue metered quantities of concentrate (flavouring or syrup) into the glass 22 simultaneously with the supply of carbonated water from the tank 114. Dispensing mechanism 20 is shown linked to concentrate container 220 by a concentrate supply line 222: this arrangement is schematic and reference is made to FIGS. 4A,4B and 5A to C which are intended to illustrate the relationship employed in the apparatus of FIG. 8 also.

The apparatus of FIG. 9A includes the carbonation chamber 100 of FIG. 8. Components already described have the same references. In FIG. 9A, the water is issuing from inlet 158. The ball 166 of the valve 164 normally floats and is forced downwardly by the supply of water. The supply of water through the upper chamber 112 continues to maintain the ball 166 in a depressed condition in which it cannot seat on an O-ring seal 167. This is especially advantageous since the ball 166 and cage 168 afford a very efficient and very inexpensive form of valve for controlling the supply of water to the agitating chamber 114. Termination of the flow of water into the chamber 114 via the upper chamber 112 occurs when the float valve 182 contacts the seal 186 (as shown in FIG. 9B) simultaneously with the upper end 186 of the float valve 182 actuating the sensing means 160. This actuates the solenoid 154 (FIG. 8) to cut off the water supply through the water inlet 158. During the filling operation, the lower chamber 114 is continually vented by the upper chamber 112 through the vent 116 to atmosphere. The upper chamber 112 provides a break in the water supply between the inlet 158 and the water in the chamber 114. Once the water supplied through the inlet 158 ceases, communication between the chamber 114 and atmosphere through the vent 116 via the upper chamber 112 also ceases. The apparatus is then ready for the next stage of operation which is the carbonation of the water in the agitating chamber 114. This occurs when the carbon dioxide from the container 210 is supplied via the carbonation gas lines 212,214 and inlet 216. The agitator means 170 is rotated for a finite duration.

Thereafter the carbonation water can be dispensed through the valve means 190 under the control of solenoid 200 into a glass 22.

Flow Controller 152

Figure 10:
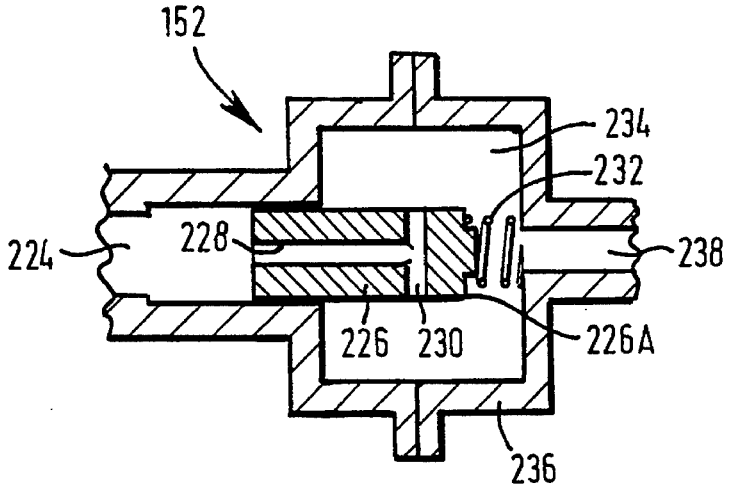
FIG. 10 shows a sectional view of a water pressure regulation mechanism of the apparatus of FIG. 8.

FIG. 10 shows the flow controller 152 of FIG. 8. In flow controller 152, water supplied to the inlet 224 passes into the flow controller 152 via a regulator member 226 which has passageways therein 228 and 230. The passageway 228 extends axially of the regulator member 226 along part of its length to where it joins the passageway 230 which extends radially thereof so as to issue at opposite sides. The regulator member 226 is biased by spring 232 arranged coaxially therewith. The chamber 234 within the housing 236 fills with water which issues through the outlet 238 about which the spring 232 extends concentrically. The end 226a of the regulator member 228 is of reduced diameter thereby to provide a seat for spring 232.

The flow controller 152 operates in the following manner: the increase in pressure at the inlet 224 causes the regulator member 226 to move further across the chamber 234 (to the right as shown in the drawing) towards the outlet 238 against the bias of the spring 232. This reduces the space between the regulator member 226 and the outlet 238. This movement effectively reduces the flow rate of water from the outlet 238. Conversely, a reduction in the inlet water pressure at the inlet 216 will allow the spring 232 to displace the regulator member 226 (to the left) away from the outlet 238 and thereby increase the space between the regulator member 226 and the outlet 238. This latter action has the effect of increasing the flow rate of water through the outlet 238 and the flow from the chamber 234. Thus, the flow controller 152 clearly assists in regulating the water supply to the chamber 110.

The Gas Supply Changeover Mechanism

Figure 11:
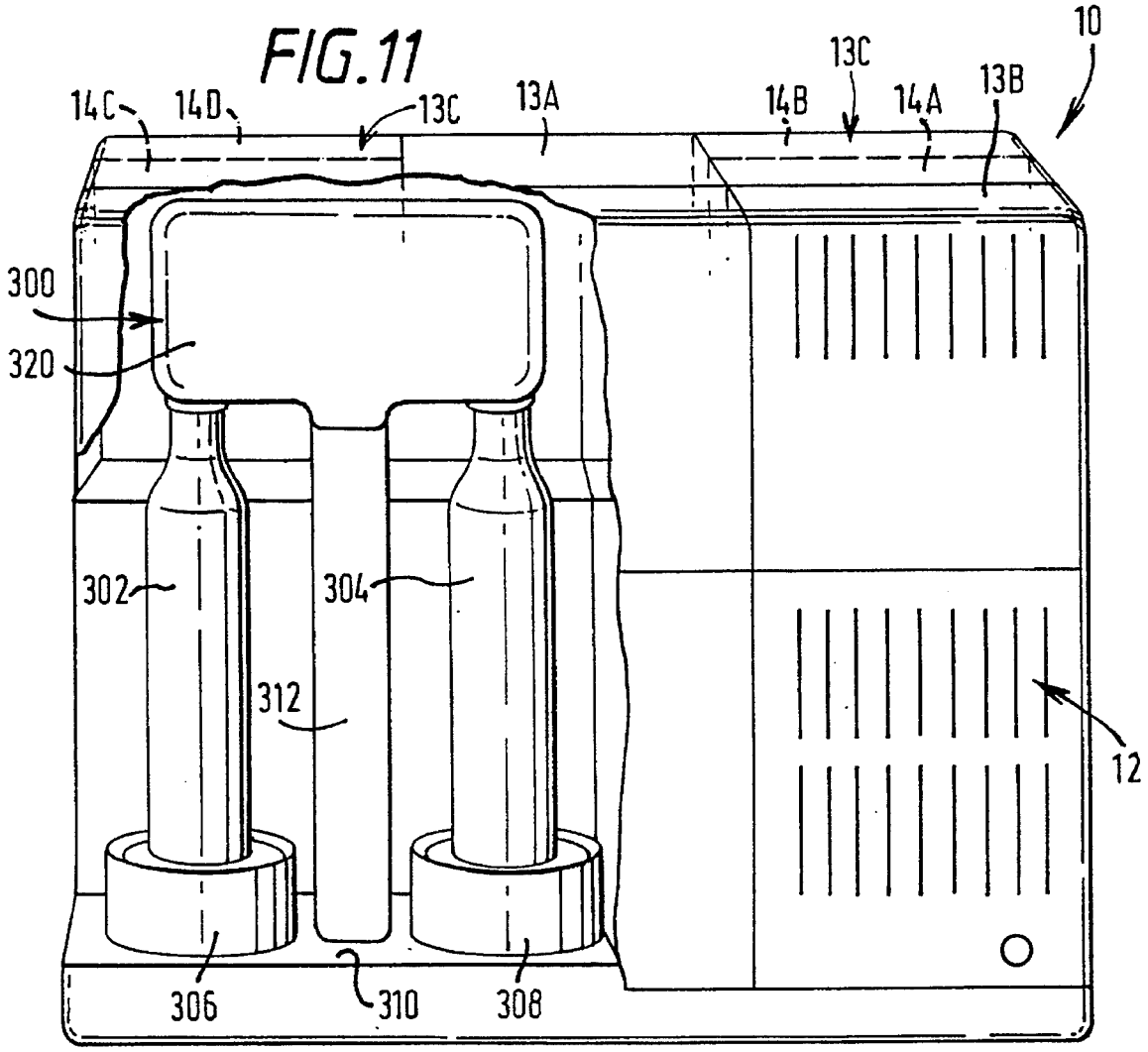
FIG. 11 shows a rear perspective view of the carbonation apparatus with a changeover mechanism for changing the carbonation gas applied between two gas cylinders.

In FIG. 11 there is shown the housing 12 of the carbonation apparatus 10 of FIG. 1. In this rear view, part of the housing casing is removed. The upper rear portion as in FIG. 1 has a central portion 13*a* and a rear portion 13*b* part of which houses the changeover mechanism 300. In this view it will be seen that the changeover mechanism 300 is in communication with gas supply bottles 302 and 304 for the supply of carbonation gas (carbon dioxide) which sit on respective bottle holders/supports 306,308 on the interior base 310. The changeover mechanism 300 comprises a lower housing 312 which depends from an upper housing 320.

Figure 12:
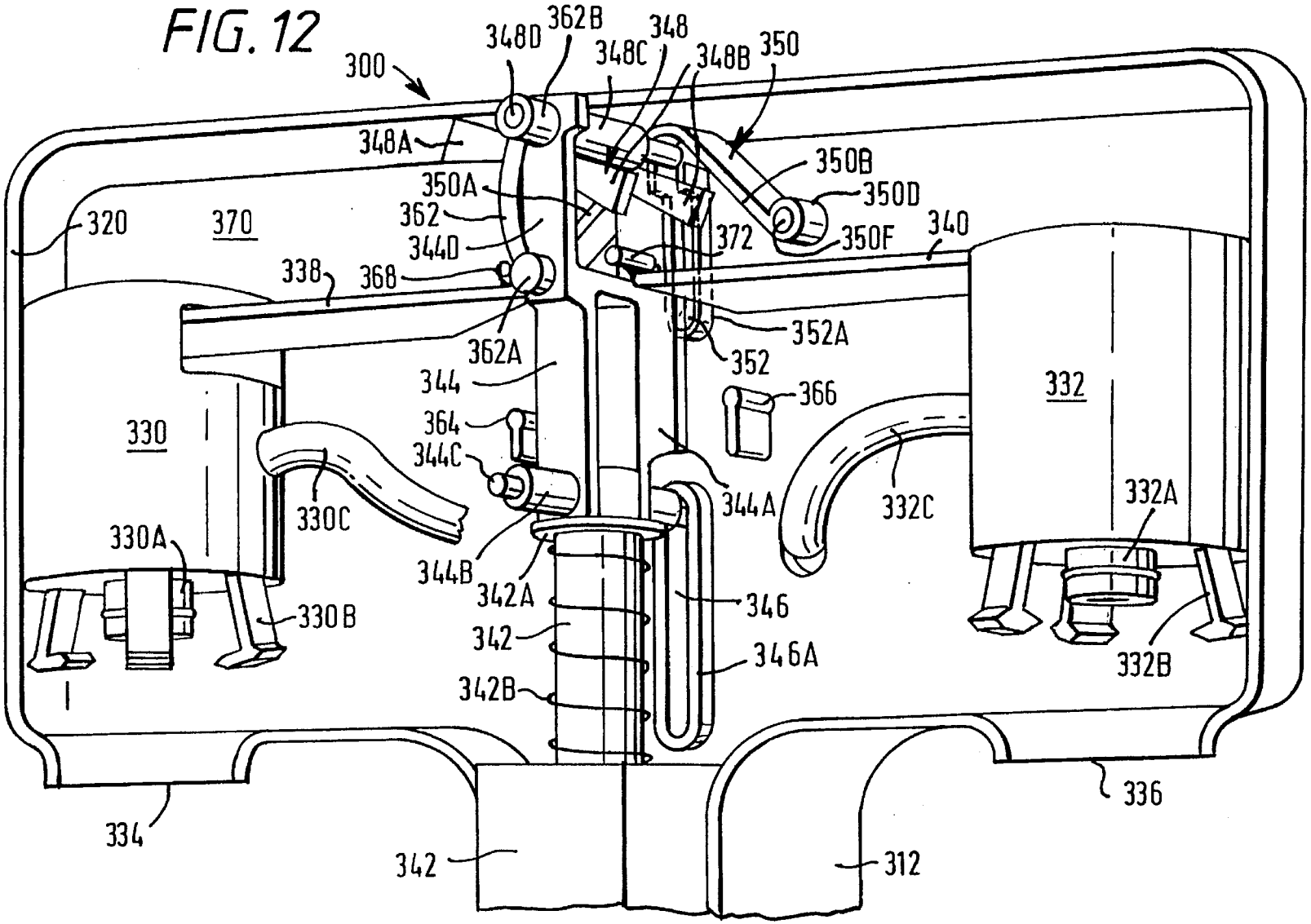
FIG. 12 shows a perspective view of the changeover mechanism of FIG. 11 when a cover plate is removed.

In FIG. 12 a cover plate of the changeover mechanism 300 has been removed so that one side of the mechanism within the housing 320 is visible. Within the housing 320 there are a pair of bottle connector housings 330 and 332. Each housing 330,332 is provided with a gas flow coupling member 330*a*,332*a* and fastener means 330*b*,332*b* and hose means 330*c*,332*c* for carrying the carbonation gas to the carbonation chamber (26, FIG. 2). The upper housing 320 itself has moulded openings 334 and 336 for the bottles 302 and 304 (FIG. 11). Each housing 330,332 has an associated actuator lever 338,340 which is actuated to open a respective valve (not shown) in the housing 330,332 to allow the passage of gas from a respective one of the bottles 302,304 via the respective coupling member 330*a*,332*a* through the valve and out through a hose 330*c*,332*c*.

A solenoid 342 is provided to drive the changeover mechanism 300. This solenoid extends into the lower housing 312 (also FIG. 11). The solenoid 342 is biased by a spring 342*b* acting upwardly on the collar 342*a*. The solenoid 342 is connected to a transfer member 344. It is the transfer member 344 which determines which of the actuator levers 338,340 is depressed and therefore which of the bottles 302,304 supplies gas to the carbonation chamber.

The transfer member 344 comprises a yoke member with lower limbs 344*a* each having a boss 344*b* for co-operation with a guide pin 344*c* about which it can toggle. The guide pin 344*c* is guided in a guide slot 346 of the housing 320 which has a slot wall 346*a*. The transfer member 344 also comprises upper limbs 344*d*. The upper limbs 344*d* carry a toggle member 348 with toggle arms 348*a,b* and a central boss 348*c* through which extends a pivot pin 348*d* about which the toggle member is pivotal. Toggle arms 348*a*,348*b* each comprise a pair of wings which are spaced wider than the width of the respective actuating levers 338,340. Toggle member 348 co-operates with toggle actuators 368,372 (as will be described) which are carried by (or integral with) the actuating levers 338,340 and extend so as to be contacted by the toggle member 348 when the arms 348*a* or 348*b* pass downwardly relative to the respective actuating lever 338 or 340.

The guide pin 344*c* is constrained to follow the slot 346 in the housing 320. A further slot 352 is defined by an aperture bound by a slot wall 352*a*. The housing 320 supports a toggle guide 350 integral therewith which has a generally inverted V-shape defined by limbs 350*a,b* terminating at their lower end in respective bosses 350*c,d* defining central apertures 350*e,f* through which actuator pins 360 are reciprocated. The means for reciprocating the actuator pins 360 will be further described in relation to a separate actuator mechanism on the other side of the changeover mechanism behind a wall 370.

A biasing member 362, which is resiliently deformable, is associated with toggle member 348. The biasing member 362 has a lower boss 362a attached to the transfer member 344 and displaceable therewith. The upper end of the biasing member 362 comprises an upper boss 362*b* which is coupled to the central boss 348*c* of the toggle member 348 such that as the toggle member is pivoted about its pivot pin 348*d*, so the configuration of the biasing member 362 changes in a resiliently deformable manner to be further illustrated.

The toggle member 348 co-operates with stops 364 and 366 which are integral with the back plate 370 of the housing 320.

Figure 13A:
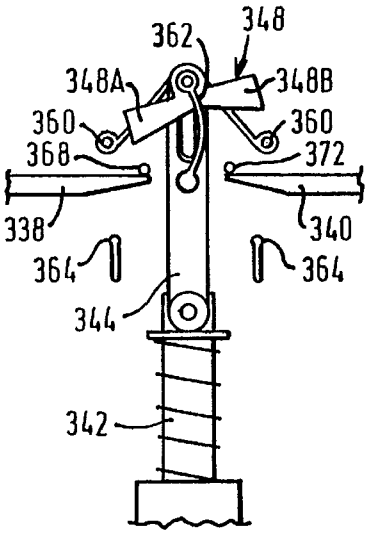

Operation of the Change Over Mechanism (FIGS. 13A to 13X)

The operation of the changeover mechanism and in particular the portion thereof associated with the transfer member 344 and the toggle member 348 will now be described with reference to FIGS. 13A to 13H, 13I to 13P, and 13Q to 13X which as aforesaid show three phases of operation of the changeover mechanism.

Turning to FIGS. 13A to 13H, these show continuous operation using the actuator lever 338 which would actuate the valve in housing 330 (FIG. 12) and thereby use gas from the cylinder 302 (FIG. 11).

Figure 13B:
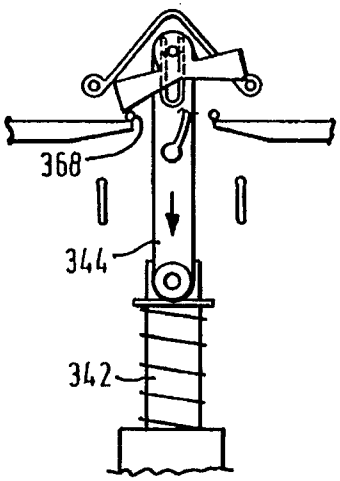
Figure 13C:
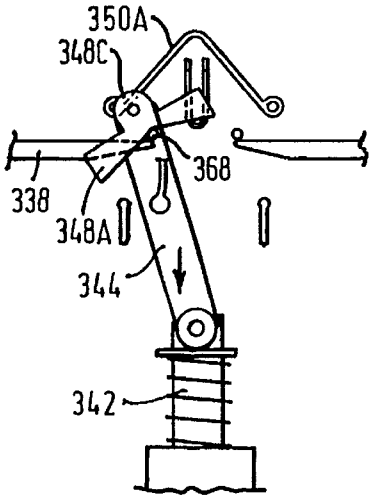
Figure 13D:
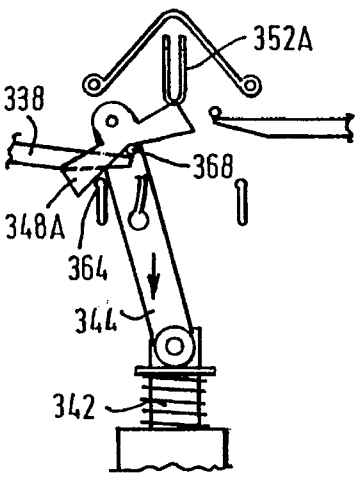
Figure 13E:
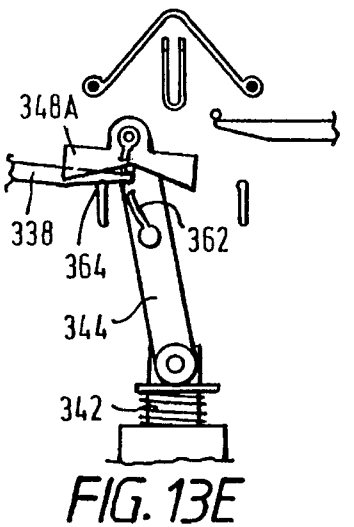

In FIG. 13A, the changeover mechanism 300 is in its initial position in which the toggle member 348 sits with its central boss 348c at the top of slot 352 (slot 352 is best seen in FIG. 13D). It will be noted that the toggle 348 is biased so that the limbs 348*a* depends downwardly relative to the limbs 348*b* due to the position of the biasing member 362 which is flexed towards the limbs 348*b*. As the solenoid 342 pulls the transfer member 344 downwardly (as shown in FIG. 13B), the limbs 348*a* of the toggle member 348 contact toggle actuator 368 and acts as a cam follower along same: it will be noted that the undersides of the limbs 348*a* and 348*b* are contoured, that is to say, inclined upwardly towards the central boss 348*c* at the middle of the toggle member so as to provide these cam surfaces. As shown in FIG. 13C, the boss 348*c* of the toggle member is brought into contact with the downwardly inclined limb 350*a* of the toggle guide 350. It can be seen from FIGS. 13B and 13C that the camming action of the toggle arms 348*a* on the stop 368 and the camming action of the central boss 348*c* on the toggle guide 350 take the transfer member 344 towards the lever 338 so that in the position shown in FIG. 13D the toggle member 348 is about to actuate the actuator lever 338. In FIG. 13D it will be noted that the underside of the boss 348*c* (of the toggle member 348) actually contacts toggle actuator 368 of the actuator lever 338: the arms 348*a* are wider than lever 338 and thus do not contact same. At the same stage, the toggle arms 348*a* have proceeded downwardly to a position in which the toggle actuator 368 is now centred between the toggle arms 348*a,b*. In FIG. 13E, the solenoid 342 has reached its downward limit and the toggle member 348 is changing its orientation after the toggle arms 348*a* have contacted the stop 364 on the back plate 370 (FIG. 12). This causes the toggle member to pivot about the pin 348*d* and turn clockwise. In making this clockwise movement, the toggle member 348 causes the biasing member 362 to flip from the position (FIG. 13D) in which it is resiliently deformably extending towards the limbs 348*b* to the position shown in FIG. 13E in which it is resiliently deformably extending towards the limbs 348*a*.

Figure 13F:
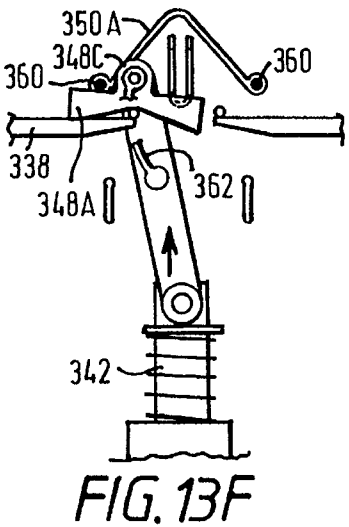

It will be noted that in FIG. 13A, the actuator pins 360, which can project through the bosses 350*c* and *d* of the toggle guide 350, are retracted. When the solenoid 342 is actuated to move downwardly as shown in FIGS. 13B to 13D the pins 360 remain retracted. The pins 360 remain retracted when the solenoid 342 starts its upward Journey (FIG. 13F). An actuator mechanism for the actuator pins 360 will only return pins 360 if there is a gas supply issuing from the appropriate gas bottle (in this case the bottle 302).

Figure 13G:
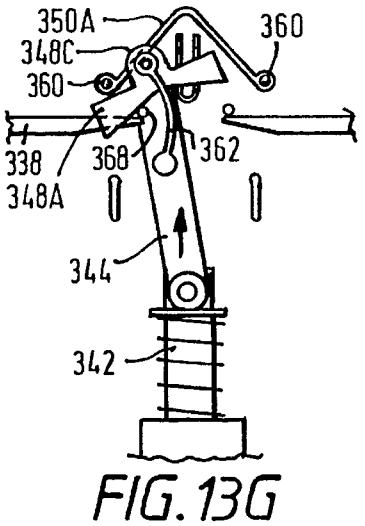
Figure 13H:
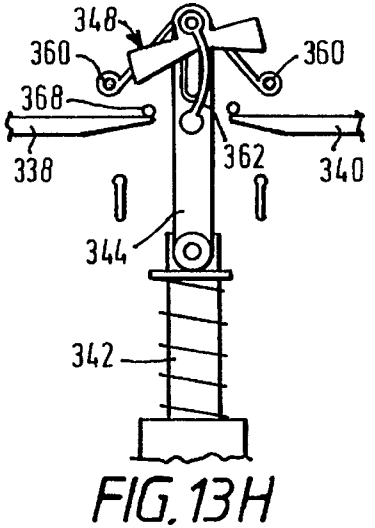

In FIG. 13F, the pins 360 have been returned so that they extend through the bosses 350*c,d*. Thus, as the solenoid 342 and the transfer member 344 are raised, the toggle member 348 comes into contact with one of the pins 360. In this FIG. 13F, it is the arms 348*a* which contacts a pin 360. This causes the toggle member 348 to make a counterclockwise motion again causing the biasing member 362 to flip back into its initial position as shown in FIG. 13G. The transfer member 344 continues its upward movement into the position shown in FIG. 13H which corresponds to the position in which it started in FIG. 13A. The actuator pins 360 are again retracted since the return of the actuator lever 338 to its initial position shuts off the gas supply through the hose 330*c*.

The operation of the changeover mechanism 300 in changing from one gas cylinder 302 to the other gas cylinder 304 (FIG. 11) will now be described with reference to FIGS. 13I to 13P. The sequence of operations in FIGS. 13I to 13M are similar to those shown in FIGS. 13A to 13E. The significant change appears in FIG. 13N when the solenoid 342 starts its upward movement there is no actuator pin 360 at the boss 350*c* of the toggle guide 350. In consequence, the toggle member 348 does not make the counterclockwise motion which appears from FIGS. 13F and 13G under the influence of actuator pin 360. Instead, as the transfer member 344 raises the (FIGS. 13N and 130) toggle member 348 maintains substantially the same attitude and the biasing member 362 remains biased towards the limbs 348*a*. Consequently, when the changeover mechanism 300 has completed its cycle as shown in FIG. 13P, the toggle member 348 is now in an attitude where the limbs 348*b* are below the limb 348*a* and the biasing member 362 extends towards the limbs 348*a*.

The operation of the changeover mechanism 300 with the continuous operation using the gas cylinder 304 will now be described with reference to FIGS. 13Q to 13X. In this cycle, it is the actuating lever 340 which is depressed. It will be noted that the toggle member 348 is biased into a clockwise attitude in which the limbs 348*b* depends below the limbs 348*a*. In its initial position in FIG. 13Q the biasing member 362 is in a position in which it is deformed towards the toggle arms 348*a*. By virtue of that initial inclination, the toggle member 348 will actuate the actuator lever 340 which causes the valve in housing 332 associated with the bottle 304 to be opened (FIG. 12). The sequence of operations followed by the changeover mechanism 300 through FIGS. 13Q to 13U are similar to those described with reference to FIGS. 13A to 13E (or FIGS. 13I to 13M), except that in this instance it is the toggle arms 348B which are actuating the lever 340 and co-operating with toggle actuator 372 thereby allowing use of the gas in the cylinder 304.

The main difference now arises in FIG. 13V where, when the transfer member 344*a* rises, the actuator pin 360 is again present. However this time it is the actuator pin 360 through the boss 350*d* which is effective to co-operate with the arms 348*b* of the toggle member 348. As it moves from FIGS. 13V to 13W, so the toggle member 348 is rotated clockwise causing the biasing member 362 again to flip from the position (FIG. 13V) in which it is biased towards the toggle arms 348*b* towards the position (FIG. 13N) in which it is biased towards the toggle arms 348*a*. The transfer member 344 continues its upward journey to the position shown in FIG. 13X in which the pins 360 are shown extended.

It will be seen that in the above sequence of operations of the transfer member 344 together with the toggle member 348, that it is the actuator pins 360 which determine whether it is the toggle arms 348*a* which contact the toggle actuator 368 to actuate the actuator lever 338 and thus the supply from bottle 302 or whether it is the toggle arms 348*b* which contact the toggle actuator 370 to actuate the actuator lever 340 and therefore the supply from bottle 304. The mechanism for withdrawing and extending the actuator pins 360 will be further described.

Reciprocating Mechanism (FIGS. 14A to 14C)

The mechanism for reciprocating the actuator pins 360 of the changeover mechanism 300 is shown in FIGS. 14A to 14C.

In FIG. 14A, the opposite side of the upper housing 320 of the changeover mechanism 300 is shown. On this side a cover plate is removed to show the internal mechanism for reciprocating the actuator pins 360. This mechanism is separated from the mechanism shown in FIG. 12 by the back plate 370. In this Figure, the hoses 330*c* and 332*c* (shown in FIG. 12) for the gas bottles 302,304 (shown in FIG. 11) can be seen extending from a shuttle valve 380. The openings 334 and 336 for the gas bottles 302 and 304 are again shown.

In terms of mounting the mechanism for reciprocating the actuator pins 360, the back plate 370 is provided with the following features. The back plate 370 has a pair of bosses 370*a,b* which are arranged for the securing of the cover plate (not shown). It has a support 370*c* for mounting a shuttle valve 380. It has a support 370*d* for mounting an actuator means 386. It has supports 370*e,f* for a toggle mechanism 390. It has apertures 370*g* (FIG. 14C) which permit the actuator pins 360 to reciprocate. These apertures 370*g* are aligned with the apertures 350*e,f* of the bosses 350*c,d* in FIG. 12. It is also provided with further supports 370*h* for the toggle mechanism 390.

The shuttle valve as well as having the hoses 330*c* and 332*c* connected thereto, has further hoses 382 and 384. The hose 382 connects the shuttle valve 380 with the carbonation apparatus of FIGS. 1 or 8. The hose 384 connects the shuttle valve 380 with the actuator means 386.

The actuator means 386 is responsive to a pressure signal from the shuttle valve 380. The actuator means 386 comprises a plunger 386a which reciprocates against the bias of an internal spring. Actuation occurs when the gas pressure through the hose 384 is sufficient to overcome the bias of the spring. The plunger 386*a* is connected to a yoke 386*b* which carries a shaft 386*d* for connection to a toggle mechanism 390. The hose connector 386c receives the hose 384 from the shuttle valve 380.

The toggle mechanism 390 comprises a first toggle member 390*a* which is pivotally connected to the shaft 386*d* of the actuator means 386 (FIG. 14B). The toggle member 390*a* is itself fixedly connected to a shaft 390*b*. The shaft 390*b* is journalled in the supports 370*e* and f which extend from the back plate 370. The toggle shaft 390*b* has a pair of spaced toggle membersor cranks 390*c* integral therewith. The toggle members 390*c* carry a toggle shaft 390*d* which is journalled thereto. The toggle shaft 390*d* has reduced end portions 390*f* (FIG. 14C) for the purpose of being journalled to the toggle members 390*c*. These end members 390*f* are integrally connected to a pair of spaced toggle members 390*e* which themselves carry the actuator pins 360.

Operation of the Reciprocating Mechanism (FIGS. 14A to 14C)

The operation of the mechanism shown in FIGS. 14A to C will now be described. The shuttle valve 380 is pneumatically switched but only when the condition in one of the gas bottles 302,304 changes. Within the housing of the shuttle valve 380 there is a reciprocating valve member. Assuming that the gas bottle 302 is in use and is supplying carbonation gas under pressure, then the shuttle valve will be switched so that carbonation gas can pass through the hose 330*c* into the shuttle valve 380 and exit through the hose 382. At this time the shuttle valve within the housing 380 will be positioned such as to seal off and prevent communication between the hose 332*c* for the gas bottle 304 and the exit hose 382 carrying carbonation gas to the carbonation apparatus. The presence of carbonation gas within the shuttle valve 380 will ensure that the gas entering through the hose 330*c* exerts a pressure signal through the hose 384 to permit operation of the actuator means 386. The actuator means 386 operates when the pressure of carbonation gas through the hose 384 is sufficient to overcome the bias of an internal spring which in the absence of the carbonation gas holds the plunger 386*a* retracted. The actuator means 386 in FIG. 14A retracts the actuator pins 360 whenever the gas pressure through hose 384 is insufficient to extend the plunger 386*a*. In this way, we have the situation depicted in FIGS. 13A to 13E in which the actuator pins 360 are withdrawn. In the event that the actuator means 386 detects pressurised gas through the hose 384, then as indicated in FIG. 13E the actuator means 386 extends its plunger 386*a* upwardly. This actuates the toggle mechanism 390 to return the actuator pins 360 to the position in which they extend through the bosses 350*a* and b of FIG. 12. This will bring about the state of the changeover mechanism 300 shown in FIGS. 13E and 13F in which the actuator pins 360 are again extended.

Once the actuating lever 338 returns to its initial position (FIG. 13F), then gas flow through hose 330*c* (FIG. 12) and hence hose 384 ceases. In consequence actuator means 386 retracts the actuator pins 360 as shown in FIGS. 13G and H.

If the actuator means 386 does not receive a pressure signal through the hose 384, then the actuator mechanism does not permit the plunger 386*a* to be upwardly extended. Then, the situation occurs as in FIG. 13M (and therefore FIG. 13N) that the actuator pins 360 are not extended and a changeover may take place. When a changeover takes place, the position of the shuttle valve within the shuttle valve housing 380 will automatically be switched over because one of the hoses 330*c*,332*c* which will formerly have been active, will now be reduced to a very low pressure status whereas the other of the hoses 330*c*,332*c* which was formerly inactive will carry the pressure medium (i.e. the carbonation gas). In consequence the shuttle valve within the shuttle valve housing 380 will switch positions.

The operation of the actuator means 386 and the toggle mechanism 390 is best appreciated from FIGS. 14B and 14C. These Figures clearly illustrate that as the actuator means 386 extends and retracts it plunger 386*a*, so the pins 360 will be retracted and extended with respect to the apertures 370*g* of FIG. 14C. In consequence the actuator pins 360 will also reciprocate with respect to the correspondingly aligned bosses 350*a* and 350*b* with their apertures 350*c* and 350*d* in FIG. 12.

It should be mentioned that if neither of the gas bottles 302,304 are charged with carbonation gas, then the actuator pins 360 will not be extended but instead will be continuously retracted. The changeover mechanism will repeatedly changeover and keep searching for a gas supply. It will be readily appreciated that it is possible to have illuminated indicators indicating the status of the gas bottles so that the user can be warned when each of the gas bottles 302,304 is emptied.

Variable Carbonation

Reference is now made to the apparatus shown in FIG. 15 which diagrammatically shows the apparatus of FIG. 1 with the concentrate containers 14*a* and 14*b* displaced (to the left in relation to the drawing) in order to illustrate the means by which the carbonation period for the carbonation of water in the carbonation chamber 26 may be varied according to the nature of the concentrate in the containers 14*a* to 14*d*. Like reference numerals are used in FIG. 15 as apply to their counterparts in FIGS. 1 and 8: parts bearing similar reference numerals may not be described in relation to this Figure. The illustration of FIG. 15 is schematic and therefore the housing 12 is shown as having a planar support surface 12*a* to receive the dispensing mechanisms 20*a* to 20*d*. In practice, the support surface 12*a* is moulded to provide recesses for the dispensing mechansisms 20*a* to 20*d*. Likewise, although the central upper portion 13*a* of the housing is illustrated, the rearward upper portion 13*b* of FIG. 1 is not illustrated. In addition, the carbonation chamber 26 is shown somewhat diagrammatically and the valve means 190 is shown as a depending spout.

It is desirable to vary the degree of carbonation of the water in the carbonation chamber 26 according to the nature of the concentrate selected for the drink to be dispensed into the glass 22 (FIG. 1). The duration for which the agitator means 170 (FIG. 8) operates, can be varied by varying the duration during which the motor which drives the agitator means 170 is driven according to a control circuit. In order to vary the duration of the carbonation period or at least the period during which the agitator means are operable, it is necessary to advise the control circuit as to the nature of the concentrate being dispensed.

For this purpose, the apparatus of FIG. 15 comprises sensors 400*a,b,c* and *d* and information carriers 410*a,b,c,* and *d*. The purpose of the sensors is to obtain a signal which can be input to the control circuit operating the motor for the agitator means 170. This signal may indicate whether the carbonation time period is to correspond to a given level of carbonation: bands such as "low", "medium" and "high" may be designated. By providing the sensors 400*a* to *d* in appropriate positions on the sidewalls 13*c* and 13*d* of the upper housing central portion 13*a*, and complementarily disposed information carries 410*a* to *d* on the containers 14*a* to 14*d* it is possible to provide such signals.

It is important that the information carriers 410*a* to *d* should be so disposed and of such dimensions as to be aligned with the sensors 400*a* to *d*. The physical phenomena employed for this sensing operation may vary. The main requirement is that the information carriers contain the data, for example information indicating "low", "medium" or "high", can be accurately reproduced on a small label which can be applied to the container. It is readily apparent that laminates are available for such labels which may comprise a surface carrier layer for carrying the information and a base layer carrying for example an impact adhesive to be applied to the container 14 and that layer may, prior to application, be covered with a removable masking layer. The information layer may contain data in such forms as a coded magnetic strip or a bar code or an electrically conductive strip or light reflecting surface. The sensors 400*a* to 400*d* will be adapted to "read" such information carriers 410*a* to *d* accordingly.

Again, there are two possibilities. The sensors 400*a* to *d* may either be capable of distinguishing between information carriers bearing coded information so as to indicate one of a plurality of levels of carbonation (as in the example of "low", "medium" and "high" given above). Alternatively, the location of the information carrier 410*a* to d may be varied according to the degree of carbonation required and a plurality of sensors for example a plurality of sensors 400*a* may each be arranged in discrete positions corresponding to the position of an information carrier for a given degree of carbonation.

In the former case where the information carriers 410 are coded to indicate different levels of carbonation requirement, the control circuitry associated with the sensors 400 will need to distinguish between different signals. In the latter case where there are a plurality of sensors 400 for each concentrate container 14, then the control circuitry will be adapted to identify which of the respective sensors 400*a*1, 400*a*2, 400*a*3, has received a signal from the respective information carrier 410.

In a further development of the application of the use of sensors 400 and information carriers 410, it is possible to have in the control circuitry an additional facility for indicating whether a concentrate container placed in a particular position for example the concentrate container 14*a*, has a secondary information carrier 410*a'* indicating that it contains a concentrate which is associated with a label on the related selection button 18*a:* for example, the concentrate container 14*a* could be intended to dispense drinks with an orange flavour and the selection button 18a could indicate that the drinks dispensed by that button had an orange flavour; then the secondary set of sensors and information carriers could be employed to illuminate an indicator associated with the selection button 18a to indicate that the orange flavoured drinks were available to the user.

Applicants have found that the quality of drink dispensed varies according to the carbonation period and the particular concentrate employed so that for example a "cola" flavoured drink requires a different level of carbonation in the water to an "orange" flavoured drink. The associated control circuitry would be set up at the factory to predetermine the carbonation periods according to the flavour of concentrate to be dispensed .at the particular positions indicated for the containers 14*a* to 14*d*.

Cooling of the Concentrate Containers

Reference is made to FIGS. 1,8 and 15. In FIG. 1 the containers 14 are within the compartment covers 13*c* which insulate the containers 14 from the ambient conditions. In FIG. 8 the carbonation chamber 110 and in particular the agitating chamber 114 is surrounded by a cooling jacket 120 containing the chilled water 126. The cooling jacket 120 receives the chilled water from the refrigerating tank 130. The outer walls of the cooling Jacket 120 are made of highly conductive material in order that the cooling jacket 120 not only chills the water in the carbonation chamber 110, but also chills the concentrate in the concentrate containers 14*a* to 14*d*. It will be seen that containers 14 are in close contact with the wall of the cooling jacket 120.

Turning to FIG. 15, it will be seen that the wall configuration of the upper central portion 13*a* of the housing 12*a* allows the containers 14*a* to 14*d* (which are further illustrated in FIGS. 4A and 5A) with correspondingly configured wall surfaces to be brought into immediate contact. Within the compartments described with reference to FIG. 1 the seating of the containers 14 (and the dispensing mechanisms coupled thereto in associated recesses previously described) assist in maintaining the required relationship. By arranging for the outer wall of the cooling jacket 120 is to be formed of highly thermally conductive material, an arrangement is afforded whereby the concentrate in the containers 14*a* is very effectively chilled by the same medium that is employed for chilling the carbonated water. This design is particularlly efficient and avoids additional cooling systems which have been employed in other drink dispensers, some of which involve complicated ducting systems for circulating chilled air. The aforementioned feature enhances the operation of the carbonation apparatus whilst reducing the engineering costs in providing for the cooling of the concentrate in the concentrate containers.

Turning to FIG. 16, there is shown part of the carbonation apparatus 10 of FIG. 1, which illustrates a compartment 13*d* for concentrate containers 14*a*,14*b* (of FIG. 1). This compartment 13*d* has a groove 13e on the rear portion 13*b* of the housing to locate a top wall cover 13*c* (FIG. 1), grooves 13*f*,13*g* on the rear portion 13*b* of the housing and on the main housing 12 respectively to locate edges of a side wall of said cover 13*c*, and groove 13*h* at the front of the housing 12 to locate a front wall of the cover 13*c*.

The grooves 13*g* and 13*h* are bound by abutments (or ridges) 17*a* and 17*b*. Further abutments 17*c*,17*d* extend between the abutment (or ridge) 17*a* and a wall 121 of the cooling jacket 120 (FIG. 8). Abutment 17*c* divides the compartment 13*d* internally into two sub-compartments for the containers 14*a*,14*b*. The abutments 17*a* and b are shown as extending wholly along the full length of the respective parts of the housing 12. Likewise the abutments 17*c,d* are shown as extending continuously between the groove 13*g* and the wall 121. It will be appreciated that these need not be continuous, but that they could be segmented (with regular or irregular spacing).

The abutments 17*a* to 17*d* are for positively locating the containers 14*a*,14*b*. Similar abutments are provided in the other compartment 13*d* on the opposite side of the upper central portion 13*a* of the housing for positively locating containers 14*c,d*.

In addition, FIG. 16 shows recesses 19*a*,19*b* to accommodate the dispensing mechanisms 20*a,b* (shown schematically in FIG. 1). Like recesses 19*c,d* (not shown) are provided in the other compartment 13*d* for dispensing mechanisms 20*c*,20*d*.

Control Circuit 500

A control circuit 500 is shown in block diagram in FIG. 17 in which a number of input means are coupled to a control unit 510 (which includes a microprocessor) to control outputs to a number of active components in the carbonation apparatus 10.

The first input component is the start switch referenced 76. The microswitch 76 is shown in FIG. 3A and is actuated when a particular one of the concentrate selector mechanisms 18*a* to 18*f* is actuated by the user pressing a respective one of the buttons on the front panel 16 (FIG. 1). The microswitch 76 sends a signal to the control unit 510 indicating that a carbonation cycle should be initiated. The next input component is the sensor which is arranged in the dispensing compartment 28. As explained with reference to FIGS. 1 and 3A it is necessary for the user to place a glass 22 in the dispensing compartment 28 in order that the sensor sends a signal to the control unit to indicate that a glass 22 is present whereby the locking plate 54 actuated by a solenoid (not shown) is displaced from its FIG. 3A position to permit the chosen one of the selection buttons 18*a* to *f* to be actuated.

The next input component is the sensor 160 associated with the water meter means 180 in FIG. 8. When the meter means 180 is in the position shown in FIG. 8, the signal via sensor 160 instructs the control unit to start the water supply by means of pump 154. When the meter means 180 is in the position shown in FIG. 9B, the signal from the sensor 160 instructs the control unit to stop the supply of water and the control unit 510 stops the pump 154.

The next input component is the changeover mechanism 300. As mentioned in the description of the changeover mechanism, the changeover mechanism may send a signal to the control unit 510 when the changeover mechanism 300 changes condition (as previously described) in response to one of the gas bottles reaching a low pressure level. The signal to the control unit 510 will be used to illuminate an indicator on panel 16 of FIG. 1 (not shown) indicating that the particular gas bottle 302 or 304 requires replacing.

The next input components are the sensors 400*a* to *d* of FIG. 15 which detect the degree of carbonation required by the concentrate container 14 in the respective compartment 13*d* associated with the particular sensor 400*a* to *d*. The control unit 510 will have timer circuits which are selected to output a carbonation period to the agitating means 170: the agitating means 170 will then be driven by its motor for a period related to the desired carbonation level.

The output components from the control unit 510 will now be described. Solenoid S1 is shown in FIG. 2 and controls the flow of redundant carbonation gas via the line 38 from the carbonation chamber 26 to the reservoirs 40*a* to 40*d* for subsequent use in dispensing concentrate from a selected one of the concentrate dispensing mechanisms 20*a* to *d*. There is a timer circuit in control unit 510 whereby solenoid S1 is opened for a finite period.

The output to locking plate 54 is actually to a solenoid which displaces the locking plate 54 to permit actuation of a selection button 18*a* to *f* once it has been established by the sensor in compartment 28 that a glass or cup 22 is present.

The output to solenoid S2 is to control the solenoid S2 in FIG. 2 and thereby to control the pressure relief valve V3 and the carbonated water dispensing valve V4. The solenoid S2 is actuated to allow carbonation gas from the reservoirs 40*a* to 40*d* through the pressure relief valve V3 and the selection mechanisms 50 (with their selection buttons 18*a* to *d*) to the dispensing mechanisms 20*a* to *d* thereby to discharge a metered quantity of concentrate through the outlet 82 of FIG. 2 into the glass 22. The solenoid S2 also opens the carbonated water dispensing valve V4 to allow a volume of carbonated water to be dispensed to the glass 22 in timed relationship with the dispensing of the concentrate.

The output to the pump 154 actuates the water pump 154 in FIG. 8 so that water from the water supply 150 is pumped into the carbonation chamber 110 and more particularly into the water break chamber 112. As aforementioned, the pumping of water is controlled by the meter means 180 and the sensor 160.

The next output from the control unit 510 is to a gas supply indicator lamp on panel 16 (not shown) for indicating in response to a signal from the changeover mechanism 300 that one of the gas bottles 302 or 304 requires replacing.

The next output is to the motor of the agitating means 170 of FIG. 8. As above-described, the motor will be driven for a finite period according to the required duration of the carbonation cycle in the carbonation chamber 110. The duration of this .period is controlled by the control unit 510 and as above-described, this may be controlled in response to the input signals of the sensors 400.

The next output is to a concentrate indicator on the panel 16 (not shown) which may indicate that a container 14 is empty. An input to the control unit 510 for this purpose could be obtained from a sensor associated with the dispensing mechanisms 20.

A further output signal goes to pump 136 of FIG. 8 which pumps water for the cooling Jacket 120. The control unit 510 will control the pumping of chilled water to the cooling jacket 120 in accordance with a predetermined program. It will be readily appreciated that sensors may be provided for the purpose of inputting signals giving temperature parameters to the control unit 510.

The next output signal is to a solenoid controlling the supply of carbonation gas in the line 36 in FIG. 2. This signal charges the head space in the carbonation chamber 114 of FIG. 8 after that chamber has been filled with water.

The control unit 510 controls the sequence of the cycle of operation of the carbonation apparatus 10. Initially, it will be monitoring the input from the sensor in the dispensing compartment 28 to ensure that a glass 22 is present. Assuming that such a glass is present, it will output a signal to the solenoid controlling the position of the locking plate 54 (FIG. 3A) whereby it is then possible for the user to actuate one of the selection buttons 18*a* to 18*f*. The actuation of a selection button 18 causes the microswitch 76 (FIG. 3A) to start the carbonation cycle. Assuming that the carbonation chamber 114 (FIG. 8) contains water to the required level, the first step then required is to charge the head space with carbonation gas from the supply 34 (FIG. 2). This is achieved by outputting a signal to a solenoid in the line 36 for gas to be supplied to the carbonation chamber. When the carbonation chamber has been charged with gas, the solenoid in line 36 is closed. Meanwhile the dispensing mechanism 20A (FIG. 4A) has been vented to atmosphere so that the chamber thereof is charged with concentrate which has flowed thereto under gravity from the container 14. When the carbonation chamber has been charged with gas, the control unit initiates a carbonation cycle for the agitator means 170 by outputting a signal to the motor thereof for the required finite duration. After this period, the control unit sends a signal to solenoid S2 whereby a charge of redundant carbonation gas from the reservoirs 40*a* to *d* is allowed to pass through the pressure relief valve V3 through the selection mechanism 50 associated with the chosen selection button 18 and to the dispensing mechanism 20 whereby a metered quantity of concentrate is dispensed through the outlet 82 of FIG. 2. In timed relationship thereto the valve V4 is opened so that the carbonated water flows from the carbonation chamber into the glass 22. It will be seen that in this embodiment, the solenoid S2 is the means by which the dispensing of both concentrate and carbonated water is effected in timed relationship. Prior to the dispensing of the carbonated water, the control unit opens the solenoid S1 so that the redundant gas in the head space of the carbonation chamber 26 (FIG. 2) is used to charge the reservoirs 40*a* to 40*d*.

Disposable Syrup Dispenser

Modified forms of syrup dispenser, which are low-cost and disposable after use, are illustrated in FIGS. 18 to 28. These may be employed instead of the units shown in FIGS. 4 and 5.

FIGS. 18 to 25 show a concentrate supply device 2' comprising a concentrate container 4', such as a liquid tight box, and a concentrate dispensing unit 6' which is secured to the container 4' and is for dispensing concentrate therefrom in metered quantities. Initially, the container 4' is filled with liquid concentrate 8' to be dispensed although each of FIGS. 18 to 21 show that the container 4' has already been partly emptied.

The dispensing unit 6' comprises a cylindrical side wall 10' which is secured, as by welding, to a disc shaped upper wall 12' having an outwardly extending flange 14' by which the unit 6 is secured, again as by welding, to a wall 16' of the container 4'. A lower wall 18' of the unit 6' is carried by the cylindrical wall 10' and has a central circular aperture 20' through which projects a stem 22', of circular cross-section, carried by the upper wall 12'. A flexible plastics diaphragm 24' of relatively flimsy material is provided in the unit 6'. The diaphragm 24', as best seen in FIG. 23, is of bag-like construction and is of a size and shape such that, as shown in FIG. 19, it may conform to the interior of the walls 10' and 18'. The diaphragm is open at its upper end and the upper edge 26' thereof is secured between the walls 10' and 12'. The diaphragm 24' has an opening 28' at its lower end and the perimeter of the opening 28' of the diaphragm is secured as by welding to the portion of the wall 18' surrounding the aperture 20'. The diaphragm 24' accordingly divides the interior of the unit 6' into two chambers 30' and 32'. The chamber 30' communicates with the interior of vessel 4' through a passage 34' which may be closed by a one-way valve 36' and the chamber 32' may receive pressurised gas from a gas supply (not shown) through a nipple 38' into which the end of a gas supply pipe 40' (corresponding to pipe 44 of FIG. 2) may be inserted. Preferably, the wall 12', flanges 16' and stem 22' are formed as a first unitary plastics moulding and the wall 10', wall 18' and nipple 38' are formed as a second unitary plastics moulding, the two mouldings being secured together with the upper edge 26' of the diaphragm 24' clamped therebetween.

The stem 22' is hollow to define a passage 42' which, at its lower end communicates with atmosphere, and its upper end may communicate with the interior of the container 4' through a passage 44' which may be closed by a one-way valve 46'.

A circumferential channel 48' is provided on the outside of stem 22' at a position near but spaced from the lower end. The size of the opening 20' in wall 18' is such that the wall 18' extends into the channel 48' and normally contacts the stem 20' at a point 50' therein to form a seal. Four axial channels 52' extend along the exterior of the portion of the stem 20' below the circumferential channel 50'. The wall 18' is flexibly resilient so that it may bend from the full line position shown in FIG. 19 in which a seal is formed at point 50' to the chain dotted line position 54' shown in FIG. 19 in which the seal at point 50' is broken and contact is made with the stem at point 56' adjacent the upper end of the channel 52'. The resilience of the wall 18' is sufficient to permit the lower part of stem 22' to be pushed through the aperture 20' during assembly.

The valve 36' is made of a unitary moulding of synthetic plastics material and comprises a ball 60' forming a valve head, a ligament 62' extending through the passage 34' and a cross-bar 64' on the opposite side of the passage 36' to the head 60' and acting as a stop limiting the downwards movement of the head 60'. The ligament 62' is sufficiently flexible to enable it to be bent so that the cross-bar 64' extends generally parallel to the ligament to enable the ligament and cross-bar to be threaded through the aperture 34' during manufacture. The construction of the valve 46' is identical to the valve 36' and thus comprises a head 70', ligament 72' and cross-bar 74'.

The device illustrated in FIGS. 18 to 25 will normally be supplied to customers with the container 4' filled with concentrate and the metering unit 6' empty. A cap 76' shown in broken lines in FIG. 18 only is preferably included and is attached to the unit 6' by a breakable seal (not shown) and covers the lower end of the stem 22' and the nipple 38'. In order to use the device, the customer removes the cap 76' and inserts the device into a carbonating apparatus, not described herein in detail, which is designed for receiving the device 2'. The device 2' is inserted in the carbonating apparatus in the "inverted" position illustrated in FIGS. 19 to 21 and the pipe 40', which is part of the carbonation apparatus, is inserted into the nipple 38' and forms a gas tight seal therewith. At this point, the chamber 32' is not pressurised and, as a result, liquid may flow under gravity from the interior of the container 4' into the chamber 30', the valve 36' opening for this purpose as shown in FIG. 18. As liquid leaves the interior of the container 4' and enters the chamber 30', pressure within the container 4' may reduce and as a result atmospheric pressure acting on valve head 70' will cause the valve 46' to open to permit air to bubble up through the liquid in container 4' as indicated at 78' in FIG. 18. Of course, if the chamber 30' is filled with air when the device is first used, the air in the chamber 30' will first be transferred through the passage 34' into the container 4' as liquid enters the chamber 30', in which the case the opening of the valve 46' may be delayed.

As shown in FIG. 19, after the chamber 30' has been filed with liquid concentrate from the container 4', valve 46' closes. The unit 6' now contains a metered quantity of liquid to be dispensed. As shown in FIG. 20, this metered quantity of liquid may be dispensed from the unit 6' by permitting gas pressure to enter chamber 32' through pipe 40'. The admission of such gas is preferably controlled by a control and timing system (not shown) of the carbonation apparatus (not shown) with which the device 2' is used, such as that previously described. As the pressure in chamber 32' increases, the resulting tendency of the liquid in chamber 30' to be forced upwardly through the passage 34' causes the valve 36' to close (FIG. 20). This pressure also causes wall 18' to flex downwardly as shown in FIG. 20 and in broken lines in FIG. 24, thus allowing liquid in the chamber 30' to be discharged therefrom through the opening 20' in the wall 18'. If the pressure in chamber 32' is sufficiently high, the wall 18' will be bent to the chain dotted line position shown in FIG. 24 and the liquid leaving the chamber 32' will pass through the relatively small apertures defined by the channels 52' and the edge of the wall 18' around the opening 20', as indicated by arrows 80' in FIG. 24. If the pressure is somewhat lower than that necessary to achieve this condition, contact will not be made at point 56' between wall 18' and stem 22' and as a result, the outflow of liquid will not be constricted by the channels 52'. In this way, variations in the rate of outflow of liquid as a result of pressure variations in chamber 32' may be reduced.

Figure 21:
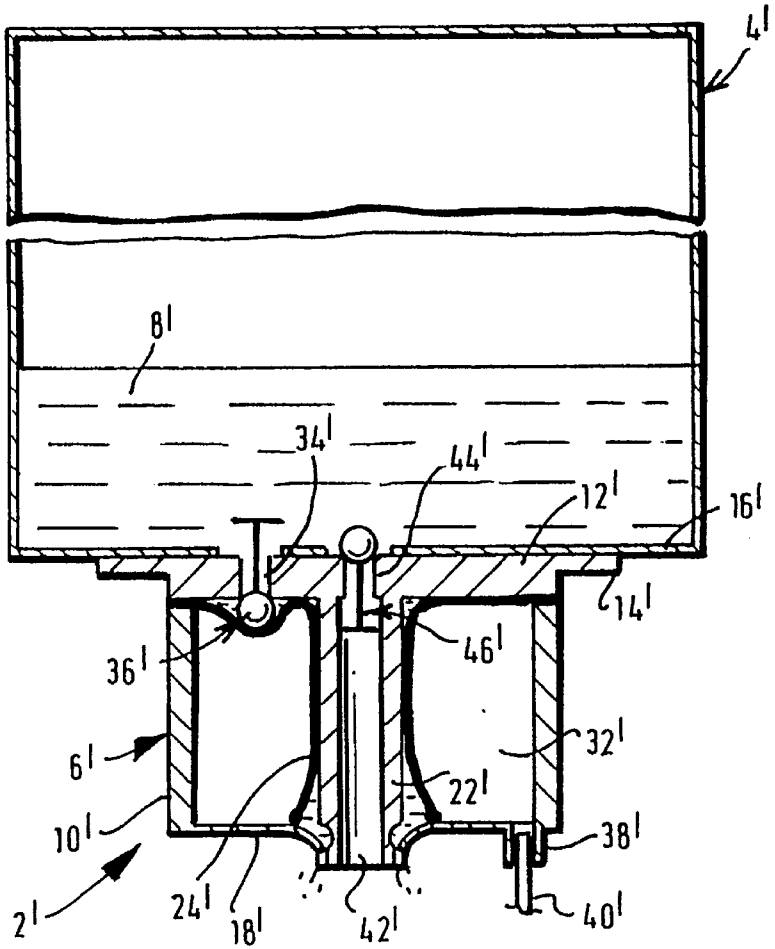

The pressure in chamber 32' is retained long enough to substantially empty the chamber 30' of liquid, at which point, as shown in FIG. 21, the diaphragm 24' has reduced the volume of chamber 30' to near to zero. Thereafter, the pressure in chamber 32' may be released and chamber 30' will again fill with concentrate as shown in FIGS. 18 and 20;

The embodiment shown in FIGS. 27 to 28 is the same as that of FIGS. 18 to 25 except that the lower wall 18A' of unit 6' is substantially rigid and, instead, the upper wall 12A' is resiliently flexible and is thus somewhat thinner than the wall 12'. FIG. 26 shows the chamber filled with liquid 30' to be dispensed and FIG. 25 shows the dispensing operation with the chamber 32' pressurised. As can be seen, the wall 12A' flexes upwardly to draw the stem 20' upwardly with respect to the aperture 20' in wall 18A', thus permitting liquid to be discharged from the chamber 30' through aperture 20'. The distance through which the stem 20' moves upwardly relative to the wall 18' depends upon the pressure in the chamber 32' so that, when the pressure is high, the liquid is constrained to flow through the restricted area defined by the edge of the wall 18A' around the aperture 20' and the channels 52' whereas lower pressures cause the stem 20' to assume intermediate position at which the area available for the outflow of liquid is greater.

Various modifications are possible within the scope of the invention. For example, although it has been assumed that the container 4' is of relatively rigid material in the illustrated embodiments, thus requiring provision for air to enter as the liquid leaves (this provision being the valve 46' in the embodiment shown in the drawings), the invention can be applied to so-called "bag-in-a-box" containers in which the liquid is contained in a collapsible bag located in a box. In this case, dispensing can be achieved without the need for air to enter the bag containing the liquid since this collapses under atmospheric pressure as liquid is withdrawn.

The invention provides a highly advantageous and inexpensive device for dispensing concentrate which may be made sufficiently cheaply to be disposed of after the liquid in the container with which it is used has been consumed.

FIGS. 18 to 25 show a concentrate supply device 2' comprising a concentrate container 4', such as a liquid tight box, and a concentrate dispensing unit 6' which is secured to the container 4' and is for dispensing concentrate therefrom in metered quantities. Initially, the container 4' is filled with liquid concentrate 8' to be dispensed although each of FIGS. 18 to 21 show that the container 4' has already been partly emptied.

The dispensing unit 6' comprises a cylindrical side wall 10' which is secured, as by welding, to a disc shaped upper wall 12' having an outwardly extending flange 14' by which the unit 6 is secured, again as by welding, to a wall 16' of the container 4'. A lower wall 18' of the unit 6' is carried by the cylindrical wall 10' and has a central circular aperture 20' through which projects a stem 22', of circular cross-section, carried by the upper wall 12'. A flexible plastics diaphragm 24' of relatively flimsy material is provided in the unit 6'. The diaphragm 24', as best seen in FIG. 23, is of bag-like construction and is of a size and shape such that, as shown in FIG. 19, it may conform to the interior of the walls 10' and 18'. The diaphragm is open at its upper end and the upper edge 26' thereof is secured between the walls 10' and 12'. The diaphragm 24' has an opening 28' at its lower end and the perimeter of the opening 28' of the diaphragm is secured as by welding to the portion of the wall 18' surrounding the aperture 20'. The diaphragm 24' accordingly divides the interior of the unit 6' into two chambers 30' and 32'. The chamber 30' communicates with the interior of vessel 4' through a passage 34' which may be closed by a one-way valve 36' and the chamber 32' may receive pressurised gas from a gas supply (not shown) through a nipple 38' into which the end of a gas supply pipe 40' may be inserted. Preferably, the wall 12', flanges 16' and stem 22' are formed as a first unitary plastics moulding and the wall 10', wall 18' and nipple 38' are formed as a second unitary plastics moulding, the two mouldings being secured together with the upper edge 26' of the diaphragm 24' clamped therebetween.

The stem 22' is hollow to define a passage 42' which, at its lower end communicates with atmosphere, and its upper end may communicate with the interior of the container 4' through a passage 44' which may be closed by a one-way valve 46'.

A circumferential channel 48' is provided on the outside of stem 22' at a position near but spaced from the lower end. The size of the opening 20' in wall 18' is such that the wall 18' extends into the channel 48' and normally contacts the stem 20' at a point 50' therein to form a seal. Four axial channels 52' extend along the exterior of the portion of the stem 20' below the circumferential channel 50'. The wall 18' is flexibly resilient so that it may bend from the full line position shown in FIG. 19 in which a seal is formed at point 50' to the chain dotted line position 54' shown in FIG. 19 in which the seal at point 50' is broken and contact is made with the stem at point 56' adjacent the upper end of the channel 52'. The resilience of the wall 18' is sufficient to permit the lower part of stem 22' to be pushed through the aperture 20' during assembly.

The valve 36' is made of a unitary moulding of synthetic plastics material and comprises a ball 60' forming a valve head, a ligament 62' extending through the passage 34' and a cross-bar 64' on the opposite side of the passage 36' to the head 60' and acting as a stop limiting the downwards movement of the head 60'. The ligament 62' is sufficiently flexible to enable it to be bent so that the cross-bar 64' extends generally parallel to the ligament to enable the ligament and cross-bar to be threaded through the aperture 34' during manufacture. The construction of the valve 46' is identical to the valve 36' and thus comprises a head 70', ligament 72' and cross-bar 74'.

The device illustrated in FIGS. 18 to 25 will normally be supplied to customers with the container 4' filled with concentrate and the metering unit 6' empty. A cap 76' shown in broken lines in FIG. 18 only is preferably included and is attached to the unit 6' by a breakable seal (not shown) and covers the lower end of the stem 22' and the nipple 38'. In order to use the device, the customer removes the cap 76' and inserts the device into a carbonating apparatus, not described herein in detail, which is designed for receiving the device 2'. The device 2' is inserted in the carbonating apparatus in the "inverted" position illustrated in FIGS. 19 to 21 and the pipe 40', which is part of the carbonation apparatus, is inserted into the nipple 38' and forms a gas tight seal therewith. At this point, the chamber 32' is not pressurised and, as a result, liquid may flow under gravity from the interior of the container 4' into the chamber 30', the valve 36' opening for this purpose as shown in FIG. 18. As liquid leaves the interior of the container 4' and enters the chamber 30', pressure within the container 4' may reduce and as a result atmospheric pressure acting on valve head 70' will cause the valve 46' to open to permit air to bubble up through the liquid in container 4' as indicated at 78' in FIG. 18. Of course, if the chamber 30' is filled with air when the device is first used, the air in the chamber 30' will first be transferred through the passage 34' into the container 4' as liquid enters the chamber 30', in which the case the opening of the valve 46' may be delayed.

As shown in FIG. 19, after the chamber 30' has been filed with liquid concentrate from the container 4', valve 46' closes. The unit 6' now contains a metered quantity of liquid to be dispensed. As shown in FIG. 20, this metered quantity of liquid may be dispensed from the unit 6' by permitting gas pressure to enter chamber 32' through pipe 40'. The admission of such gas is preferably controlled by a control and timing system (not shown) of the carbonation apparatus (not shown) with which the device 2' is used. Such a system is described in our co-pending UK application no. 8914420.8. As the pressure in chamber 32' increases, the resulting tendency of the liquid in chamber 30' to be forced upwardly through the passage 34' causes the valve 36' to close (FIG. 20). This pressure also causes wall 18' to flex downwardly as shown in FIG. 20 and in broken lines in FIG. 24, thus allowing liquid in the chamber 30' to be discharged therefrom through the opening 20' in the wall 18'. If the pressure in chamber 32' is sufficiently high, the wall 18' will be bent to the chain dotted line position shown in FIG. 24 and the liquid leaving the chamber 32' will pass through the relatively small apertures defined by the channels 52' and the edge of the wall 18' around the opening 20', as indicated by arrows 80' in FIG. 24. If the pressure is somewhat lower than that necessary to achieve this condition, contact will not be made at point 56' between wall 18' and stem 22' and as a result, the outflow of liquid will not be constricted by the channels 52'. In this way, variations in the rate of outflow of liquid as a result of pressure variations in chamber 32' may be reduced.

The pressure in chamber 32' is retained long enough to substantially empty the chamber 30' of liquid, at which point, as shown in FIG. 21, the diaphragm 24' has reduced the volume of chamber 30' to near to zero. Thereafter, the pressure in chamber 32' may be released and chamber 30' will again fill with concentrate as shown in FIGS. 18 and 20;

The embodiment shown in FIGS. 27 to 28 is the same as that of FIGS. 18 to 25 except that the lower wall 18A' of unit 6' is substantially rigid and, instead, the upper wall 12A' is resiliently flexible and is thus somewhat thinner than the wall 12'. FIG. 26 shows the chamber filled with liquid 30' to be dispensed and FIG. 25 shows the dispensing operation with the chamber 32' pressurised. As can be seen, the wall 12A' flexes upwardly to draw the stem 20' upwardly with respect to the aperture 20' in wall 18A', thus permitting liquid to be discharged from the chamber 30' through aperture 20'. The distance through which the stem 20' moves upwardly relative to the wall 18' depends upon the pressure in the chamber 32' so that, when the pressure is high, the liquid is constrained to flow through the restricted area defined by the edge of the wall 18A' around the aperture 20' and the channels 52' whereas lower pressures cause the stem 20' to assume intermediate position at which the area available for the outflow of liquid is greater.

Various modifications are possible within the scope of the invention. For example, although it has been assumed that the container 4' is of relatively rigid material in the illustrated embodiments, thus requiring provision for air to enter as the liquid leaves (this provision being the valve 46' in the embodiment shown in the drawings), the invention can be applied to so-called "bag-in-a-box" containers in which the liquid is contained in a collapsible bag located in a box. In this case, dispensing can be achieved without the need for air to enter the bag containing the liquid since this collapses under atmospheric pressure as liquid is withdrawn.

The invention provides a highly advantageous and inexpensive device for dispensing concentrate which may be made sufficiently cheaply to be disposed of after the liquid in the container with which it is used has been consumed.

FIGS. 18 to 25 show a concentrate supply device 2' comprising a concentrate container 4', such as a liquid tight box, and a concentrate dispensing unit 6' which is secured to the container 4' and is for dispensing concentrate therefrom in metered quantities. Initially, the container 4' is filled with liquid concentrate 8' to be dispensed although each of FIGS. 18 to 21 show that the container 4' has already been partly emptied.

The dispensing unit 6' comprises a cylindrical side wall 10' which is secured, as by welding, to a disc shaped upper wall 12' having an outwardly extending flange 14' by which the unit 6 is secured, again as by welding, to a wall 16' of the container 4'. A lower wall 18' of the unit 6' is carried by the cylindrical wall 10' and has a central circular aperture 20' through which projects a stem 22', of circular cross-section, carried by the upper wall 12'. A flexible plastics diaphragm 24' of relatively flimsy material is provided in the unit 6'. The diaphragm 24', as best seen in FIG. 23, is of bag-like construction and is of a size and shape such that, as shown in FIG. 19, it may conform to the interior of the walls 10' and 18'. The diaphragm is open at its upper end and the upper edge 26' thereof is secured between the walls 10' and 12'. The diaphragm 24' has an opening 28' at its lower end and the perimeter of the opening 28' of the diaphragm is secured as by welding to the portion of the wall 18' surrounding the aperture 20'. The diaphragm 24' accordingly divides the interior of the unit 6' into two chambers 30' and 32'. The chamber 30' communicates with the interior of vessel 4' through a passage 34' which may be closed by a one-way valve 36' and the chamber 32' may receive pressurised gas from a gas supply (not shown) through a nipple 38' into which the end of a gas supply pipe 40' may be inserted. Preferably, the wall 12', flanges 16' and stem 22' are formed as a first unitary plastics moulding and the wall 10', wall 18' and nipple 38' are formed as a second unitary plastics moulding, the two mouldings being secured together with the upper edge 26' of the diaphragm 24' clamped therebetween.

The stem 22' is hollow to define a passage 42' which, at its lower end communicates with atmosphere, and its upper end may communicate with the interior of the container 4' through a passage 44' which may be closed by a one-way valve 46'.

A circumferential channel 48' is provided on the outside of stem 22' at a position near but spaced from the lower end. The size of the opening 20' in wall 18' is such that the wall 18' extends into the channel 48' and normally contacts the stem 20' at a point 50' therein to form a seal. Four axial channels 52' extend along the exterior of the portion of the stem 20' below the circumferential channel 50'. The wall 18' is flexibly resilient so that it may bend from the full line position shown in FIG. 19 in which a seal is formed at point 50' to the chain dotted line position 54' shown in FIG. 19 in which the seal at point 50' is broken and contact is made with the stem at point 56' adjacent the upper end of the channel 52'. The resilience of the wall 18' is sufficient to permit the lower part of stem 22' to be pushed through the aperture 20' during assembly.

The valve 36' is made of a unitary moulding of synthetic plastics material and comprises a ball 60' forming a valve head, a ligament 62' extending through the passage 34' and a cross-bar 64' on the opposite side of the passage 36' to the head 60' and acting as a stop limiting the downwards movement of the head 60'. The ligament 62' is sufficiently flexible to enable it to be bent so that the cross-bar 64' extends generally parallel to the ligament to enable the ligament and cross-bar to be threaded through the aperture 34' during manufacture. The construction of the valve 46' is identical to the valve 36' and thus comprises a head 70', ligament 72' and cross-bar 74'.

The device illustrated in FIGS. 18 to 25 will normally be supplied to customers with the container 4' filled with concentrate and the metering unit 6®empty. A cap 76' shown in broken lines in FIG. 18 only is preferably included and is attached to the unit 6' by a breakable seal (not shown) and covers the lower end of the stem 22' and the nipple 38'. In order to use the device, the customer removes the cap 76' and inserts the device into a carbonating apparatus, not described herein in detail, which is designed for receiving the device 2'. The device 2' is inserted in the carbonating apparatus in the "inverted" position illustrated in FIGS. 19 to 21 and the pipe 40', which is part of the carbonation apparatus, is inserted into the nipple 38' and forms a gas tight seal therewith. At this point, the chamber 32' is not pressurised and, as a result, liquid may flow under gravity from the interior of the container 4' into the chamber 30', the valve 36' opening for this purpose as shown in FIG. 18. As liquid leaves the interior of the container 4' and enters the chamber 30', pressure within the container 4' may reduce and as a result atmospheric pressure acting on valve head 70' will cause the valve 46' to open to permit air to bubble up through the liquid in container 4' as indicated at 78' in FIG. 18. Of course, if the chamber 30' is filled with air when the device is first used, the air in the chamber 30' will first be transferred through the passage 34' into the container 4' as liquid enters the chamber 30', in which the case the opening of the valve 46' may be delayed.

As shown in FIG. 19, after the chamber 30' has been filed with liquid concentrate from the container 4', valve 46' closes. The unit 6' now contains a metered quantity of liquid to be dispensed. As shown in FIG. 20, this metered quantity of liquid may be dispensed from the unit 6' by permitting gas pressure to enter chamber 32' through pipe 40'. The admission of such gas is preferably controlled by a control and timing system (not shown) of the carbonation apparatus (not shown) with which the device 2' is used, such as that previously described. As the pressure in chamber 32' increases, the resulting tendency of the liquid in chamber 30' to be forced upwardly through the passage 34' causes the valve 36' to close (FIG. 20). This pressure also causes wall 18' to flex downwardly as shown in FIG. 20 and in broken lines in FIG. 24, thus allowing liquid in the chamber 30' to be discharged therefrom through the opening 20' in the wall 18'. If the pressure in chamber 32' is sufficiently high, the wall 18' will be bent to the chain dotted line position shown in FIG. 24 and the liquid leaving the chamber 32' will pass through the relatively small apertures defined by the channels 52' and the edge of the wall 18' around the opening 20', as indicated by arrows 80' in FIG. 24. If the pressure is somewhat lower than that necessary to achieve this condition, contact will not be made at point 56' between wall 18' and stem 22' and as a result, the outflow of liquid will not be constricted by the channels 52'. In this way, variations in the rate of outflow of liquid as a result of pressure variations in chamber 32' may be reduced.

The pressure in chamber 32' is retained long enough to substantially empty the chamber 30' of liquid, at which point, as shown in FIG. 21, the diaphragm 24' has reduced the volume of chamber 30' to near to zero. Thereafter, the pressure in chamber 32' may be released and chamber 30' will again fill with concentrate as shown in FIGS. 18 and 20;

The embodiment shown in FIGS. 27 to 28 is the same as that of FIGS. 18 to 25 except that the lower wall 18A' of unit 6' is substantially rigid and, instead, the upper wall 12A' is resiliently flexible and is thus somewhat thinner than the wall 12'. FIG. 26 shows the chamber filled with liquid 30' to be dispensed and FIG. 25 shows the dispensing operation with the chamber 32' pressurised. As can be seen, the wall 12A' flexes upwardly to draw the stem 20' upwardly with respect to the aperture 20' in wall 18A', thus permitting liquid to be discharged from the chamber 30' through aperture 20'. The distance through which the stem 20' moves upwardly relative to the wall 18' depends upon the pressure in the cheer 32' so that, when the pressure is high, the liquid is constrained to flow through the restricted area defined by the edge of the wall 18A' around the aperture 20' and the channels 52' whereas lower pressures cause the stem 20' to assume intermediate position at which the area available for the outflow of liquid is greater.

Various modifications are possible within the scope of the invention. For example, although it has been assumed that the container 4' is of relatively rigid material in the illustrated embodiments, thus requiring provision for air to enter as the liquid leaves (this provision being the valve 46' in the embodiment shown in the drawings), the invention can be applied to so-called "bag-in-a-box" containers in which the liquid is contained in a collapsible bag located in a box. In this case, dispensing can be achieved without the need for air to enter the bag containing the liquid since this collapses under atmospheric pressure as liquid is withdrawn.

The invention provides a highly advantageous and inexpensive device for dispensing concentrate which may be made sufficiently cheaply to be disposed of after the liquid in the container with which it is used has been consumed.

We claim:

1. A device for discharging metered quantities of liquid concentrate comprising a housing having wall means defining a hollow interior, a flexible member dividing the interior of the housing into a first chamber and a second chamber, inlet valve means in communication with the first chamber for permitting flow of concentrate therethrough into the first chamber when the inlet valve means is open and the inlet valve being closeable to resist reverse flow of concentrate therethrough, outlet valve means in communication with the first chamber for discharging concentrate therefrom, and gas inlet means in communication with the second chamber for the supply of gas thereto for pressurization of said hollow interior to cause said flexible member to flex so as to discharge concentrate from the first chamber through said outlet valve means, said outlet valve means comprising an opening in a first portion of said wall means and a valve head carried by a second portion of said wall means, said first and second portions of said wall means being relatively movable for effecting relative movement of the valve head and the valve opening, and being resiliently biased to a first relative position in which the opening is closed by the valve head and being arranged to move in response to said pressurization to a second relative position in which the outlet valve means is open.

2. Apparatus according to claim 1 in which the first portion of the wall means is relatively flexible and the second portion of the wall means is relatively rigid so that, in response to said pressurization, the first portion of the wall means moves relative to the second portion of the wall means thereby moving the valve head to open the outlet valve means.

3. Apparatus according to claim 1 in which the first portion of the wall means is relatively rigid and the second portion of the wall means is relatively flexible so that, in response to said pressurization, the second portion of the wall means moves relative to the first portion of the wall means thereby moving the valve opening to open the outlet valve means.

4. Apparatus accordingly to claim 1 in which the first portion of the wall means and the second portion of the wall means are arranged generally opposite each other.

5. Apparatus according to claim 1 in which said hollow interior is generally cylindrical with the first and second portions of the wall means being disposed at respective opposite ends of said generally cylindrical hollow interior and the flexible member being generally cup-shaped and arranged to substantially conform with the interior wall of said hollow interior when said hollow interior is not pressurized

6. Apparatus according to claim 1 in which the valve head is connected to the second portion of the wall means by a stem which extends axially through the hollow interior.

7. Apparatus accordingly to claim 1 in which the second portion of the wall means also carries the inlet valve means and a first portion of the flexible member is sealably engaged around the periphery of the second portion of the wall means, and a second portion of the flexible member being sealably engaged with the first portion of the wall means around the periphery of the valve opening.

8. Apparatus according to claim 1 in combination with a container containing liquid concentrate in fluid communication with said inlet valve means for providing liquid concentrate therethrough and a pressurized gas supply in fluid communication with said gas inlet means for the supply of gas therethrough for said pressurization.

9. Apparatus according to claim 8 in which said valve head further comprises an air inlet valve means in communication with the exterior of said housing and the interior of said container containing liquid concentrate for permitting the flow of gas therethrough into said container and the air inlet valve being closable to resist the flow of concentrate from said container therethrough.

10. Apparatus according to claim 9 in which the valve head means is connected to the second portion of the wall means by a stem which extends axially through the hollow interior which stem has a hollow center providing fluid communication between said interior of said container containing liquid concentrate and said air inlet valve means.

11. Apparatus according to claim 1 in which the first and second portions of said wall means are resiliently biased to said first relative position by resilient deformation of said wall means.

* * * * *

UNITED STATES PATENT AND TRADEMARK OFFICE

CERTIFICATE OF CORRECTION

PATENT NO. : 5,499,741

DATED : March 19, 1996

INVENTOR(S) : Alistair Scott, et al.

It is certified that error appears in the above-indentified patent and that said Letters Patent is hereby corrected as shown below:

On the title page, item [62], should read--Division of Ser. No. 778,811, Jan. 23, 1992, now abandoned, which was the national stage of international application number PCT/GB90/00946, Jun. 19, 1990--,

Column 2, line 41, delete "aspect)" and insert --aspect,-- therefore.

Column 15, line 11, delete "Jacket" and insert --jacket-- therefore.

Column 18, line 57, delete "Journey" and insert --journey-- therefore.

Column 23, line 26, delete ".at" and insert --at-- therefore.

Column 23, line 36, delete "Jacket" and insert --jacket-- therefore.

Column 25, line 54, delete "Jacket" and insert --jacket-- therefore.

Column 32, line 41, delete "®" and insert --'-- therefore.

Column 33, line 45, delete "cheer" and insert --chamber-- therefore.

Signed and Sealed this

Fifth Day of November, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,499,741

DATED : March 19, 1996

INVENTOR(S) : Scott et al.

It is certified that error appears in the above-identified patent and that said Letters Patent is hereby corrected as shown below:

Title page, after "[76 Inventors]" insert --Assignee: Isoworth Limited, Petersborough, England--.

Column 34, line 52, "accordingly" should read --according--.

Signed and Sealed this

Eleventh Day of February, 1997

*Attest:*

*Attesting Officer*

BRUCE LEHMAN

*Commissioner of Patents and Trademarks*